US007187901B2

(12) United States Patent
Ohashi

(10) Patent No.: US 7,187,901 B2
(45) Date of Patent: Mar. 6, 2007

(54) RECORDING APPARATUS

(75) Inventor: Tetsuyo Ohashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/926,144

(22) Filed: Aug. 26, 2004

(65) Prior Publication Data

US 2005/0047840 A1 Mar. 3, 2005

(30) Foreign Application Priority Data

Aug. 29, 2003 (JP) ..... 2003-306415

(51) Int. Cl.
*G03G 15/00* (2006.01)

(52) U.S. Cl. ..... 399/388; 399/381

(58) Field of Classification Search ..... 399/388, 399/381; 400/61; 347/104
See application file for complete search history.

(56) References Cited

U.S. PATENT DOCUMENTS

| | | | | |
|---|---|---|---|---|
| 5,580,042 | A * | 12/1996 | Taniguro et al. | 271/274 |
| 5,620,174 | A * | 4/1997 | Taniguro et al. | 271/10.12 |
| 5,672,091 | A * | 9/1997 | Takahashi et al. | 451/6 |
| 6,012,810 | A | 1/2000 | Ohashi | 347/104 |
| 6,092,892 | A * | 7/2000 | Taniguro et al. | 347/104 |
| 6,129,461 | A * | 10/2000 | Nakai | 400/59 |
| 6,222,571 | B1 * | 4/2001 | Sasaki et al. | 347/175 |
| 6,457,888 | B1 * | 10/2002 | Matsumoto | 400/625 |
| 6,550,907 | B2 * | 4/2003 | Uchida | 347/104 |
| 6,796,648 | B2 | 9/2004 | Ohashi | 347/104 |
| 6,869,175 | B2 * | 3/2005 | Sinmmachi | 347/104 |
| 6,869,235 | B2 * | 3/2005 | Kawaguchi et al. | 400/59 |
| 6,935,737 | B2 * | 8/2005 | Kanome et al. | 347/104 |
| 6,953,246 | B2 * | 10/2005 | Takahashi et al. | 347/104 |
| 2002/0067940 | A1 | 6/2002 | Sasai et al. | 400/61 |
| 2004/0017459 | A1 | 1/2004 | Kawaguchi et al. | 347/104 |
| 2004/0165019 | A1 | 8/2004 | Ohashi | 347/104 |

FOREIGN PATENT DOCUMENTS

| | | |
|---|---|---|
| EP | 1 380 432 | 1/2004 |
| JP | 2004-42392 | 2/2004 |
| WO | WO 99/52713 | 10/1999 |

* cited by examiner

*Primary Examiner*—Anthony H. Nguyen
(74) *Attorney, Agent, or Firm*—Fitzpatrick, Cella, Harper & Scinto

(57) ABSTRACT

A recording apparatus is capable of reducing the operations to be executed by a user in a case of employing a thick recording sheet for a recording operation, thereby improving the operability of the recording apparatus. A thick sheet guide, which is mountable on the recording apparatus, is capable of assuming a first state for guiding a recording sheet in a case of supply of the recording sheet to a recording portion from a downstream side in a normal conveying direction, and a second state retracted from a conveying path in a case of conveying of the recording sheet in the normal direction. In the recording apparatus, a pinch roller is separated from a sheet conveying roller when a sensor detects that the thick sheet guide is shifted from the second state to the first state.

6 Claims, 25 Drawing Sheets

RECORDING APPARATUS

BACKGROUND OF THE INVENTION

1. Field of the Invention

The present invention relates to a recording apparatus provided with a mechanism for recording on a recording medium of a large thickness and a high bending rigidity.

2. Related Background Art

For recording on a recording medium of a large thickness in a recording apparatus such as an ink jet recording apparatus, several systems have been proposed or practiced. In all these systems, a straight path for the recording medium is provided in an ordinary recording apparatus, and the recording medium is conveyed by a sheet conveying roller same as that used for conveying a recording medium of an ordinary thickness.

Among these, there is known a recording apparatus disclosed in US-2002-067940 in which the user inserts a thick recording medium by once separating a pair of sheet conveying rollers maintained in mutual press-contact, then returns the sheet conveying rollers in a mutually press-contacted state and the rollers are rotated to convey such thick recording medium. There is also commercialized a system in which the thick recording medium is formed in a thin tapered shape at a front end thereof so as to be spontaneously introduced in a nip of the paired sheet conveying rollers, whereby introduction and conveying of the thick recording medium are achieved by the rotation of the paired sheet conveying rollers.

However such prior technologies have been associated with certain limitations. As one of such limitations, the user is required to execute an operation of separating the paired sheet conveying rollers and an operation of bringing the rollers in mutual press-contact again prior to the start of a recording operation. For this reason, certain complex operations are necessary and the operability is deteriorated.

Also the system in which the thick recording medium is formed in the thin tapered shape at the front end thereof can only utilize an exclusive thick recording medium formed in such shape and is unable to execute recording on an ordinary thick recording medium.

SUMMARY OF THE INVENTION

An object of the present invention is to provide a recording apparatus capable of reducing operations to be executed by the user in case of using a thick recording medium as the recording medium, thereby improving the operability of the apparatus. Another object of the present invention is to provide a recording apparatus capable, in case of utilizing a thick recording medium, of feeding and recording even on a non-exclusive recording medium.

Still another object of the present invention is to provide a recording apparatus including a conveying portion which supports a recording medium by a conveying roller and a pinch roller pressed to such conveying roller, thereby conveying the recording medium to a position opposed to a recording portion, guide means which is provided mountably on the recording apparatus for supplying a recording medium from a downstream side in a conveying direction of the recording medium by the conveying portion during a recording operation by the recording portion, and which can assume a first mode capable of supplying the recording medium from such downstream side and a second mode incapable of supplying the recording medium from the downstream side, detection means which detects whether the guide means is in the first mode or in the second mode, and displacing means which displaces the pinch roller in a position in contact with the conveying roller or in a position separated from the conveying roller, wherein the displacing means separates the pinch roller from the conveying roller in response to a detection by the detection means that the guide means shifts from the second mode to the first mode.

DESCRIPTION OF THE PREFERRED EMBODIMENTS

In the following, the present invention will be clarified by embodiments thereof with reference to the accompanying drawings, in which same or equivalent parts are represented by same numbers through the drawings.

Figure 1:
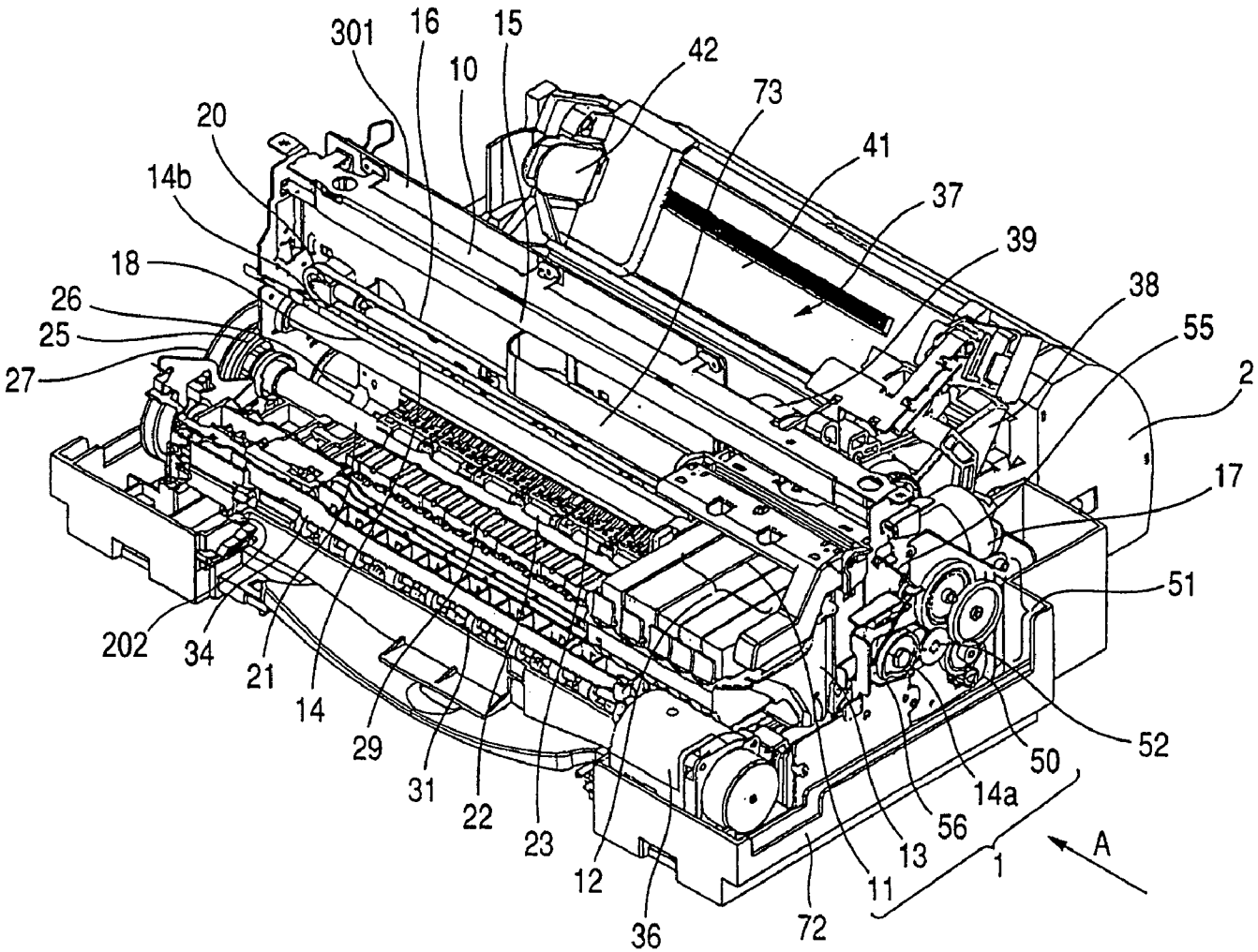
FIG. 1 is a schematic perspective view showing the entire configuration of a recording apparatus in an embodiment of the present invention.
Figure 2:
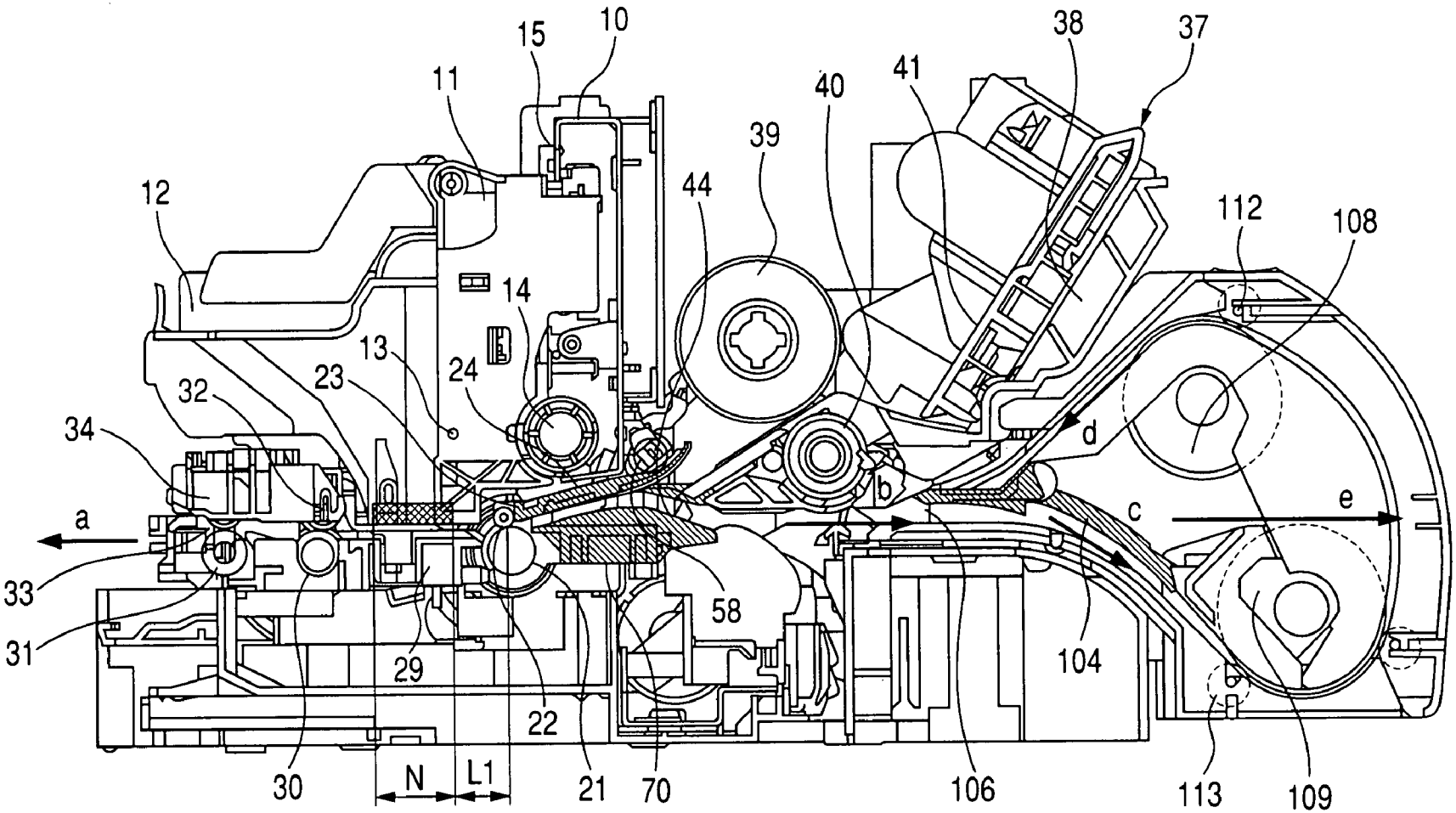
FIG. 2 is a schematic lateral cross-sectional view of the entire configuration of the recording apparatus, seen from a direction A in FIG. 1.

FIG. 1 is a schematic perspective view showing an entire configuration of the embodiment of a recording apparatus embodying the present invention, and FIG. 2 is a schematic lateral cross-sectional view showing the entire configuration of the recording apparatus seen from a direction A in FIG. 1. FIGS. 1 and 2 illustrate a case where the recording apparatus is an ink jet recording apparatus for recording on a recording medium by discharging ink thereon. As the recording medium, various materials can be used such as a paper, a plastic sheet, a cloth, a metal sheet or a plate-shaped member. In the following description, however, the recording media in a wide sense may be represented as a recording sheet or a sheet because a recording paper sheet is a typical example of the recording media, but such usage is not to limit the range of the recording media to a recording sheet or a sheet.

In FIGS. 1 and 2, there are illustrated a main body 1 of a recording unit (main body of recording apparatus), a sheet inverting portion (auto both-side unit or auto inversion unit) 2, a chassis 10 supporting the structure of the recording unit main body 1, a recording head 11 serving as recording means for achieving recording by an ink discharge, an ink tank 12 storing ink to be supplied to the recording head 11, a carriage 13 for supporting the recording head 11 and the ink tank 12 and executing a scanning (main scanning) motion, a guide shaft 14 supporting and guiding the carriage 13, a guide rail 15 parallel to the guide shaft 14 and serving to guide the carriage 13, a carriage belt (timing belt) 16 for driving the carriage 13, a carriage motor 17 for driving the carriage belt 16 through a pulley, a code strip 18 for detecting the position of the carriage 13, and an idler pulley 20 positioned opposite to the pulley of the carriage motor 17 and supporting the carriage belt 16.

In FIGS. 1 and 2, there are also shown a sheet conveying roller (feeding roller) 21 for conveying (feeding) a recording medium (recording sheet) 4, a pinch roller 22 pressed to and driven by the sheet conveying roller 21, a pinch roller holder 23 for rotatably supporting the pinch roller 22, a pinch roller spring 24 for pressing (or press-contacting) the pinch roller 22 to the sheet conveying roller 21, a sheet conveying roller pulley 25 fixed to the sheet conveying roller 21, an LF (line feed) motor 26 for driving the sheet conveying roller 21, a code wheel 27 for detecting a rotation angle of the sheet conveying roller 21, and a platen 29 for supporting the recording sheet 4 in an opposed position to the recording head 11.

There are further provided a first sheet discharge roller 30 for conveying the recording sheet 4 in cooperation with the sheet conveying roller 21, a second sheet discharge roller 31 provided at a downstream side of the first sheet discharge roller 30, a first spur array 32 constituting a rotary member for supporting the recording sheet in an opposed position to the first sheet discharge roller 30, a second spur array 33 constituting a rotary member for supporting the recording sheet in an opposed position to the second sheet discharge roller 31, a spur base 34 for rotatably supporting the first spur array 32 and the second spur array 33, a maintenance unit 36 to be operated for preventing clogging of the recording head 11 (clogging in a discharge port or a nozzle) and in case of recovering the ink discharging performance, or for filling ink flow paths of the recording head with ink at the replacement of the ink tank 12, and a main ASF (automatic sheet feeder) 37 serving as an auto sheet feeding portion for stacking recording sheets and supplying such sheets one by one to the recording portion at a recording operation.

Also in FIGS. 1 and 2, there are shown an ASF base 38 constituting a supporting base for the main ASF 37, a sheet feeding roller 39 maintained in contact with the stacked recording sheets for advancing such recording sheet, a separating roller 40 for separating recording sheet one by one in case they are conveyed simultaneously, a pressure plate 41 for stacking the recording sheets and biasing them toward the sheet feeding roller 39, a side guide 42 provided on the pressure plate 41 and fixable in an arbitrary position thereon in a transversal direction of the recording sheet, a returning claw 43 for returning, to a predetermined position, a front end of a recording sheet that has advanced in a sheet feeding operation beyond a nip portion between the sheet feeding roller 39 and the separating roller 40, and an ASF flap 44 for limiting the conveying of the recording sheet from the main ASF 37 to a single direction.

There are further provided a lift input gear 50 engaging with an ASF planet gear 49, a lift reducing gear train 51 for transmitting a power from the lift input gear 50 under a reduction, a lift cam gear 52 connected directly with a lift cam shaft, a guide shaft spring 55 for biasing a guide shaft 54 in a lateral side thereof, a guide slope 56 on which a cam of a guide shaft gear 53 slides, a lift cam shaft 58 for lifting the pinch roller holder 23, etc., a sheet guide 70 for guiding a front end of the recording sheet into a nip portion between the sheet conveying roller 21 and the pinch roller 22, a base 72 supporting the entire main body 1 of the recording unit, and a control board 301 incorporating a control system.

Figure 3:
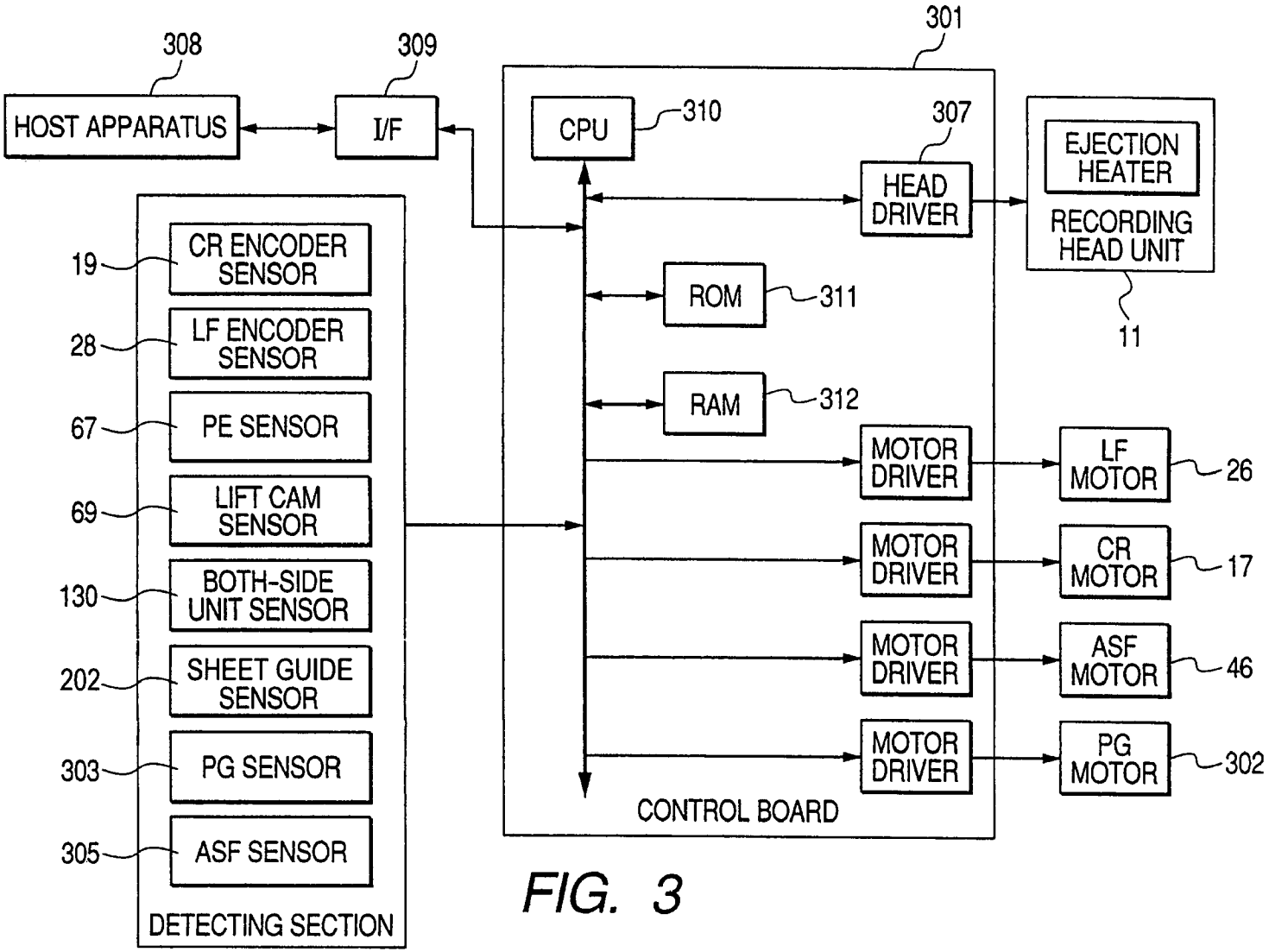
FIG. 3 is a block diagram of drive means for driving the entire recording apparatus embodying the present invention.

FIG. 3 is a block diagram showing control means which controls the entire recording apparatus embodying the present invention.

Referring to FIG. 3, there are shown a CR (carriage) encoder sensor 19 for reading the code strip 18 provided on the carriage 13, an LF encoder sensor 28 for reading the code wheel 27 mounted on the chassis 1, an ASF motor 46 for driving the main ASF 37, a PE (paper end) sensor 67 for detecting a motion of a PE sensor lever 66, a lift cam sensor 69 for detecting a motion of the lift cam shaft 58, and a sheet inverting portion (both-wide unit) sensor 130 for detecting attachment/detachment of the sheet inverting portion (auto both-side unit) 2.

In FIG. 3, there are further shown a PG motor 302 for driving the maintenance unit 36, a PG sensor 303 for detecting the function of the maintenance unit 36, an ASF sensor 305 for detecting the function of the main ASF 37, a head driver 307 for driving the recording head 11, a host apparatus 308 for transmitting recording data to the recording apparatus, an I'/F (interface) 309 for electrical connection/interfacing of the host apparatus 308 and the recording apparatus, a CPU 310 for controlling the recording apparatus and issuing control commands thereto, a ROM 311 in which control data, etc., are stored, and a RAM 312 used as a development area for the recording data, etc.

Now, the outline of the recording apparatus of the present invention will be at first explained with reference to FIGS. 1, 2 and 3, and functions of respective portions will be explained later. At first, there will be explained the configuration of an ordinary recording apparatus of serial scan type. The recording apparatus of the present embodiment is constituted principally of a sheet feeding portion, a conveying portion, a recording portion, a recording means (recording head) maintenance unit, and a sheet inverting portion. When recording data are transmitted from the host apparatus 308 and are stored in the RAM 312 through the interface (I/F) 309, the CPU 310 issues a recording operation start signal to initiate a recording operation.

When the recording operation is started, at first a sheet feeding operation is conducted. The sheet feeding portion is constituted of the main ASF 37, which is an auto sheet feeding portion for pulling out a recording sheet, for each recording operation, from a stack on the pressure plate 41 and feeding it to the conveying portion. At the start of the sheet feeding operation, the ASF motor 46 rotates in a normal direction to rotate, through a gear train, a cam supporting the pressure plate 41. When the cam is disengaged by the rotation of the ASF motor, the pressure plate 41 is biased toward the sheet feeding roller 39 by the function of an unillustrated pressure plate spring. As the sheet feeding roller 39 rotates at the same time in a direction for conveying the recording sheet, an uppermost recording sheet starts to be conveyed. In this operation, plural recording sheets may be advanced at the same time depending on conditions of a frictional force between the sheet feeding roller 39 and the recording sheet 4 and a frictional force between the recording sheets.

In such situation, the separating roller 40, pressed to the sheet feeding roller 39 and having a predetermined returning rotational torque in a direction opposite to the sheet conveying direction, serves to press back the recording sheets other than a recording sheet positioned closest to the sheet feeding roller 39. Also at the end of the sheet feeding operation by the ASF, the separating roller 40 is released from the pressed state with the sheet feeding roller 39 and is separated by a predetermined distance therefrom by a cam function, and, in order to securely push back the recording sheets to the predetermined position on the pressure plate, a returning claw (not shown) is rotated to achieve such function. A recording sheet alone is thus conveyed to the conveying portion through the above-described functions.

When a recording sheet is conveyed from the main ASF 37, a front end of the recording sheet impinges on an ASF flap 44, which is biased by an ASF flap spring in such a direction as to close the sheet path, but passes through by pushing off the ASF flap 44. When a recording operation on the recording sheet is completed and a rear end thereof passes through the ASF flap 44, it returns to the original biased state to close the sheet path, so that the recording sheet when conveyed in the opposite direction does not return to the main ASF 37.

The recording sheet 4 conveyed from the sheet feeding portion is conveyed toward a nip between the sheet conveying roller 21 and the pinch roller 22, constituting the conveying portion. As the center of the pinch roller 22 is provided, with respect to the center of the sheet conveying roller 21, with a certain offset toward the first sheet discharge roller 30, a tangential angle at which the recording sheet is inserted is somewhat inclined from the horizontal direction. Therefore, in order to appropriately guide the front end of the recording sheet to the nip, a sheet path formed by the pinch roller holder 23 and the guide member (sheet guide) 70 conveys the sheet in an angled posture.

The sheet conveyed by the ASF 37 impinges on the nip portion of the sheet conveying roller 21 in a stopped state. In this state, the main ASF 37 executes a conveying by a distance slightly longer than a predetermined sheet path length thereby forming a loop in the sheet between the sheet feeding roller 39 and the sheet conveying roller 21. By a straightening force of the recording sheet itself, the front end of the sheet is pressed to the nip of the sheet conveying roller 21, whereby the front end of the sheet becomes parallel to the sheet conveying roller 21, thus achieving so-called registration operation. After the registration, the LF motor 26 starts to rotate while the recording sheet moves in a positive direction (toward the first sheet discharge roller 30).

Thereafter, the sheet feeding roller 39 is cut off from the driving power and is rotated by the recording sheet. At this point, the recording sheet is conveyed by the sheet conveying roller 21 and the pinch roller 22 only. The recording sheet is advanced in the positive direction by predetermined line feed amounts and proceeds along a rib provided on the platen 29.

The front end of the sheet reaches a nip of the first sheet discharge roller 30 and the first spur array 32 and a nip of the second sheet discharge roller 31 and the second spur array 33 in succession, but, since the first sheet discharge roller 30 and the second sheet discharge roller 31 have a peripheral speed substantially same as that of the sheet conveying roller 21 while the sheet conveying roller 21 is linked by a gear train with the first sheet discharge roller 30 and the second sheet discharge roller 31, the first sheet discharge roller 30 and the second sheet discharge roller 31 rotate in synchronization with the sheet conveying roller 21 whereby the recording sheet 4 is conveyed without being slack or being tensioned.

The recording portion is principally constituted of a recording head 11, and a carriage 13 supporting the recording head 11 and executing a scanning motion (displacement) in a direction crossing (normally orthogonally) the conveying direction of the recording sheet. The carriage 13 is supported and guided by a guide shaft 14 fixed to a chassis 10 and a guide rail 15 constituting a part of the chassis 10, and is reciprocated (scans) by the transmission of a driving power of a carriage motor 17 through a carriage belt 16, which is supported between the carriage motor 17 and an idler pulley 20.

In the recording head 11, plural ink flow paths connected with the ink tank 12 are formed and communicate with discharge ports provided on a face (discharge port face) opposed to the platen 29. An ink discharging actuator (energy generating means) is provided in each of the plural discharge ports constituting a discharge port array. Such actuator can be an electrothermal converting member (heat generating element) for utilizing a pressure generated by a film boiling of liquid, or an electromechanical converting member (electric-pressure converting element) such as a piezo element.

In an ink jet recording apparatus utilizing a recording head 11 as described above, an ink droplet discharge according to recording data can be achieved by transmitting a signal from a head driver 307 through a flexible flat cable 73 to the recording head 11. Also an ink droplet discharge at a suitable timing to the recording sheet can be achieved by reading the code strip 18 provided on the chassis 10 by the CR encoder 19 mounted on the carriage 13. When the recording of a line is completed in this manner, the recording sheet is advanced by a required amount by the conveying portion. This operation is repeated to execute a recording operation over the entire recording sheet.

The maintenance unit 36 serves to prevent the clogging of the discharge ports of the recording head 11 and to remove a smear, caused for example by paper dusts, on the discharge port face of the recording head 11, thereby recovering and maintaining the recording performance of the recording head 11. The maintenance unit 36 also executes ink suction at the replacement of the ink tank 12. Thus, the maintenance unit 36 so positioned as to oppose to the recording head 11 in a home position of the carriage 13 is constituted, for example, of a capping mechanism having a cap for covering the discharge port face of the recording head 11 thereby protecting the discharge ports, a suction recovery mechanism for generating a negative pressure in the cap thereby discharging ink by suction, and a wiping mechanism for cleaning a peripheral area of the discharge ports by wiping.

More specifically, in case of sucking the ink for refreshing the ink in the discharge ports of the recording head 11, the suction discharge of the ink is achieved by pressing the cap onto the discharge port face and driving a suction pump to generate a negative pressure inside the cap. Also in case ink is deposited on the discharge port face after the ink suction or contaminants such as paper dusts are deposited on the discharge port face, such deposits are removed by contacting a wiper with the discharge port face and wiping the discharge port face by a parallel displacement of the wiper. The recording apparatus is schematically constructed as explained in the foregoing.

In the following, a detailed description will be given on the configurations specific to the present embodiment, including the configuration of a sheet inverting portion 2. The recording apparatus of the present embodiment is featured in a capability of an automatic both-side recording, namely recording on front and back sides of a sheet-shaped recording material automatically without requiring operations by the operator.

At first reference is made to FIG. 2 for explaining a path for the recording sheet.

Referring to FIG. 2, there are shown a switching flap 104 constituted of a movable flap rotatably supported for determining a passing direction of the recording sheet, an exit flap 106 rotatably supported and opened when the recording sheet goes out of the sheet inverting portion 2, a first both-side roller 108 serving as an inversion roller for conveying the recording sheet in the sheet inverting portion 2, a second both-side roller 109 serving as an inversion roller for conveying the recording sheet in the sheet inverting portion 2, a first both-side pinch roller 112 rotated by the first both-side roller 108, and a second both-side pinch roller 113 rotated by the second both-side roller 109.

When a recording operation is initiated, the sheet feeding roller 39 feeds one by one the plural recording sheets stacked on the main ASF 37, to the sheet conveying roller 21. The recording sheet pinched between the sheet conveying roller 21 and the pinch roller 22 is conveyed in a direction a shown in FIG. 2. In case of both-side recording, the recording sheet after the recording on the front side is conveyed in a horizontal path, provided under the main ASF 37, in a direction b shown in FIG. 2. The recording sheet is introduced into the sheet inverting portion 2 which is provided behind the main ASF 37, and is conveyed in a direction C shown in FIG. 2.

In the sheet inverting portion 2, the recording sheet changes its advancing direction by being pinched between the second both-side roller 109 and the second both-side pinch roller 113, then is conveyed in a direction d shown in FIG. 2 by being pinched between the first both-side roller 108 and the first both-side pinch roller 112, and finally returns to the horizontal path with a change of the advancing direction by 180°. The recording sheet conveyed in the horizontal path in the direction a shown in FIG. 2 is pinched again by the sheet conveying roller 21 and the pinch roller 22, and is subjected to a recording on a back side. As explained in the foregoing, the recording sheet after the recording on the front side is subjected to a reversal of the front and back sides by means of the horizontal path positioned below the main ASF 37 and the sheet inverting portion 2 provided behind the main ASF 37 and then to a recording on the back side, whereby the recordings can be automatically made on the front and back sides.

A recording range will be explained in case of recording on the front side (first side or top side). The recording head 11 has a discharge port region between the sheet conveying roller 11 and the first sheet discharge roller 30, but it is usually difficult to position such discharge port region N very close to the nip of the sheet conveying roller 21 because of arrangements of the ink flow paths to the discharge ports and of wirings to the actuators (discharge energy generating means). Therefore, within a range where the recording sheet is pinched between the sheet conveying roller 21 and the pinch roller 22, the recording can only be made to a range distanced by a length L1, shown in FIG. 2, in the downstream side of the nip of the sheet conveying roller 21.

In order to decrease such lower margin area on the front side, the recording apparatus of the present embodiment continues the recording operation to a position where the recording sheet is disengaged from the nip of the sheet conveying roller 21 and is pinched and conveyed by the first sheet discharge roller 30 and the second sheet discharge roller 31 only. It is thus rendered possible to execute the recording operation to a position where the lower margin on the front side becomes zero. However, in case of conveying the recording sheet from such situation in the aforementioned direction b shown in FIG. 2, it is not possible (or difficult) to guide the recording sheet to the nip of the sheet conveying roller 21 and the pinch roller 22, possibly leading a sheet jamming (sheet clogging). In order to prevent such sheet jamming, the present embodiment adopts means to be explained in the following for releasing the pinch roller 22 from the sheet conveying roller 21 to form a predetermined gap therebetween, re-introducing an end of the recording sheet into such gap and contacting the pinch roller 22 again with the sheet conveying roller 21 thereby enabling to convey the recoding sheet in the direction b.

In the following there will be explained a releasing mechanism of the pinch roller 22, a releasing mechanism of a PE sensor lever 66, a pressure regulating mechanism for a pinch roller spring 24, an up-down mechanism for a sheet guide 70 and an up-down mechanism of the carriage 13, which constitute characteristics of the present embodiment.

As explained in the foregoing, the pinch roller 22 is released from the sheet conveying roller 21 in order to re-introduce the recording sheet, and certain additional mechanisms are provided for inverting the recording sheet after the re-introduction thereof.

One of such mechanisms is a releasing mechanism for a PE sensor lever 66. An ordinary PE sensor lever 66 is so mounted as to be capable of rocking with a certain angle to the surface of the recording sheet, in order to exactly detect the position of the front end or the rear end of the recording sheet when it proceeds in the normal direction. Because of such setting, when the sheet proceeds in the opposite direction, there are encountered technical difficulties that an end of the recording sheet is hooked or an end of the PE sensor lever 66 is caught by the recording sheet under conveying. In the present embodiment, therefore, the PE sensor lever 66 is released from the passing sheet surface until a middle of the front-back side inversion step of the recording sheet so as not to be in contact with the recording sheet.

The aforementioned releasing mechanism for the PE sensor lever 66 may also be replaced by another means or configuration. For example, for resolving the aforementioned technical difficulties, it is possible to provide the front end of the PE sensor lever 66 with a roller or the like, thereby resolving the technical difficulties by the rotation of such roller when the recording sheet advances in the opposite direction. It is also possible to adopt a configuration in which the PE sensor lever 66 has a larger rocking angle and can swing to an angle opposite to the normal direction when the recording sheet is conveyed in the opposite direction, thereby resolving the aforementioned technical difficulties.

Another is a pressure regulating mechanism for the pinch roller spring 24, for varying a pressure (spring force) of the pinch roller 22 to the paper conveying roller 21. In the present embodiment, the pinch roller 22 is released by rotating the entire pinch roller holder 23. In a state where the pinch roller 22 is pressed to the sheet conveying roller 21, since the pinch roller holder 23 is pressed by the pinch roller spring 24, a rotation of the pinch roller holder 23 in the releasing direction increases the pressure of the pinch roller spring 24 thereby resulting drawbacks of an increase in the load for releasing the pinch roller holder 23 or an increase in the stress applied to the pinch roller holder 23 itself. In order to prevent such phenomena, a mechanism for reducing the pressure of the pinch roller spring 24 at the release of the pinch roller holder 23 is provided.

Another mechanism is an up-down mechanism for the sheet guide 70. The sheet guide 70 is usually located, in order to guide the recording sheet fed from the main ASF 37 to the sheet conveying roller 21, in a position at a certain upward angle with respect to the horizontal path (state shown in FIG. 2), so as to smoothly guide the recording sheet to the nip portion of the LF roller 21 having a certain angle from the horizontal position as explained in the foregoing. In such configuration, however, when the recording sheet is conveyed in the direction b in FIG. 2, the recording sheet is again guided to the main ASF 37. In order to prevent such situation and to enable a smooth guiding to the horizontal path, it is preferable to change the angle of the sheet guide 70 to a horizontal position. For this purpose, an up-down mechanism for vertically moving the sheet guide 70 is provided.

A final mechanism is an up-down mechanism for the carriage 13. When the pinch roller holder 23 is brought into the released state, a front end of the pinch roller holder 23 comes close to the carriage 13, and this mechanism is provided in order to prevent the mutual contact of the two, thereby avoiding a situation where the carriage 13 cannot be moved in the main scanning direction. Therefore an up-down mechanism is provided for elevating the carriage 13 in synchronization with the releasing operation of the pinch roller holder 23. This up-down mechanism for the carriage 13 can also be utilized for other purposes, for example, for retracting the recording head 11 in order to prevent contact of the recording head 11 and the recording sheet in case of recording a thick recording sheet.

In the following detailed explanations will be given on the foregoing five mechanisms (releasing mechanism of the pinch roller 22, releasing mechanism of the PE sensor lever 66, pressure regulating mechanism for the pinch roller spring 24, up-down mechanism for the sheet guide 70 and up-down mechanism of the carriage 13).

Figure 4:
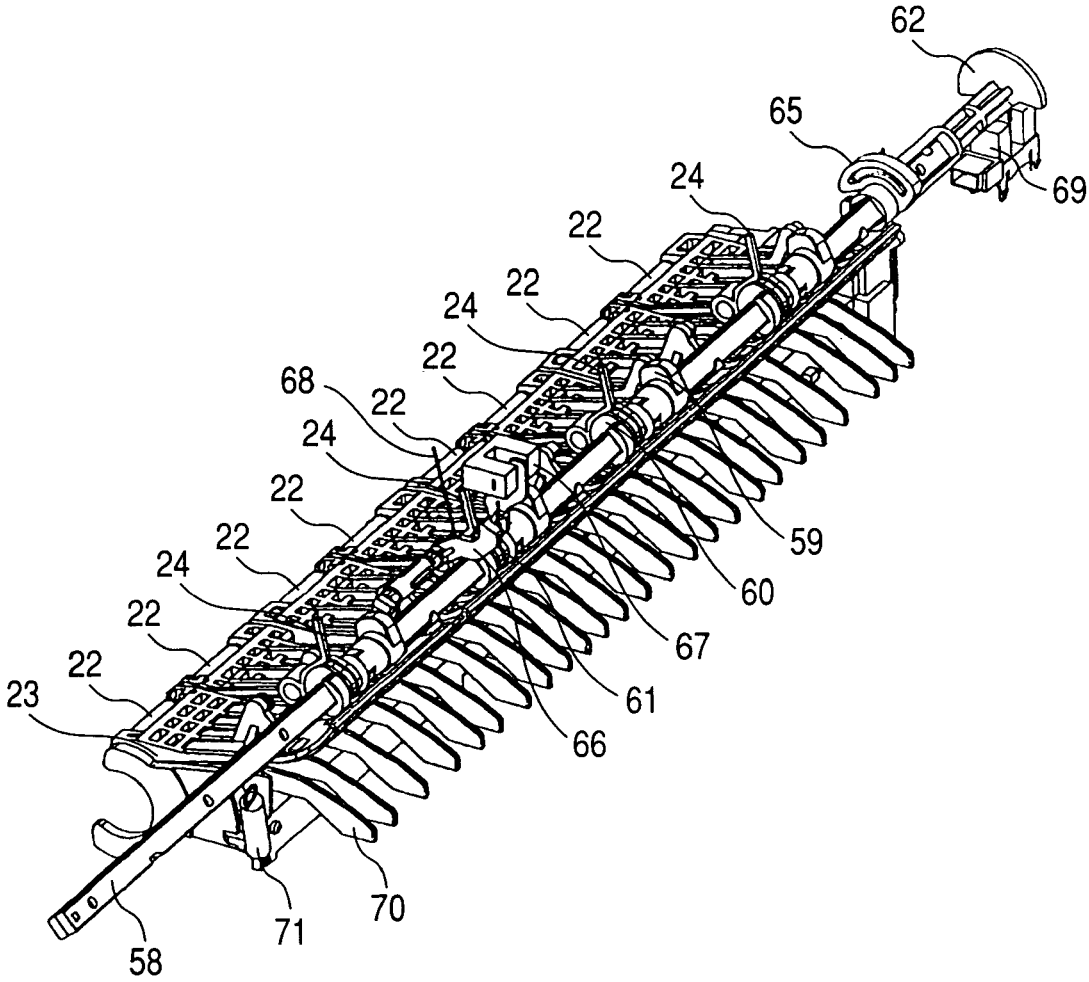
FIG. 4 is a schematic perspective view showing schematic configuration of a pinch roller releasing mechanism, a PE sensor lever releasing mechanism, a pinch roller spring pressure regulating mechanism, and a sheet guide up-down mechanism.

FIG. 4 is a schematic perspective view showing the configuration of the pinch roller releasing mechanism, the PE sensor lever releasing mechanism, the pinch roller spring pressure regulating mechanism and the sheet guide up-down mechanism.

In FIG. 4, there are shown a pinch roller holder pressing cam 59 in contact with the pinch roller holder 23, a pinch roller spring pressing cam 60 constituting a function point of the pinch roller spring 24, a PE sensor lever pressing cam 61 in contact with the PE sensor lever 66, a lift cam shaft shield plate 62 indicating an angle of the lift cam shaft 58, a sheet guide pressing cam 65 in contact with the sheet guide 70, a PE sensor lever 66 in contact with the recording sheet for detecting a front end or a rear end thereof, a PE sensor 67 to be exposed (or permeated)/masked (or blocked) by the PE sensor lever 66, a PE sensor lever spring 68 for biasing the PE sensor lever 66 in a predetermined direction, a lift cam sensor 69 to be exposed/masked by the lift cam shaft shield plate 62, and a sheet guide spring 71 for biasing the sheet guide 70 in a predetermined direction.

The pinch roller releasing mechanism, the PE sensor lever releasing mechanism, the pinch roller spring pressure regulating mechanism and the sheet guide up-down mechanism are operated by a rotation of the lift cam shaft 58. In the configuration of the present embodiment, the pinch roller holder pressing cam 59, the pinch roller spring pressing cam 60, the PE sensor lever pressing cam 61 and the sheet guide pressing cam 65 are respectively fixed on the lift cam shaft 58, whereby the respective cams function in synchronization with a turn of the lift cam shaft 58. An initial angle and a turn of the lift cam shaft 58 are recognized by the lift cam shaft shield plate 62 which exposes or masks the lift cam sensor 69. However the concept of the present invention is not limited by such configuration, and there may also be employed mechanisms driven independently.

In the following, function of each mechanism will be explained.

Figure 5A:
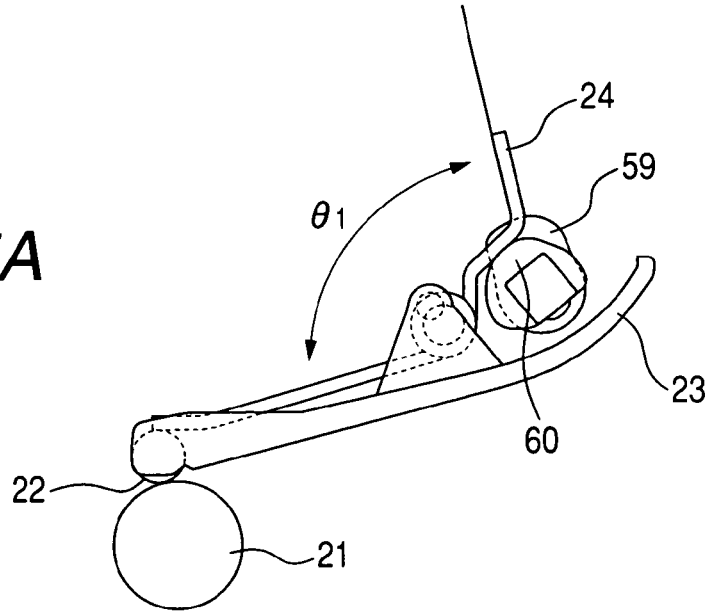
FIGS. 5A, 5B, and 5C are partial lateral views schematically showing functions of the pinch roller releasing mechanism and the pinch roller spring pressure regulating mechanism.
Figure 5B:
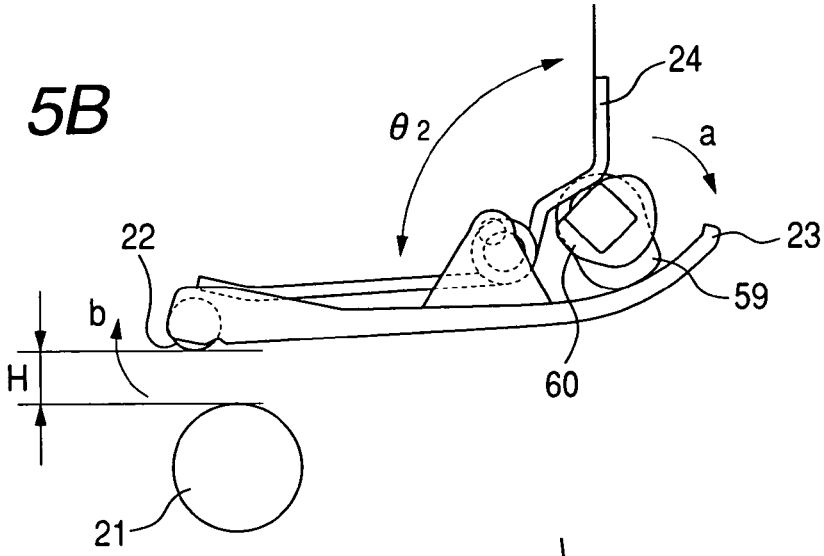
Figure 5C:
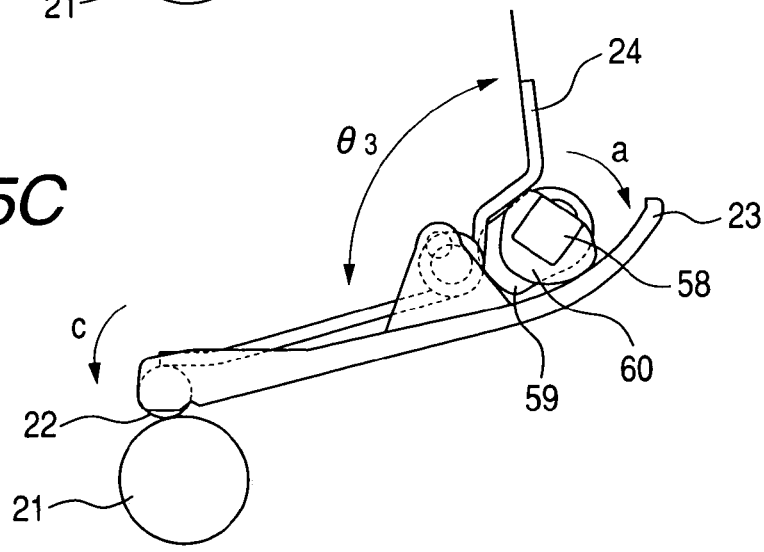

FIGS. 5A to 5C are partial lateral views schematically showing functions of the pinch roller releasing mechanism and the pinch roller spring pressure regulating mechanism. FIG. 5A shows a state where the pinch roller holder pressing cam 59 is in an initial state, the pinch roller 22 is pressed to the sheet conveying roller 21 and the pinch roller spring 24 has a pressure in a standard state. The pinch roller holder 23 is rotatably supported, at a pinch roller holder shaft 23*a*, by bearings in the chassis 10, and is capable of a rocking-motion over a predetermined angular range. The pinch roller holder 23 rotatably supports, at an end thereof, the pinch roller 22 and is provided, at the other end, with an area for impinging on the pinch roller holder pressing cam 59.

As shown in FIG. 5A, the pinch roller spring 24 is formed by a torsion coil spring, which impinges at an end, as a function point, on the pinch roller holder 23 at a side of the pinch roller 22, is supported at the other end by the pinch roller spring pressing cam 60 and is supported at an intermediate portion of the spring by a support portion of the chassis 10. Owing to such supporting configuration, the pinch roller 22 is pressed under a predetermined pressure to the sheet conveying roller 21. By activating the rotating mechanism for the sheet conveying roller 21 in this state, it is possible to convey the recording sheet pinched in the nip portion of the sheet conveying roller 21 and the pinch roller 22.

FIG. 5B shows a state where the pinch roller 22 is in a released state, and the pinch roller spring 24 is in a load-removed state. More specifically, by a rotation of the lift cam shaft 58 in a direction a, the pinch roller holder pressing cam 59 impinges on the pinch roller holder 23 to gradually rotate the pinch roller holder 23 in a direction b, whereby the pinch roller 22 is released from the sheet conveying roller 21. Also in the state shown in FIG. 5B, the pinch roller spring pressing cam 60 contacts the pinch roller spring 24 at a smaller radius portion thereof and a torsion angle θ2 of the pinch roller spring 24 is larger than the angle θ1 in the state shown in FIG. 5A, whereby the load of the spring is reduced and the pinch roller holder 23 is almost free from the load. Therefore, the pinch roller holder 23 is in a state almost free from the stress. In this state, a gap H of a predetermined amount is formed between the sheet conveying roller 21 and the pinch roller 22, and the front end of the recording sheet, even in case of being roughly guided, can be easily inserted into the nip.

FIG. 5C shows a state where the pinch roller 22 is pressed to the sheet conveying roller 21 as in FIG. 5A, but in a light contact state with a weaker contact pressure. In the state shown in FIG. 5C, a further rotation of the lift cam shaft 58 in the direction a releases the contact between the pinch roller holder pressing cam 59 and the pinch roller holder 23, the pinch roller holder 23 rotates in a direction c to return to the original state, and the pinch roller spring pressing cam 60 contacts the pinch roller spring 24 at such a radius between those in FIGS. 5A and 5B.

Thus, the torsion angle θ3 of the pinch roller spring 24 is somewhat smaller than the angle θ1 in FIG. 5A, so that the contact force of the pinch roller 22 to the sheet conveying roller 21 becomes somewhat smaller. In such configuration, in case a recording sheet thicker than normal is pinched between the sheet conveying roller 21 and the pinch roller 22, there can be prevented a situation where the torsion angle of the pinch roller spring 24 becomes larger than in the ordinary situation thereby increasing the load to the pinch roller holder 23. It is therefore possible to equalize the rotational load by the axial loss of the sheet conveying roller 21 for a recording sheet of an ordinary thickness and for a thicker recording sheet.

When the lift cam shaft 58 is rotated by one turn through the aforementioned states, the pinch roller releasing mechanism and the pinch roller spring pressure regulating mechanism return to a standard state shown in FIG. 5A.

Figure 6A:
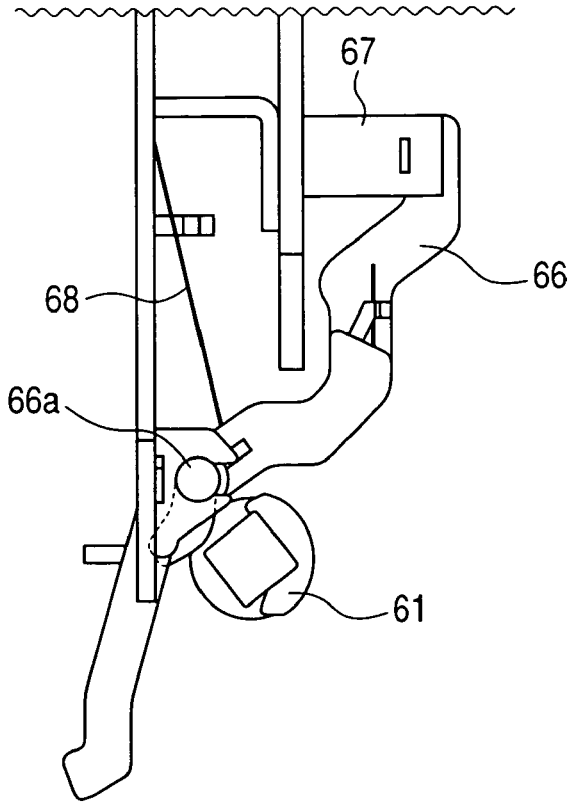
FIGS. 6A and 6B are partial lateral views schematically showing functions of a PE sensor lever up-down mechanism.
Figure 6B:
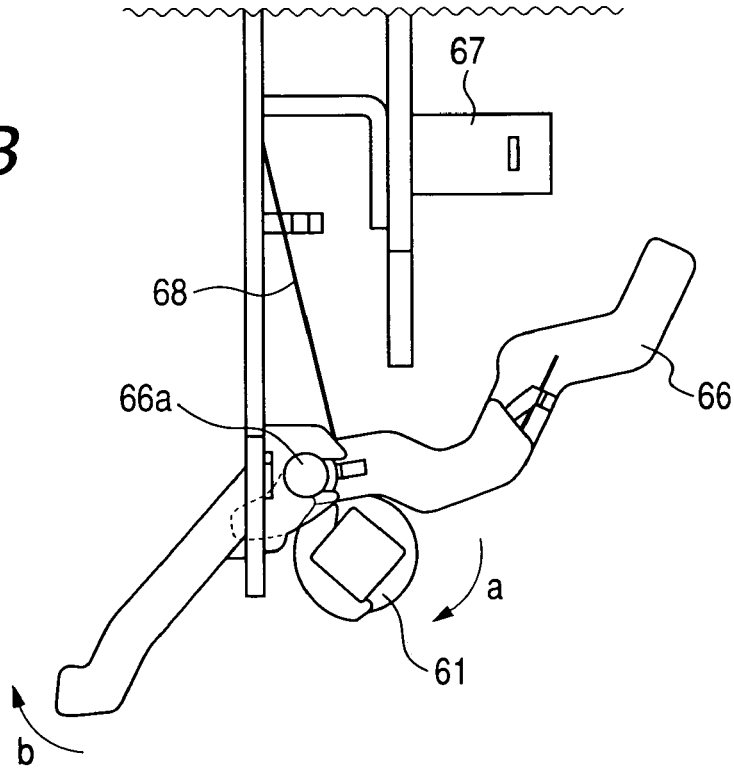

FIGS. 6A and 6B are partial lateral views schematically showing the functions of the PE sensor lever up-down mechanism. FIG. 6A illustrates a state where the PE sensor lever pressing cam 61 is in an initial state and the PE sensor lever 66 is in a free state. The PE sensor lever 66 is rotatably supported, by a PE sensor lever shaft 66*a*, at bearings in the chassis 10. In the state shown in FIG. 6A, the PE sensor lever 66 is biased to the illustrated position by the PE sensor lever spring 68, and the PE sensor 67 is masked by a shield plate of the PE sensor lever 66. When a recording sheet passes the position of the PE sensor lever 66 in this state, the PE sensor lever 66 rotates clockwise in the illustration, whereby the PE sensor 67 is exposed thereby being capable of detecting the presence of the recording sheet. Such masked and exposed states allow to detect the front end and the rear end of the recording sheet.

FIG. 6B is a partial lateral view schematically showing a state where the PE sensor lever 66 is locked. In FIG. 6B, a rotation of the PE sensor lever pressing cam 61 in the direction a causes a cam follower portion of the PE sensor lever 66 to be pushed up and rotated in a direction b. In this state, a sheet detecting portion of the PE sensor lever 66 is hidden inside the pinch roller holder 23, so that the PE sensor lever 66 does not contact the recording sheet even when it is present in the path. Therefore, in case the recording sheet is conveyed in the direction b in FIG. 2 in this state, the recording sheet can be prevented from jamming by contacting the PE sensor lever 66.

Figure 7A:
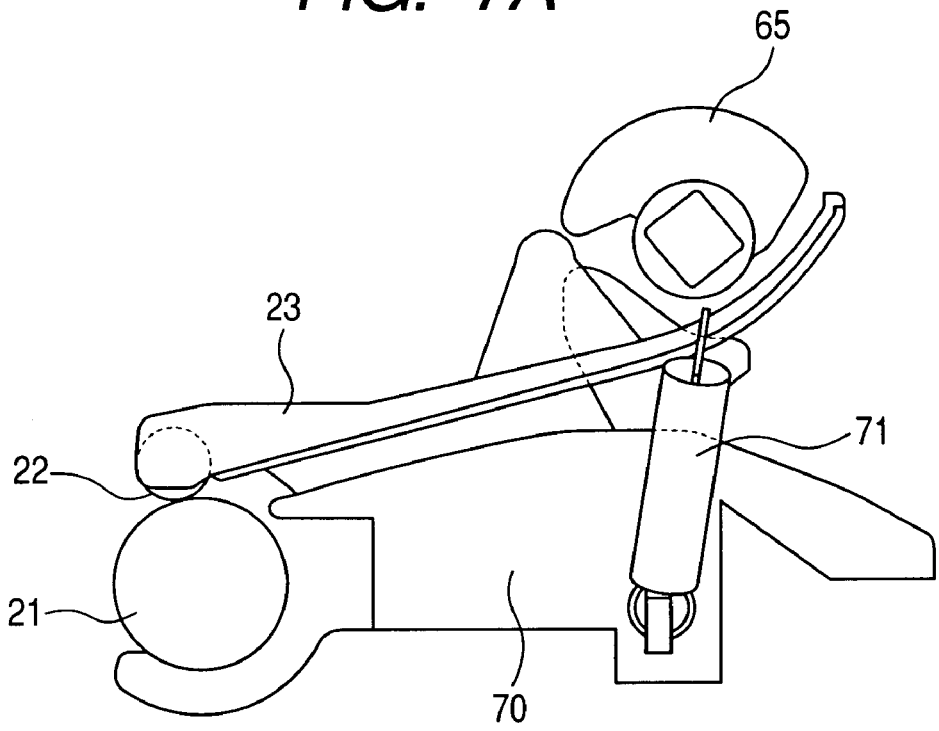
FIGS. 7A and 7B are partial lateral views schematically showing functions of the sheet guide up-down mechanism.
Figure 7B:
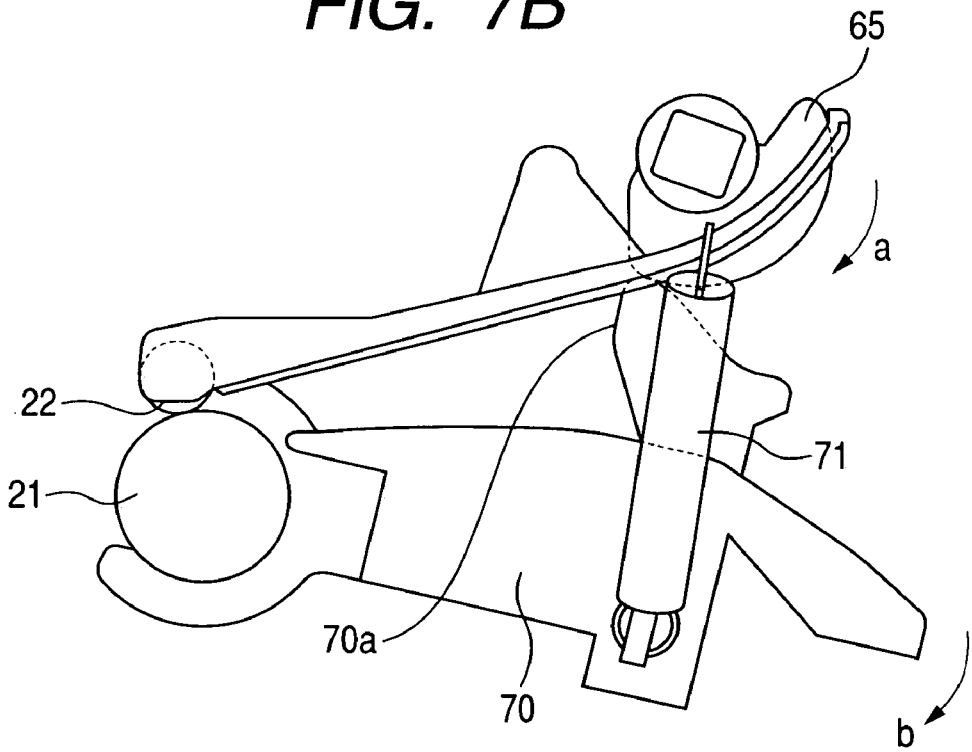

FIGS. 7A and 7B are partial lateral views schematically showing functions of the sheet guide up-down mechanism. FIG. 7A shows a state where the sheet guide 70 is in an up-state. Referring to FIG. 7A, the sheet guide 70 is usually biased in a lifting direction by the sheet guide spring 71, and is defined in position by impinging on an unillustrated stopper. By the function of the sheet guide spring 71, the sheet guide 70 maintains this position (up-state) when a recording sheet supplied from the main ASF 37 passes. However, the sheet guide 70 can be lowered against the spring force of the sheet guide spring 71 in case a force larger than in the normal state is applied.

FIG. 7B shows a state where the sheet guide 70 is in a down-state. Referring to FIG. 7B, a rotation of the sheet guide pressing cam 65 fixed to the lift cam shaft 58 in a direction a in FIGS. 7A and 7B causes the sheet guide pressing cam 65 to impinge on and gradually press a sheet guide cam follower 70*a* which constitutes a part of the sheet guide 70. Thus the sheet guide 70 is rotated in a direction b and is pressed down against the spring force of the sheet guide spring 71. In this state, a portion of the sheet guide 70 facing the sheet path becomes substantially horizontal whereby the sheet path becomes almost completely straight. Thus, when the sheet is conveyed in the direction b in FIG. 2 by the sheet conveying roller 21, the recording sheet is conveyed horizontally and an already recorded portion on the front side (top surface or first side) of the recording sheet is prevented from being pressed to an upper portion of the sheet path.

Figure 8:
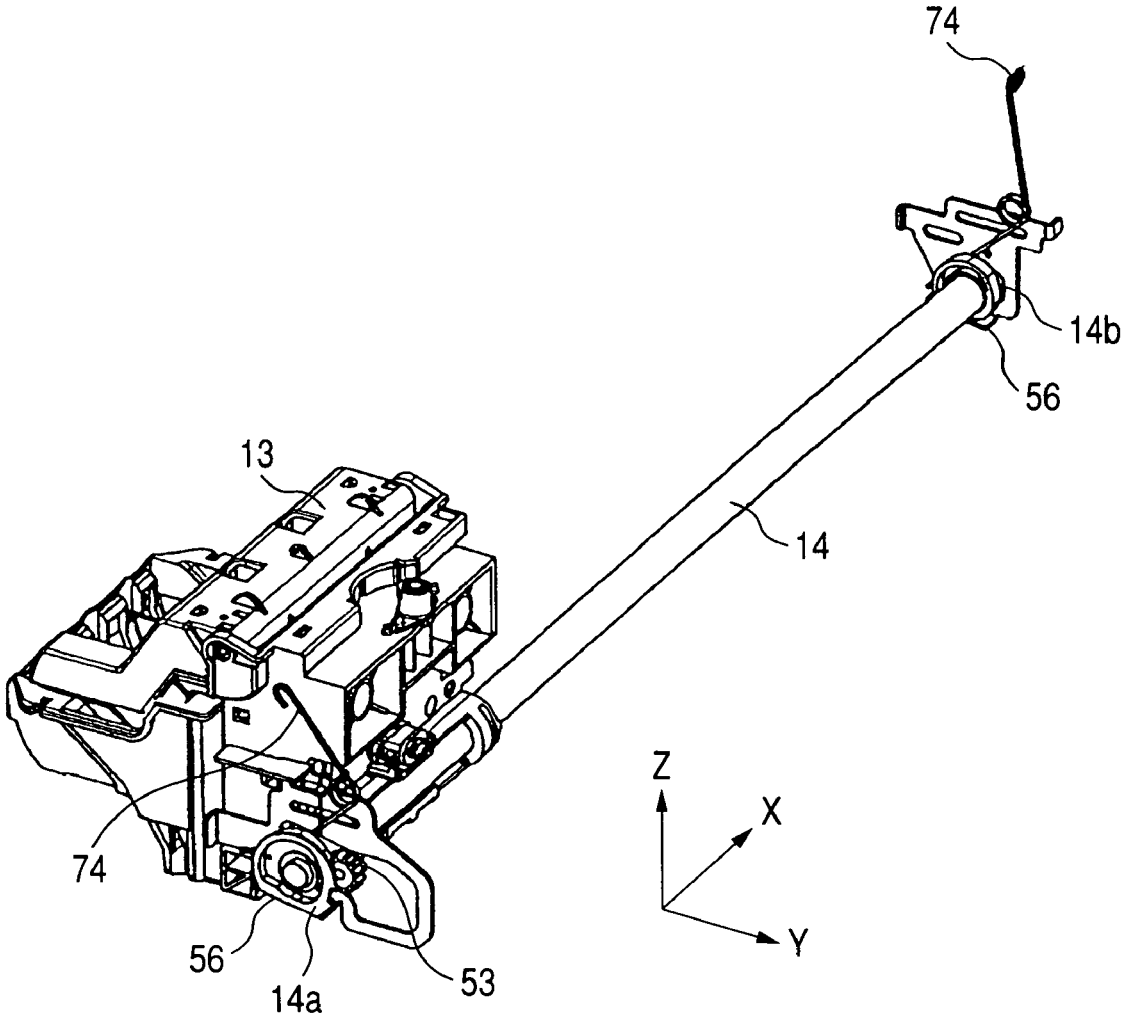
FIG. 8 is a schematic perspective view showing a carriage up-down mechanism.

FIG. 8 is a schematic perspective view showing a carriage up-down mechanism. In FIG. 8, there are shown a right guide shaft cam 14*a* mounted on the guide shaft 14, a left guide shaft cam 14*b* mounted on the guide shaft 14, and a cam idler gear 53 connecting a lift cam gear 52 and a gear integral with the right guide shaft cam 14*a*. The guide shaft 14 is supported by both lateral faces of the chassis 10 as shown in FIG. 1, and is fitted in an unillustrated vertically elongated holes thereby being freely movable in a direction indicated by an arrow Z in FIG. 8 but being prevented from movement in directions of arrows X and Y in FIG. 8.

In the mechanism shown in FIG. 8, the guide shaft 14 is normally biased downwards (opposite to the arrow Z) by the guide shaft spring 74, but, when the cam idler gear 53 rotates, the right guide shaft cam 14*a* and the left guide shaft cam 14*b* impinge on the guide slopes 56 whereby the guide shaft 14 rotates and moves vertically.

Figure 9A:
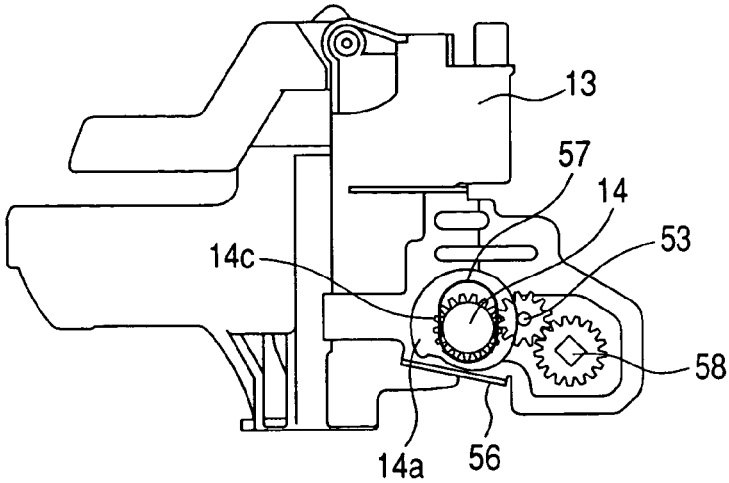
FIGS. 9A, 9B, and 9C are partial lateral views schematically showing functions of the carriage up-down mechanism.
Figure 9B:
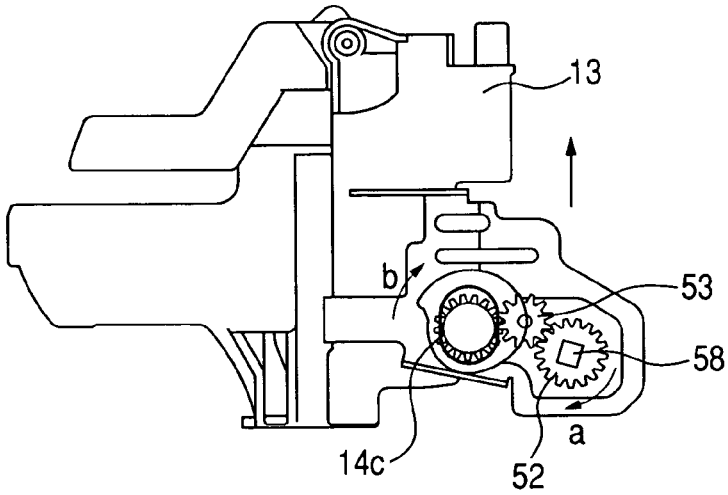
Figure 9C:
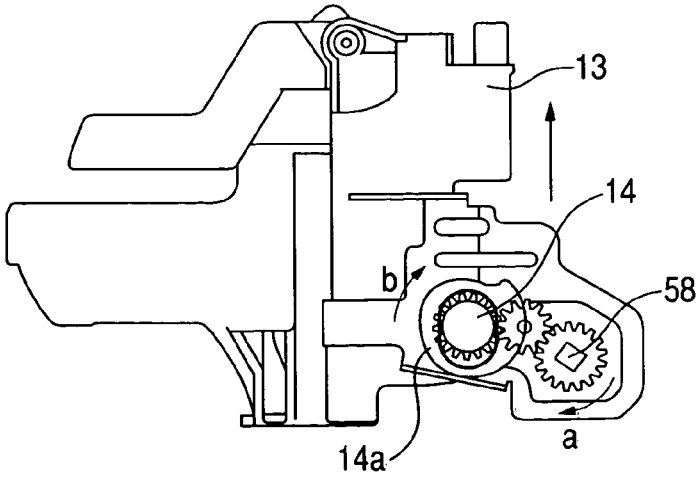

FIGS. 9A to 9C are partial lateral views schematically showing functions of the carriage up-down down mechanism. FIG. 9A shows a state where the carriage 13 is in a first carriage position which is a standard position. In this state, the guide shaft 13 is defined in position by impinging on a lower end of the elongated guide hole 57 of the chassis 10, and the guide shaft cam 14*a* is not in contact with the guide slope 56.

FIG. 9B shows a state where the carriage 13 is shifted to a somewhat higher second carriage position. A rotation of the lift cam shaft 58 from the first carriage position causes the lift cam gear 52, fixed on the lift cam shaft 58, to rotate, whereby a guide shaft cam R gear 14*c* rotates through the cam idler gear 53 meshing with the lift cam gear 52. By selecting a same number of teeth for the lift cam gear 52 and the guide shaft cam R gear 14*c*, the lift cam shaft 58 and the guide shaft 14 rotate in a same direction by approximately same angles. The rotations are not in a completely same angle, because the lift cam gear 52 and the cam idler gear 53 have fixed rotary axes while the guide shaft 14 itself, constituting a rotary axis of the guide shaft cam R gear 14*c*, can move vertically whereby the distance between the gears changes.

Such rotation of the lift cam shaft 58 in the direction a causes the guide shaft 14 to also rotate in a direction b. This rotation causes the guide shaft R cam 14*a* and the guide shaft L cam 14*b* to respectively impinge on the fixed guide slopes 56. In this state, since the moving direction of the guide shaft 14 is limited to the vertical direction by the elongated guide hole 57 of the chassis 10 as explained before, the guide shaft 14 moves to the second carriage position. Such second carriage position can be advantageously selected in case the recording sheet shows a large deformation to cause a contact of the recording sheet and the recording head 11 in the first carriage position.

FIG. 9C shows a state where the carriage 13 is in a highest third carriage position. A further rotation of the lift cam shaft 58 from the second carriage position causes the guide shaft R cam 14*a* and the guide shaft L cam 14*b* to have larger radii in the cam faces, whereby the guide shaft 14 is moved to a still higher position. Such third carriage position is suitable for a recording sheet thicker than normal.

In the foregoing, detailed explanations on the five mechanisms, namely the pinch roller releasing mechanism, the PE sensor lever releasing mechanism, the pinch roller spring pressure regulating mechanism and the sheet guide up-down mechanism, have been given.

Figure 10:
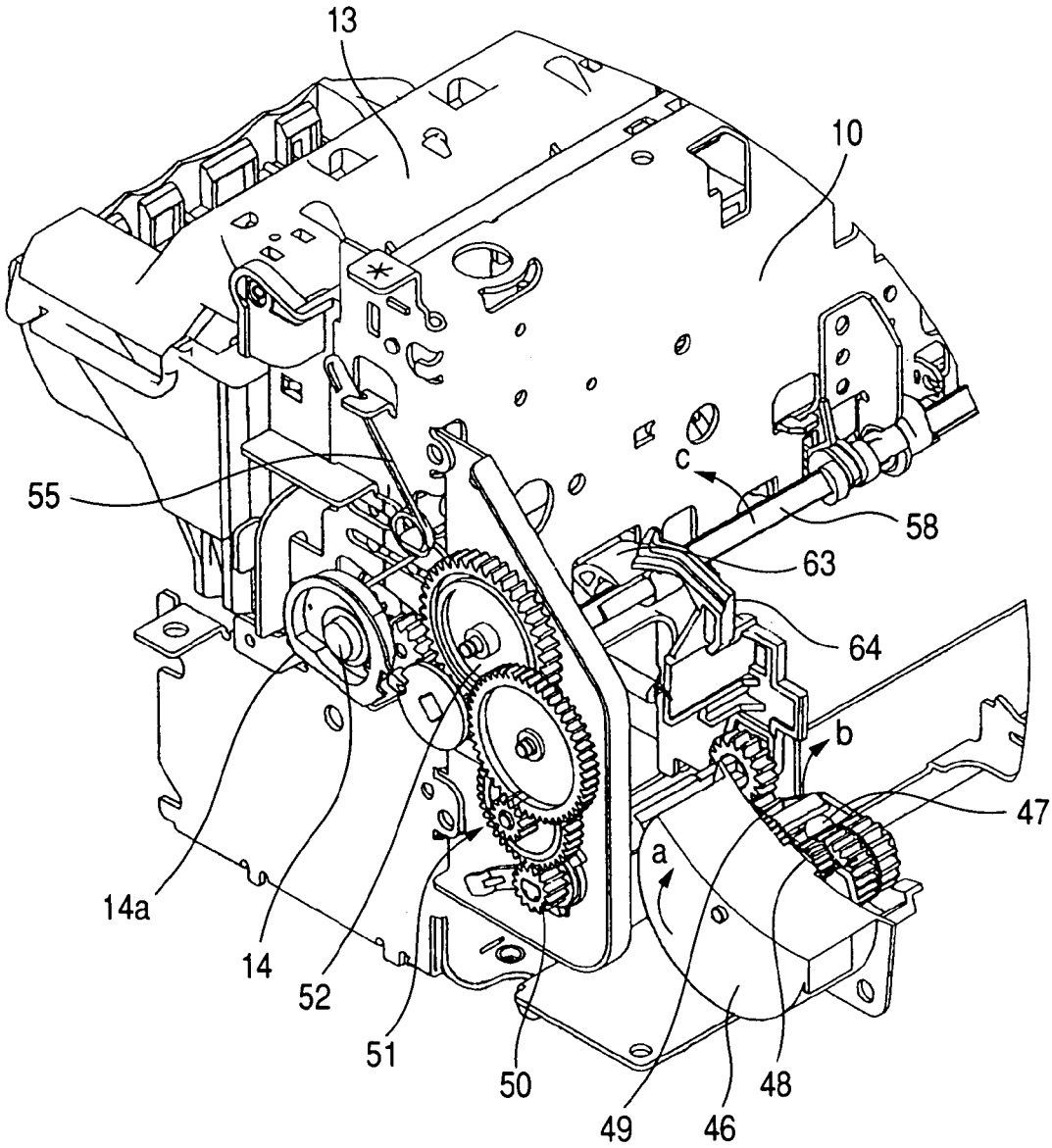
FIG. 10 is a schematic perspective view showing a drive mechanism for a lift cam shaft.

FIG. 10 is a schematic perspective view showing a drive mechanism for the lift cam shaft. In the following, the drive mechanism for the lift cam shaft 58 will be explained. In the present embodiment, the ASF motor 46 for driving the main ASF 37 is employed as a drive source for the lift cam shaft 58, and is controlled in the rotating direction and the rotating amount to suitably operate the main ASF 37 or the lift cam shaft 58.

In FIG. 10, there are shown an ASF motor 46 constituting a drive source (upper half being removed in illustration in order to show gears), an ASF pendulum arm 47 positioned next to a gear mounted on the ASF motor 46, an ASF solar gear 48 mounted at a center of the ASF pendulum arm 47, an ASF planet gear 49 mounted at an end of the ASF pendulum arm 47 and meshing with the ASF solar gear 48, a pendulum locking cam 63 fixed to the lift cam shaft 58, and a pendulum locking lever 64 capable of rocking to act on the pendulum locking cam 63.

As explained in the foregoing, the transmitting direction of the driving force of the ASF motor 46 is determined by the rotating direction thereof, and the ASF motor 46 is rotated in a direction a in FIG. 10 in case of driving the lift cam shaft 58, whereby a gear mounted on the ASF motor 46 rotates the ASF solar gear 48. As the ASF solar gear 48 and the ASF pendulum arm 47 engage mutually rotatably with a predetermined frictional force, the ASF pendulum arm 47 rocks in the rotating direction (indicated by an arrow b in FIG. 10) of the ASF solar gear 48. Thus the ASF planet gear 49 meshes with a next lift input gear 50. In this manner the driving force of the ASF motor 46 is transmitted to the lift cam gear 52 through the lift reducing gear train 51. In this state, the ASF pendulum arm 47 rocks in the direction b in FIG. 10, so that the driving power to the gear train for driving the main ASF 37 is cut off.

On the other hand, in case of driving the main ASF 37, the ASF motor 46 is rotated opposite to the direction a in FIG. 10, so that the ASF pendulum arm 47 rocks in a direction opposite to the arrow b in FIG. 10. Thus the ASF planet gear 49 is released from the engagement with the lift input gear 50, while another ASF planet gear 49 provided on the ASF pendulum arm 47 meshes with the gear train of the main ASF 37, thereby driving the main ASF 37.

In the present embodiment, the ASF motor 46 is constituted of so-called stepping motor with an open loop control, but it is naturally possible to employ a closed loop control utilizing an encoder on a DC motor or the like.

In case a planet gear mechanism is employed for the driving power transmission and a negative load is generated at the driven side, there may result a so-called overtaken state in which the gears are disengaged by a movement of the pendulum locking lever 64 and the driven side advances in phase relative to the driving side. In order to prevent such phenomenon, the present embodiment is provided with the pendulum locking cam 63 and the pendulum locking lever 64. In case the lift cam shaft 58 is within a predetermined angular range, based on a cam face shape of the pendulum locking cam 63, the pendulum locking lever 64 rocks in a direction c in FIG. 10 whereby the pendulum locking lever 64 engages with and fixes the ASF pendulum arm 47 so as not to return to the side for driving the main ASF 37. Therefore, the ASF planet gear 49 is constantly maintained in a meshing state with the lift input gear 50, and the ASF motor 46 and the lift cam shaft 58 rotate always in synchronization.

Also when the pendulum locking cam 63 returns to a predetermined angular range, the pendulum locking lever 64 returns in a direction opposite to the arrow c in FIG. 10, whereby the ASF pendulum arm 47 is unlocked and returns to a state where the driving power can be transmitted to the main ASF 37 by a reverse rotation of the ASF motor 46.

The aforementioned mechanisms of the lift cam shaft 58 enable a release of the pinch roller 22, a locking of the PE sensor lever 66, a pressure regulation of the pinch roller spring 24, a vertical movement of the sheet guide 70 and a vertical movement of the carriage 13. In the following, these five mechanisms will be collectively called lift mechanisms.

In the following, there will be explained how these five lift mechanisms function in mutual correlation. FIGS. 11A to 11D are schematic partial lateral views showing functions of the carriage 13, the pinch roller 22, the PE sensor lever 66 and the sheet guide 70.

Figure 11A:
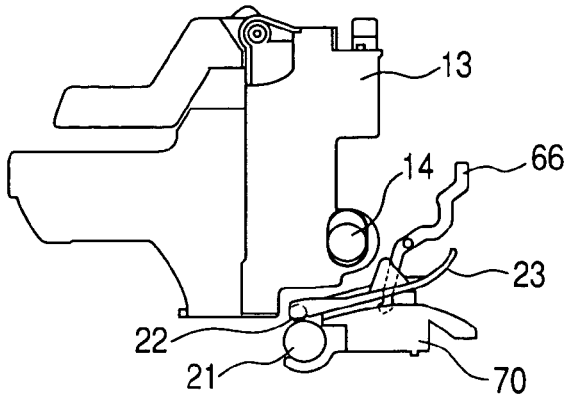
FIGS. 11A, 11B, 11C, and 11D are schematic partial lateral views showing functions of a carriage, a pinch roller, a PE sensor lever and a sheet guide.

FIG. 11A shows a state where the lift mechanisms are in a first position. In this state, the pinch roller 22 is pressed (or press-contacted) to the sheet conveying roller 21, the PE sensor lever 66 is in a free state, the pinch roller spring 24

(see FIGS. 5A to 5C) is pressed with an ordinary pressure, the sheet guide 70 is in an up-state, and the carriage 13 is in the first carriage position.

This state shown in FIG. 11A is used for a recording operation utilizing an ordinary recording sheet, or for a registration after the inversion of the recording sheet in the sheet inverting portion 2. The carriage 13 is supported movably along the guide shaft 14, and can be vertically moved by vertically moving the guide shaft 14 along an elongated guide hole 57 formed in the chassis 10.

Figure 11B:
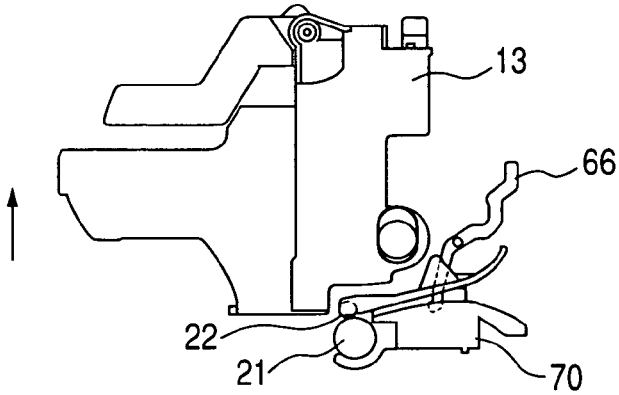

FIG. 11B shows a state where the lift mechanisms are in a second position. In this state, the pinch roller 22 is pressed to the sheet conveying roller 21, the PE sensor lever 66 is in a free state, the pinch roller spring 24 is pressed under an ordinary pressure, the sheet guide 70 is in an up-state, and the carriage 13 is in the second carriage position. In comparison with the first position of the lift mechanisms, this state is different only in the position of the carriage 13. This state is used for preventing a frictional contact of the recording sheet and the recording head 11 in case the recording sheet shows a large deformation, or for a recording sheet of a certain larger thickness.

Figure 11C:
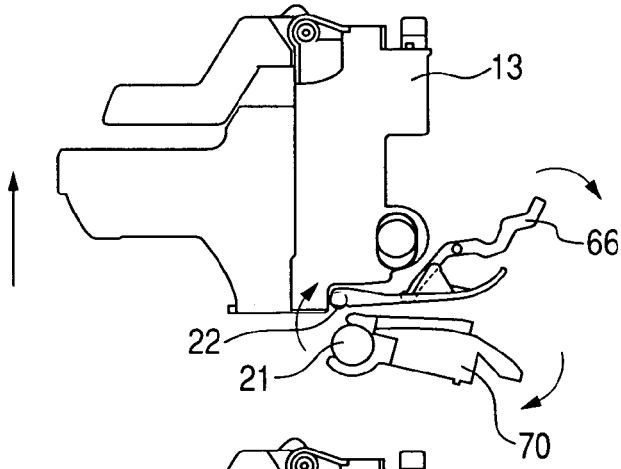

FIG. 11C shows a state where the lift mechanisms are in a third position. In this state, the pinch roller 22 is released with a predetermined gap from the sheet conveying roller 21, the PE sensor lever 66 is retracted upwards and locked, the pinch roller spring 24 has a weakened contact pressure, the sheet guide 70 is in a down-state, and the carriage 13 is in the highest third carriage position. In comparison with the second position of the lift mechanisms, states are changed in all the mechanisms to open the sheet path in a straight state and to enable introduction of the recording sheet. This state is used for conveying the recording sheet in a direction b in FIG. 2 after the recording on the front side of the recording sheet, or for inserting a recording sheet of a large thickness.

Figure 11D:
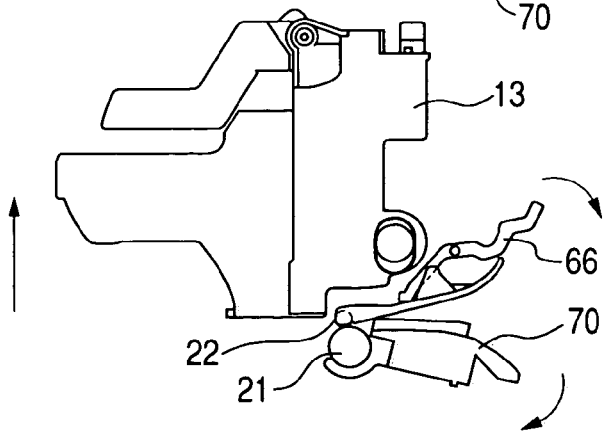

FIG. 11D shows a state where the lift mechanisms are in a fourth position. In this state, the pinch roller 22 is pressed to the sheet conveying roller 21, the PE sensor lever 66 is retracted upward and locked, the pinch roller spring 24 is pressed with a somewhat weakened contact pressure, the sheet guide 70 is in a down-state, and the carriage 13 is in the highest third carriage position. In comparison with the third position of the lift mechanisms, the pinch roller 22 returns to the pressed state, and the pinch roller spring 24 is so changed as to be pressed with a somewhat weaker pressure. This state is used in case of conveying, in an auto both-side recording, the recording sheet toward the sheet inverting portion 2 after the re-introduction of the recording sheet, or for a recording with a recording sheet of a large thickness.

In the present embodiment, in consideration of the functions of the recording apparatus, the lift mechanisms are limited to the aforementioned four positions as shown in FIGS. 11A to 11D in order to simplify the configuration. More specifically, the positions change cyclically in the order of first position—second position—third position—fourth position during a turn of the lift cam shaft 58. However, the present invention is not limited to such embodiment, and there may be employed a configuration in which the components of the mechanisms are operated independently. Also the pressure regulating mechanism for the pinch roller spring 24 is not essential, but can be dispensed with in case the pinch roller holder 23 has a sufficiently high rigidity or the load fluctuation of the LF motor 26 is negligible. Also the up-down mechanism for the sheet guide 70 may be dispensed with, in case, for example, by a positioning of the main ASF 37, the front end of the recording sheet can be satisfactorily guided to the nip of the sheet conveying roller 21 even with a horizontal sheet guide 70.

Figure 12:
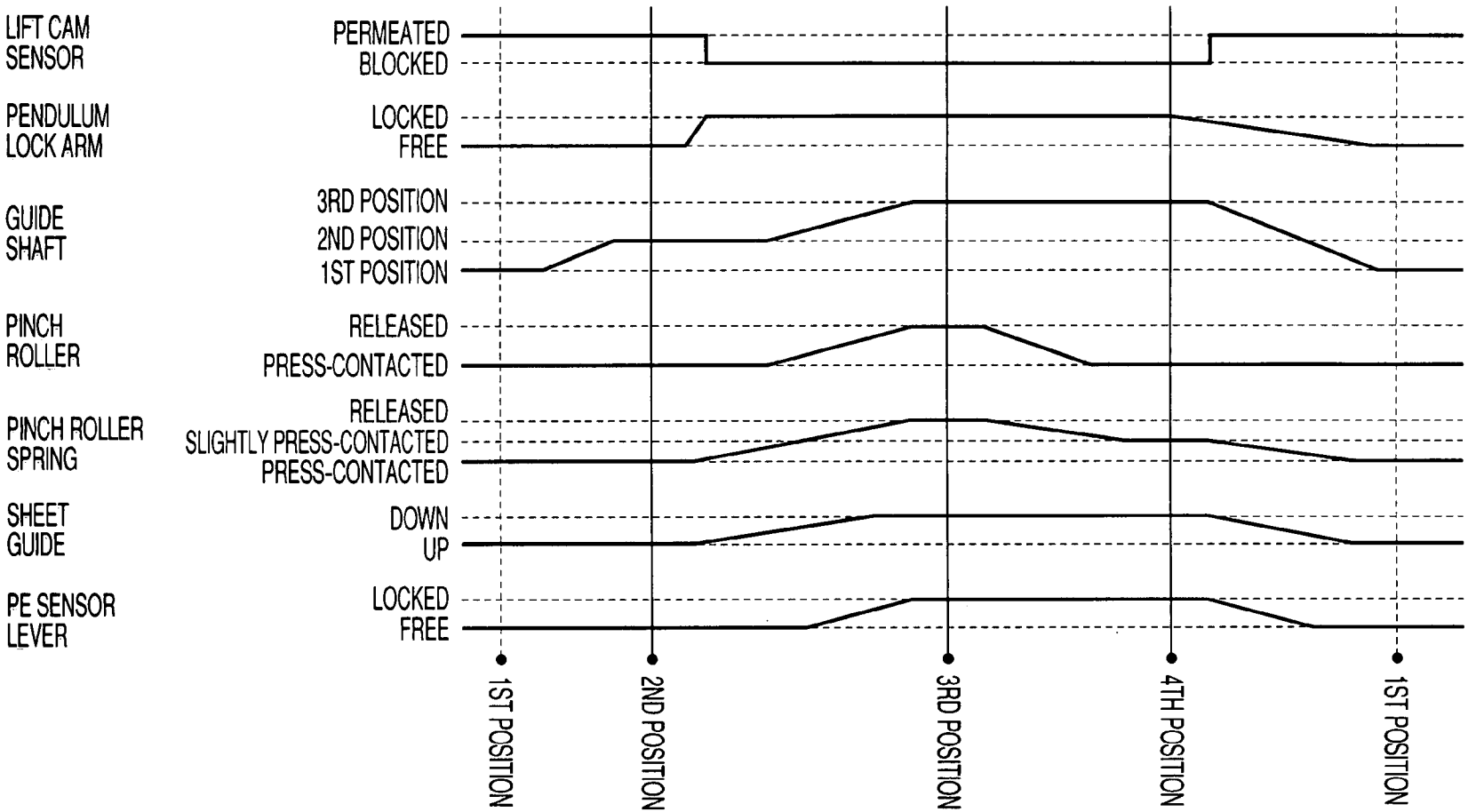
FIG. 12 is a timing chart showing function states of a lift mechanism.

FIG. 12 is a timing chart showing the function states of the lift mechanisms. In order to clarify further the contents explained in FIGS. 5A through 5C, 6A and 6B, 7A and 7B, 8 to 10, and 11A through 11D, an explanation will be given again with reference to a timing chart in FIG. 12.

The abscissa in FIG. 12 indicates an angle of the lift cam shaft 58 over a range of 360° and the ordinate indicates each mechanism and a position thereof. As shown in FIG. 12, a synchronized operation of the lift cam shaft 58 and the guide shaft 14 allows to simultaneously operate the plural mechanisms, by detecting the angle of the lift cam shaft 58 with the lift cam sensor 69 (FIG. 4), and controlling the rotation angle of the ASF motor 46 (FIG. 3).

The lift mechanisms function as have been explained in the foregoing.

Figure 13A:
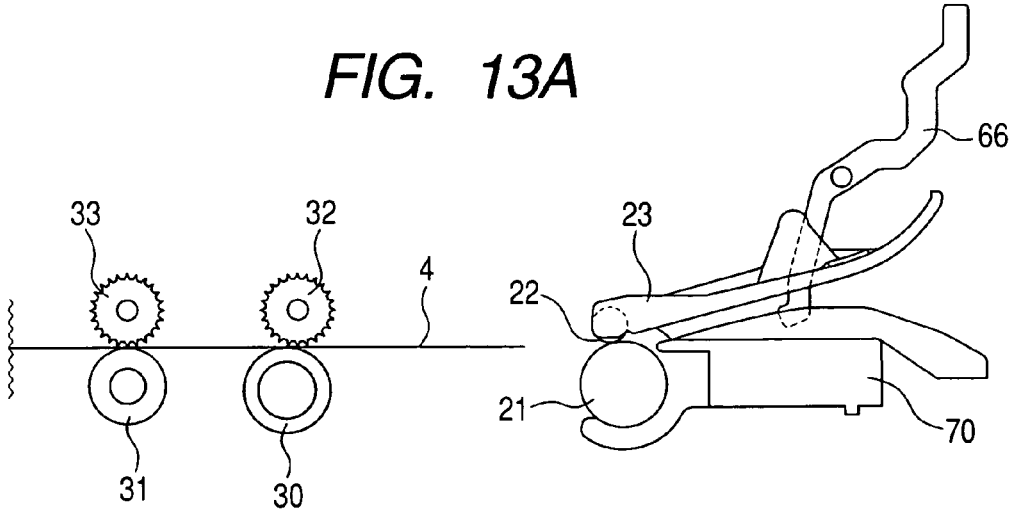
FIGS. 13A, 13B, and 13C are schematic lateral views showing a process, after recording on a front side of a recording sheet, of re-introducing the recording sheet into a nip of sheet conveying rollers.
Figure 13B:
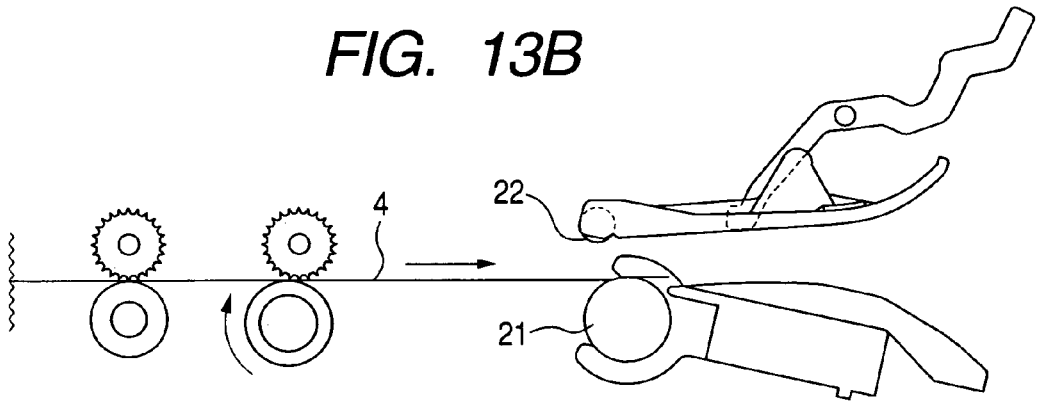
Figure 13C:
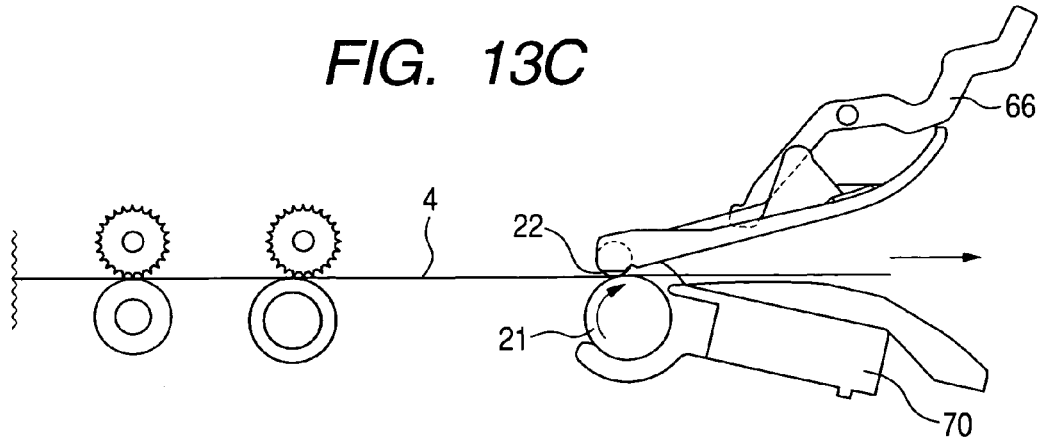

FIGS. 13A to 13C are schematic lateral views showing steps of re-entry of a recording sheet, after a recording on a front side (top side or first side) thereof, into the nip of the sheet conveying roller 21. In the following, a specific explanation will be given on how an auto both-side recording is achieved on a recording sheet.

FIG. 13A shows a state where the recording sheet 4 has completed the recording on the front side (top side or first side) and is supported by the first sheet discharge roller 30 and the first spur array 32, and the second sheet discharge roller 31 and the second spur array 33. The first spur array 32 and the second spur array 33 are constituted of rotary members pressed to and driven by the corresponding sheet discharge rollers. In this state, the lift mechanisms are in the first or second position. As explained in the foregoing, by executing the recording under advancement of the recording sheet 4 to such position, the discharge port array of the recording head 11 can be opposed down to the rear end of the recording sheet 4, whereby the recording can be achieved without forming a lower margin on the recording sheet 4.

Then the lift mechanisms are shifted to the third position as shown in FIG. 13B, thereby forming a predetermined large gap between the pinch roller 22 and the sheet conveying roller 21. It is thus rendered possible to achieve easy entry of the rear end of the recording sheet 4, even with a certain undulation or an upward curling. In this state, the pinch roller holder 23 and the carriage 13 do not mutually interfere, so that the carriage 13 may be present in any position in the main scanning direction.

FIG. 13B shows a state where the recording sheet 4 is conveyed in a direction b in FIG. 2 (hereinafter the conveying of the recording sheet 4 in such direction being called a back-feed reverse conveying) by rotating the first sheet discharge roller 30 in a direction indicated by an arrow from a state shown in FIG. 13A, and is stopped under the pinch roller 22. A stopping in this state is adopted because the recording apparatus of the present embodiment employs an ink jet recording method of wet type. The recorded side of the recording sheet 4 (upper side in FIGS. 13A to 13C) is in a wet state immediately after the recording operation and, if immediately pinched between the pinch roller 22 and the sheet conveying roller 21, the ink may be transferred onto the pinch roller 22 and may be transferred again onto the recording sheet 4 in a subsequent conveying process thereby causing a smear thereon.

Whether the ink transfers onto the pinch roller 22, stated differently whether the ink is dry or not, is influenced by various factors. Such factors include a type of the recording sheet, a type of the used ink, a superposed deposition-method of the used ink, a deposition amount of the used ink per unit area (for example, density per unit area of recorded data), an environmental temperature of the recording operation, an environmental humidity of the recording operation, an environmental gas flow rate of the recording operation, etc. In brief, the ink tends to dry faster on a recording sheet having an ink receiving layer at the surface and capable of introducing the ink promptly into the interior. Also a faster drying is possible with an ink employing smaller ink particles such as a dye and easily permeable into the interior of the recording sheet. Also a faster drying is possible with an ink system utilizing chemically reactive inks which are solidified by superposed deposition onto the surface of the recording sheet.

Also a faster drying is possible by reducing the ink amount deposited per unit area. Also a faster drying is possible by elevating the environmental temperature of the recording operation. Also a faster drying is possible by lowering the environmental humidity of the recording operation. Also a faster drying is possible by elevating the environmental gas flow rate of the recording operation. Since the necessary drying time varies by various conditions as explained above, the present embodiment adopts a configuration of employing, as a standard value, a drying time required in a recording operation with a predetermined ink system under ordinary conditions of use (ordinary recording sheet and ordinary recording environment), and regulating such standard value with a predictable condition to obtain a drying-time.

The predictable condition is an ink amount deposited per unit area, but it is possible also to achieve a finer prediction of the waiting time for drying, by employing means for detecting the environmental temperature, means for detecting the environmental humidity, means for detecting the environmental air flow rate, etc., in combination. The waiting time for drying can be determined, for example, by storing the data received from the host apparatus 308 (FIG. 3) in the RAM 312 (FIG. 3), calculating the ink amount to be deposited per unit area and comparing a maximum value with a predetermined threshold value stored in the ROM 311 (FIG. 3). The waiting time for drying can be optimized according to the pattern to be recorded, by increasing the waiting time for a larger maximum value of the ink amount per unit area and decreasing the waiting time for a smaller maximum value.

The waiting time for drying is also variable depending on whether the ink used for recording is a dye-based ink or a pigment-based ink, and may be made shorter for a dye-based ink which dries faster and longer for a pigment-based ink which dries slower. Also the waiting time for drying may be made shorter at a higher ambient temperature causing a faster drying, or longer at a lower ambient temperature causing a slower drying. Also the waiting time for drying may be made longer at a higher ambient humidity causing a slower drying, or shorter at a lower ambient humidity causing a faster drying. Also the waiting time for drying may be made shorter in case of a recording sheet having an ink receiving layer on the surface and capable of immediately introducing the deposited ink into the interior because the surface of the recording sheet can be easily dried, and made longer for a strongly water-repellent recording sheet which is more difficult to dry.

Such waiting for drying may be made in the state shown in FIG. 13A, but is preferably executed after a back-feed of the recording sheet 4 to a position shown in FIG. 13B. This is because of a deformation in the recording sheet 4. In case of a recording on the recording sheet 4 with a wet ink jet process, a water absorption of the recording sheet 4 causes a dilatation of fibers constituting the recording sheet 4, thereby resulting in an elongation thereof. Depending on the recorded pattern, the recording sheet 4 may generate a relatively significantly elongated portion and a relatively insignificantly elongated portion, and, in such case, the surface of the recording sheet 4 shows a conspicuous undulation with a lapse of time after the recording. Magnitude of such undulation depends principally on the time after the start of water absorption by the recording sheet 4, and increases with the lapse of time, converging to a predetermined deformation amount.

Therefore, in case the deformation at the end of the recording sheet becomes large after a prolonged lapse of time, even if the pinch roller 22 is released from the sheet conveying roller 21, there is a possibility that the end portion of the recording sheet interferes with the pinch roller 22 thereby causing a jam. In order to avoid such situation, the recording sheet after the recording is subjected to the back-feeding and is moved to the position under the pinch roller 22 before the undulation by the deformation of the recording sheet becomes large. Because of the aforementioned reason, the present embodiment adopts a configuration of awaiting the drying of the recorded portion of the recording sheet 4 after back-feeding of the rear end of the front side of the recording sheet 4 to the position shown in FIG. 13B. The gap between the sheet conveying roller 21 and the pinch roller 22 when separated is selected larger than an ordinary amount of deformation of the recording sheet after the recording of a first side (front side) thereof.

FIG. 13C shows a state in which the recording sheet 4 is conveyed toward the sheet inverting portion 2. When the recorded portion of the recording sheet 4 is dried and reaches a state where the ink is no longer transferred to the pinch roller 22 in a contact state, the lift mechanisms are shifted to the fourth position as shown in FIG. 11D to pinch the recording sheet 4 by the pinch roller 22 and the sheet conveying roller 21. In this state the sheet conveying roller 21 is driven in the reverse direction to back-feed the recording sheet 4. In this state, since the PE sensor lever 66 is rotated upward and locked, there can be prevented a situation where the end portion thereof is trapped in the recording sheet 4 or rubs the recorded portion to cause a peeling.

Also the sheet guide 70 is in the down-state and forms a substantially horizontal sheet path, so that the recording sheet 4 can be straightly conveyed toward the sheet inverting portion 2. In the present embodiment, the sheet guide 70 is normally maintained in the up-state, but the present invention is not restricted by such embodiment and the sheet guide 70 may be normally maintained in the down-state. More specifically, the lift mechanisms may normally wait in the third or fourth position and may be shifted to the first position at the sheet feeding operation from the main ASF 37. Such configuration enables a smooth insertion at the insertion of a recording sheet of a high rigidity from the side of the sheet discharge rollers.

The conveying of the recording sheet 4 after the end of the recording on the front side (top side) to the sheet inverting portion 2 is conducted as explained above.

Figure 14:
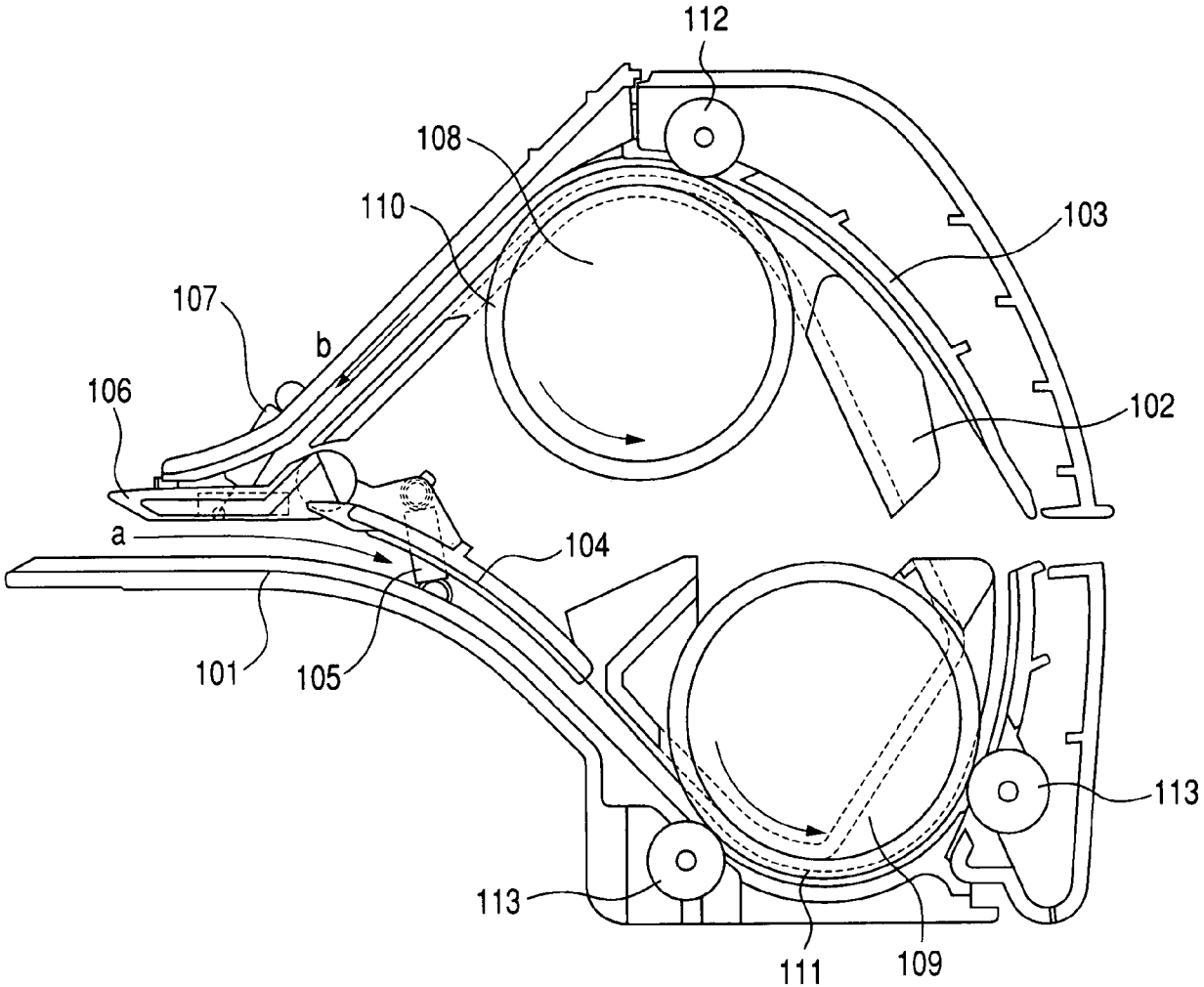
FIG. 14 is a schematic lateral cross-sectional view showing positions of sheet paths constituting a sheet inverting portion and conveying rollers.

FIG. 14 is a schematic lateral cross-sectional view showing arrangement of a sheet path and conveying rollers in the sheet inverting portion 2. In the following a conveying mode in the sheet inverting portion 2 will be explained with reference to FIG. 14.

Referring to FIG. 14, there are shown a both-side unit frame 101 constituting a structural member of the sheet inverting portion 2 and constituting a part of a sheet conveying path, an inner guide 102 fixed in the interior of the both-side unit frame 101 and constituting a part of the sheet conveying path, a rear cover 103 provided open-closably in a rear part of the both-side unit frame 101 and constituting a part of the sheet conveying path, a switching flap spring 105 for biasing a switching flap (movable flap) 104 in a predetermined direction, an exit flap spring 107 for biasing an exit flap 106 in a predetermined direction, a both-side roller rubber A 110 constituting a rubber portion of a both-side roller A 108, and a both-side roller rubber B 111 constituting a rubber portion of a both-side roller B 109.

When the recording sheet 4 is conveyed in a state shown in FIG. 13C to the sheet inverting portion 2, the exit flap 106 is biased, by the function of the exit flap spring 107, in a position as shown in FIG. 14, so that an entrance path is determined uniquely. Therefore, the recording sheet 4 proceeds in a direction indicated by an arrow a in FIG. 14. Then the recording sheet 4 impinges on the switching flap 104, and, since the switching flap spring 105 is so selected that the switching flap 104 does not rotate for an ordinary recording sheet 4 suitable for both-side recording, the recording sheet 4 proceeds along a sheet path between the switching flap 104 and the both-side unit frame 101. The recording sheet 4, proceeding in this state, is contacted at the recorded (front) side thereof with the second roller rubber 111 of the both-side roller 109 and at the unrecorded (rear) side thereof with the second pinch roller 113 formed by a polymer material of a high lubricating property, and is supported therebetween.

Since the first both-side roller 108, the second both-side roller 109 and the sheet conveying roller 21 are rotated at substantially same peripheral speeds by a drive mechanism to be explained later, the recording sheet 4 is conveyed without a slippage to the second both-side roller 109. Also such substantially same peripheral speeds prevent the recording sheet 4 from becoming slack or being subjected to a tension. After a change in the advancing direction along the second both-side roller 109, the recording sheet 4 proceeds along the rear cover 103 and is similarly supported between the first roller rubber 110 and the first both-side pinch roller 112.

After a change in the advancing direction again along the first both-side roller 108, the recording sheet 4 is conveyed in a direction b in FIG. 14. The first both-side roller 108 and the second both-side roller 109 constitute inversion rollers for inverting the front and back sides or the conveyed direction of the recording sheet 4. In the course of advancement of the recording sheet 4 in this state, the front edge thereof impinges on the exit flap 106. The exit flap 106 is biased by the exit flap spring 107 of a very low power so that the recording sheet 4 itself pushes away the exit flap 106 and exits from the sheet inverting portion 2. Also the sheet path length in the sheet inverting portion 2 is so selected that the rear end of the recording sheet 4 in the advancing direction thereof has already passed under the exit flap 106 when the front end of the recording sheet 4 in the advancing direction thereof exits from the exit flap 106, whereby there is no mutual friction between the front end portion and the rear end portion of the recording sheet 4.

Detailed operations will be explained later with reference to a flow chart, but the length of the recording sheet can be measured by the PE sensor lever 66 at the recording on the front side of the recording sheet 4. Therefore, in case a recording sheet shorter than the distance from the sheet conveying roller 21 to the second both-side roller 109 or shorter than the distance from the first both-side roller 108 to the sheet conveying roller 21, or a recording sheet longer than a turn-around distance of the sheet inverting portion 2 from the exit flap 106 to the exit flap 106 is inserted, an alarm is given at the completion of the recording on the front side and the recording sheet 4 is discharged without conveying to the sheet inverting portion 2.

Now there will be explained reason why the recorded surface of the recording sheet 4 is conveyed at the side of the first roller rubber 110 and the second roller rubber 111. The first roller rubber 110 and the second roller rubber 111 are in the driving side, while the first pinch roller 112 and the second pinch roller 113 are in the driven side. Therefore, the recording sheet 4 is conveyed by the rollers of the driving side, and the rollers of the driven side are rotated by the friction with the recording sheet 4. Such driving method is acceptable when the rotary axes supporting the first pinch roller 112 and the second pinch roller 113 have a sufficiently small axial loss, but in case the axial loss increases for some reason, there may result a slippage between the recording sheet 4 and the first pinch roller 112 or the second pinch roller 113. The recorded portion of the recording sheet 4 has been dried to such an extent that the ink is not transferred by a contact with the roller, but there may result an ink peeling from the surface of the recording sheet 4 in case it is rubbed.

In case the recorded surface of the recording sheet 4 is maintained in contact with the first pinch roller 112 or the second pinch roller 113 and causes a slippage to such rollers, the ink on the recorded surface may be peeled off. In order to avoid such situation, the present embodiment employs such an arrangement that the rollers of the driving side are contacted with the recorded (front) side and the rollers of the driven side are contacted with the unrecorded (back) side.

Another reason for adopting such arrangement is as follows. The first both-side roller 108 or the second both-side roller 109 of the driving side cannot be prepared with a diameter less than a certain limit because it is limited by a bending radius of the recording sheet 4, while the first both-side pinch roller 112 or the second both-side pinch roller 113 can be realized with a smaller diameter. Therefore, for designing a compact sheet inverting portion 2, the first both-side pinch roller 112 and the second both-side pinch roller 113 are often designed with a small diameter.

Also the recorded surface of the recording sheet 4 does not basically cause a transfer of the ink to the contacting roller, but may still cause a transfer in a very small amount, thereby gradually smearing the roller which is in contact with the recorded surface. A roller of a smaller diameter, of which external periphery has a higher frequency of contact with the recording sheet 4, is smeared faster than a roller of a larger diameter and can therefore be considered disadvantageous for such smearing. In consideration of such compact configuration of the apparatus and such roller smearing, the present embodiment adopts an arrangement in which the recorded (front) side of the recording sheet is contacted by the first both-side roller 108 and the second both-side roller 109 of larger diameters.

Still another reason for adopting such arrangement is as follows. In case of pinching and conveying a recording sheet by a pair of rollers one of which is driven, it is customary to employ a material of a higher friction coefficient in the driving side and a material of a lower friction coefficient in the driven side in order to obtain an accurate conveying amount, and to employ an elastic material in either of the rollers in order to secure a certain area of nip (nip area). A rubber material providing a high friction coefficient and a high elasticity with a low cost is usually employed for the material of the driving side. Also for increasing the conveying power, there is often employed a structure of applying a surface polishing on the rubber, including an elastomer or the like, and intentionally leaving polishing grains constituting minute irregularities. In such case, the driven side is usually formed with a polymer resin with a relatively low friction coefficient.

In a comparison of a rubber surface with small surface irregularities and a surface formed by a smooth polymer resin, the ink stain sticks to either when it is contacted with the recorded surface of the recording sheet, but the rubber with minute surface irregularities can retain the stain on the surface by such irregularities and transfers little the stain again onto the recording sheet, while the smooth polymer resin tends to show peeling of the stain and cause a re-transfer onto the recording sheet. It is therefore considered advantageous to contact rubber with the recorded surface of the recording sheet. Also because of this reason, the present embodiment adopts an arrangement in which the rollers of a rubber material are provided at a side contacting the recorded side (front side or first side) of the recording sheet and the rollers of a polymer resin material are provided at a side contacting the non-recorded side (back side) of the recording sheet.

The reversing operation for executing a both-side recording on an ordinary recording sheet is executed as explained in the foregoing.

In the following there will be explained functions of the sheet inverting portion 2 in case of a recording on a highly rigid recording medium, without both-side recording. A recording medium of a high rigidity can be, for example, a cardboard of a thickness of 2 to 3 mm, or a disk-shaped or irregular-shaped recording medium placed on a predetermined tray. Such recording medium, because of its high rigidity, cannot be so bent as to match the diameter of the both-side rollers in the sheet inverting portion 2 and cannot, therefore, be subjected to an auto both-side recording. However, there can be conceived a situation where a recording on such recording medium is desired while the sheet inverting portion 2 is attached to the recording apparatus. In case the recording medium has a high rigidity, a feeding by the main ASF 37 is also not possible, and the recording medium is fed from the side of the sheet discharge rollers 31, 32 toward the sheet conveying roller 21, utilizing the straight sheet path. The functions of the sheet inverting portion 2 in such case will be explained in the following.

Figure 15A:
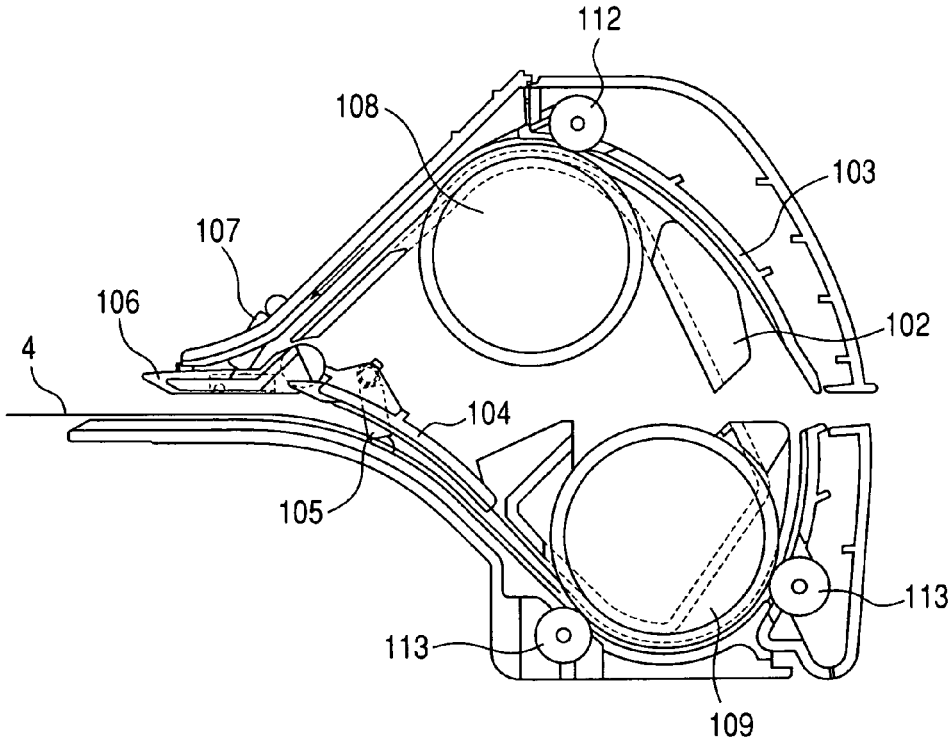
FIGS. 15A and 15B are schematic lateral cross-sectional views showing functions of a switching flap.
Figure 15B:
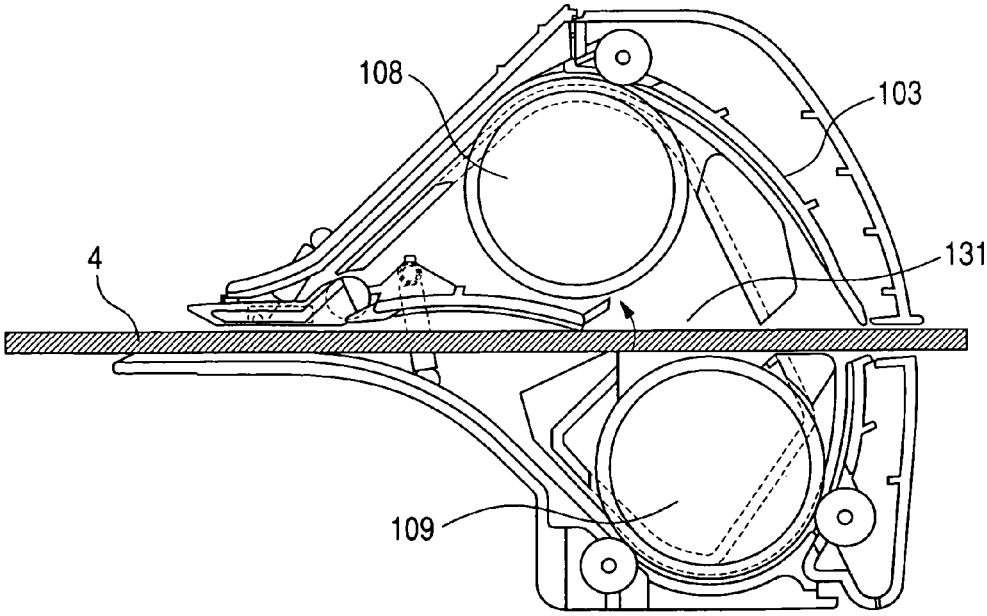

FIGS. 15A and 15B are schematic lateral cross-sectional views showing functions of the switching flap 104. FIG. 15A shows a state in an auto both-side recording with an ordinary recording sheet as explained in the foregoing. In this state, the switching flap spring 105 biases and maintains the switching flap 104 in contact with a stopper against the pressure of the recording sheet 4, so that the recording sheet 4 is guided to the aforementioned sheet path for inversion.

FIG. 15B shows a state of using a recording medium of a high rigidity. The highly rigid recording medium 4, upon entering the sheet inverting portion 2, passes under the exit flap 106 and impinges on the switching flap 104. Since the switching flap spring 105 is adjusted at such a pressure that the switching flap 104 can rock in a retracting direction upon being pressed by the inserted highly rigid recording medium, the switching flap 104 rocks counterclockwise as indicated by an arrow in FIG. 15B and is moved to a retracted position with the advancement of the highly rigid recording medium. Therefore, the highly rigid recording medium 4 is guided to a shunt path 131 constituting a second sheet path and provided between the first both-side roller 108 and the second both-side roller 109. The rear cover 103 has an aperture in a position corresponding to the shunt path 131, so that the highly rigid recording medium even of a large length is not hindered in conveying by an interference with the sheet inverting portion 2.

The present invention is not limited to the aforementioned configuration, explained with reference to FIG. 15B. In executing the present invention, it is not essential to form a shunt path 131 between the two both-side rollers at above and below, but there can also be adopted a following configuration.

Figure 16:
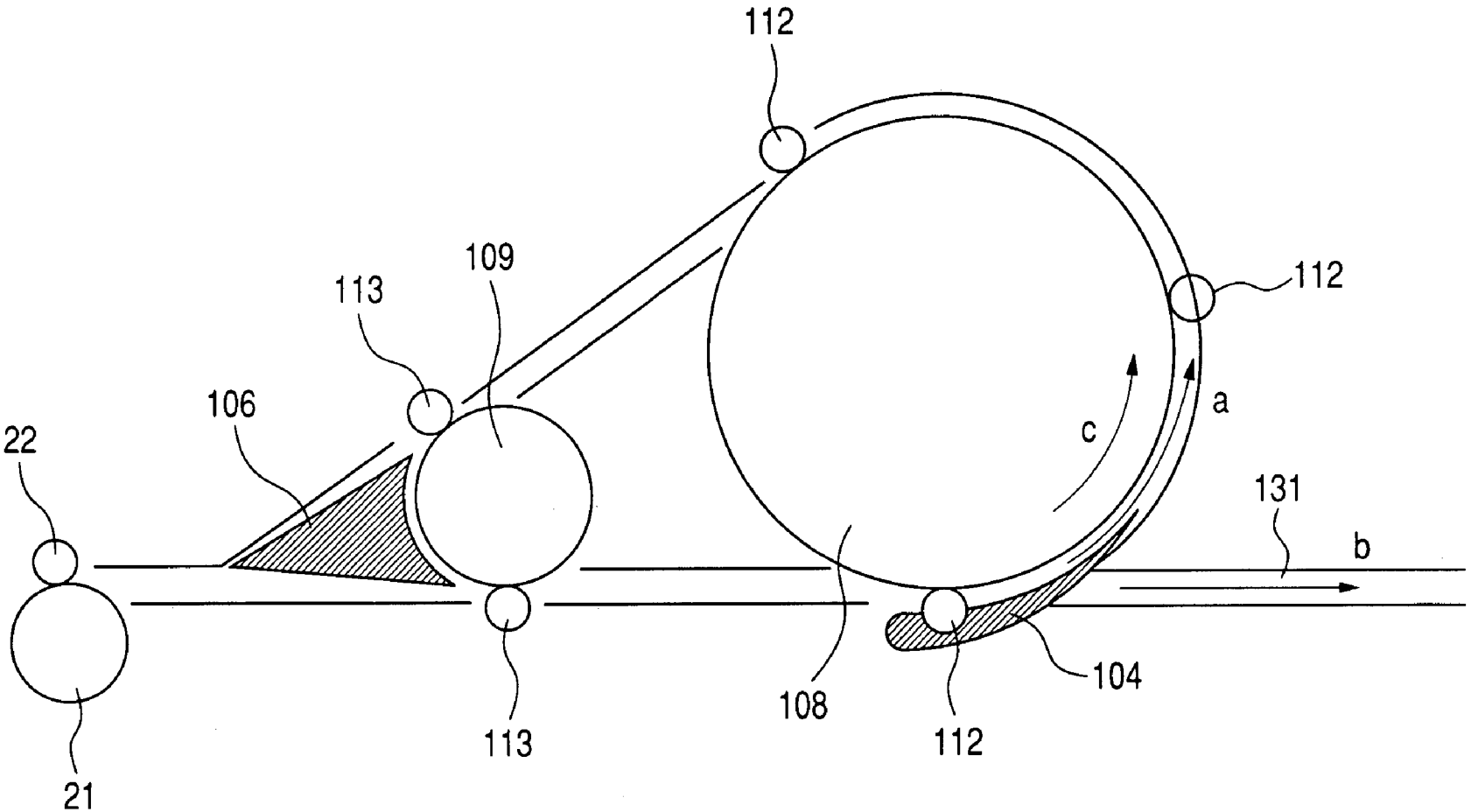
FIG. 16 is a schematic lateral cross-sectional view showing a sheet inverting portion constituted by positioning a both-side roller of a large diameter above a substantially horizontal path.

FIG. 16 is a schematic lateral cross-sectional view showing a sheet inverting portion 2 in which a both-side roller of a large diameter is positioned above a substantially horizontal path. Referring to FIG. 16, a switching flap 104 is biased, by an unillustrated switching flap spring, in a position shown in FIG. 16, and such switching flap spring is adjusted at such a spring force that the switching flap 104 can be rotated when contacted by a highly rigid recording medium. In FIG. 16, components corresponding to those in FIGS. 14, 15A and 15B are represented by corresponding numbers and the details thereof will refer to the foregoing description and will not be explained further.

In the above-described configuration, the recording sheet of low rigidity proceeds in a direction a in FIG. 16 by the rotation of the first both-side roller 108 in a direction indicated by an arrow c in FIGS. 22A to 22E, but the recording medium of a high rigidity pushes away the switching flap 104 and proceeds into a shunt path 131 as indicated by an arrow b in FIG. 16. Therefore, a highly rigid recording medium even of a large length is not hindered in conveying by an interference with the sheet inverting portion 2. As explained in the foregoing, in the sheet inverting portion of the present embodiment, it is possible to execute a one-side recording on a recording medium which has a high rigidity and cannot be bent much, without detaching the sheet inverting portion. The sheet inverting portion 2 having two sheet paths has been explained in the foregoing.

In the following, there will be explained a drive mechanism for the rollers of the sheet inverting portion 2.

Figure 17:
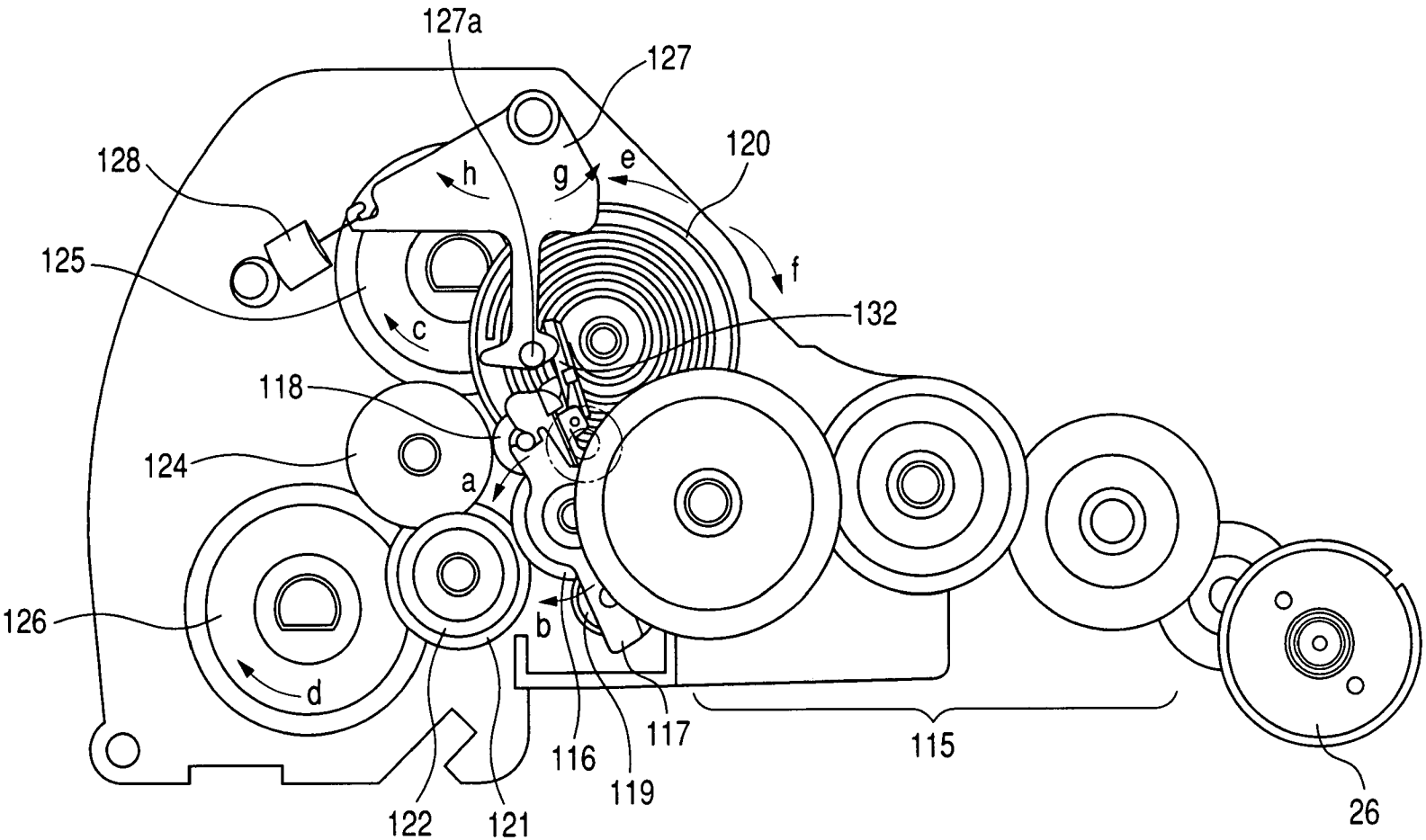
FIG. 17 is a schematic lateral cross-sectional view showing configuration of a drive mechanism for rollers of an auto both-side unit in a recording apparatus embodying the present invention, seen from a side opposite to FIG. 2.

FIG. 17 is a schematic lateral cross-sectional view showing a roller driving mechanism of the sheet inverting portion 2, seen from a side opposite to that of FIG. 2, in an embodiment of the recording apparatus embodying the present invention.

Referring to FIG. 17, there are shown a both-side transmission gear train 115 for transmitting power from the LF motor 26 to a both-side solar gear 116, a both-side solar gear 116 positioned at a center of a both-side pendulum arm, a both-side pendulum arm 117 capable of rocking about the both-side solar gear 116, a both-side planet gear 118 mounted rotatably on the both-side pendulum arm 117 and engaging with the both-side solar gear 116, and a similar second both-side planet gear 119.

Referring to FIG. 17, there are also shown a spiral groove gear 120 engaging with the both-side solar gear 116 through an idler, a first inversion delay gear 121 meshing with the both-side planet gear B 119, a second inversion delay gear 122 concentric with the first inversion delay gear 121, an inversion delay gear spring 123 providing a relative biasing force between the first inversion delay gear 121 and the second inversion delay gear 122, a both-side roller idler gear 124 connecting the two both-side roller gears, a first both-side roller gear 125 fixed to the first both-side roller 108, a both-side roller gear 126 fixed to the second both-side roller 109, a stop arm 127 rocking by engaging with the groove of the spiral groove gear 120, a stop arm spring 128 for centering the stop arm 127, and a both-side pendulum arm spring 132 mounted on the both-side pendulum arm 117.

In the present embodiment, as explained in the foregoing, the driving power for the sheet inverting portion 2 is obtained from the LF motor 26 which drives the sheet conveying roller 21. Such configuration is preferred since, in conveying the recording sheet by the cooperation of the sheet conveying roller 21 and the both-side rollers 108, 109, an almost complete synchronization can be achieved in start/stop timing and in the conveying speed of the recording sheet.

A driving force from the LF motor 26 is transmitted to the both-side solar gear 116 through the both-side transmission gear train 115. On the both-side solar gear 116, there is mounted the both-side pendulum arm 117, on which the first both-side planet gear 118 and the second both-side planet gear 119 are mounted.

As a suitable frictional force is provided between the both-side solar gear 116 and the both-side pendulum arm 117, the both-side pendulum arm 117 causes a rocking motion along the rotation of the both-side solar gear 116. Now let it be assumed that a normal direction means a rotating direction of the LF motor 26 for causing the sheet conveying roller 21 to rotate in a direction to convey the recording sheet in the discharging direction, and that a reverse direction means a rotating direction of the LF motor 26 for conveying the recording sheet toward the sheet inverting portion 2. When the LF motor 26 is rotated in the normal direction, the both-side solar gear 116 rotates in a direction a in FIG. 17. Along with the rotation of the both-side solar gear 116, the both-side pendulum arm 117 basically rocks in a direction a in FIG. 17.

As a result, the first both-side planet gear 118 meshes with the both-side roller idler gear 124, thereby rotating the both-side roller idler gear 124. By the rotation of the both-side roller idler gear 124, the first both-side roller gear 125 rotates in a direction c in FIG. 17, while the second both-side roller gear 126 rotates in a direction d in FIG. 17. The directions c and d in FIG. 17 correspond to directions in which the both-side rollers 108 and 109 respectively convey the recording sheet in the sheet inverting portion 2.

When the LF motor 26 is rotated in the reverse direction, the both-side solar gear 116 rotates in a direction b in FIG. 17. With the rotation of the both-side solar gear 116, the both-side pendulum arm 117 basically rocks in a direction b in FIG. 17, whereupon the second both-side planet gear 119 meshes with the first inversion delay gear 121. The first inversion delay gear 121 and the second inversion delay gear 122 respectively have projections, which protrude from mutually opposed thrust faces and which mutually engage serving as a clutch when the first inversion delay gear 121 is rotated by one turn while the second inversion delay gear 122 is considered to be stopped.

Prior to the engagement of the second both-side planet gear 119 with the first inversion delay gear 121, the first inversion delay gear 121 and the second inversion delay gear 122 are biased by the inversion delay gear spring 123 in such a direction that the projections are mutually separated, so that the second inversion delay gear 122 starts to rotate after about a turn of the first inversion delay gear 121 from the start of rotation thereof. Consequently, a period from the start of rotation of the LF motor 26 in the reverse direction, to the start of rotation of the second inversion delay gear 122 constitutes a delay period, in which the first both-side roller 108 and the second both-side roller 109 remain in a stopped state.

A rotation of the second inversion delay gear 122 causes, through the both-side roller idler gear 124, the first both-side roller gear to rotate in a direction c in FIG. 17 and the second both-side roller gear to rotate in a direction d in FIG. 17. These rotating directions are same as those when the LF motor 26 is rotated in the normal direction. Therefore, this mechanism allows to rotate the first both-side roller 108 and the second both-side roller 109 constantly in the conveying direction of the recording sheet, regardless of the rotating direction of the LF motor 26.

In the following, there will be explained the function of the spiral groove gear 120. The spiral groove gear 120 is provided with gear teeth on the external periphery and, and, on an end face, with a cam formed by a spiral groove having an endless track at an innermost circumference and at an outermost circumference. In the present embodiment, the spiral groove gear 120 is connected with the both-side solar gear 116 across the idler gear, and therefore rotates in the same direction as and in synchronization with the both-side solar gear 116. In the groove of the spiral groove gear 120, there engages a follower pin 127*a* constituting a part of the stop arm 127, which therefore rocks according to the rotation of the spiral groove gear 120. For example, when the spiral groove gear 120 rotates in a direction e in FIG. 17, the follower pin 127*a* is guided in the spiral groove and is drawn into the internal part, whereby the stop arm 127 rocks in a direction g in FIG. 17. When the spiral groove gear 120 continues to rotate in the direction e in FIG. 17, the follower pin 127*a* soon enters the endless track at the innermost circumference, whereby the stop arm 127 stops at a predetermined position.

On the other hand, when the spiral groove gear 120 rotates in a direction f in FIG. 17, the follower pin 127*a* is moved to the outer circumference whereby the stop arm 127 rocks in a direction h in FIG. 17. Similarly also in this case, when the spiral groove gear 120 continues to rotate in the direction f in FIG. 17, the follower pin 127*a* soon enters the endless track at the outermost circumference, whereby the rocking motion of the stop arm 127 stops at a predetermined position. In order that the follower pin 127*a* can smoothly move from the outermost or innermost endless track to the spiral groove when the rotating direction of the spiral groove gear 120 is changed, a stop arm spring 128 is mounted on the stop arm 127 for causing a centering force to a center position at about the middle of the moving range of the stop arm 127.

The stop arm 127 functioning as explained above acts on the both-side pendulum arm spring 132 mounted on the both-side pendulum arm 117. The both-side pendulum arm spring 132 is an elastic member mounted on the both-side pendulum arm 117 and extending toward the stop arm 127. The front end of the both-side pendulum arm spring 132 is always positioned closer than the stop arm 127 to the center of the spiral groove gear 120.

Such configuration provides following functions when the LF motor 26 rotates in the normal direction. When the recording sheet is conveyed to the sheet inverting portion 2 by rotating the LF motor 26 in the reverse direction and is returned to the sheet conveying roller 21 after the front-back side inversion, the stop arm 127 rotates on the outermost endless track of the spiral groove gear 120 as shown in FIG. 18C to be explained later. Thereafter, during the recording on the back side by rotating the LF motor 26 in the normal direction, the stop arm 127 moves toward the internal circumference of the spiral groove gear 120. When the LF motor 26 rotates in the normal direction, since the both-side pendulum arm 117 executes power transmission by a rocking in the direction a in FIG. 17, the stop arm 127 comes into contact with the both-side pendulum arm spring 132 in the course of movement toward the internal circumference as shown in FIG. 18D.

When the LF motor 26 is further rotated in the normal direction, the stop arm 127 moves further to the internal circumference thereby causing an elastic deformation of the both-side pendulum arm spring 132, whereby the position of the both-side pendulum arm 117 is determined by a balance of a force, acting in an angular direction of pressure, of the meshing tooth faces of the first both-side planet gear 118 and the both-side roller idler gear 124 in mutually meshing state, a force for rocking the both-side pendulum arm 117 in the direction a in FIG. 17, and a repulsive force of the both-side pendulum arm spring 132. In the present embodiment, the repulsive force of the both-side pendulum arm spring 132 is selected so small that, even when the stop arm 127 is present in the innermost endless track as shown in FIG. 18E, the power transmission between the first both-side planet gear 118 and the both-side roller idler gear 124 is continued with a mere elastic compression of the both-side pendulum arm spring 132.

Also, even in case the operation of the LF motor 26 is intermittent and repeats rotation and stopping, teeth of the first both-side plant gear 118 and the both-side roller idler gear 124 continue to mesh and are not disengaged even during a stopped state. However, when the recording on the back side of the recording sheet 4 is completed and the power transmission to the sheet inverting portion 2 becomes unnecessary, it is preferable to disconnect the drive in order to reduce the load on the LF motor 26. Therefore, following operations are executed in case disconnection of the power transmission is desired.

Figure 18A:
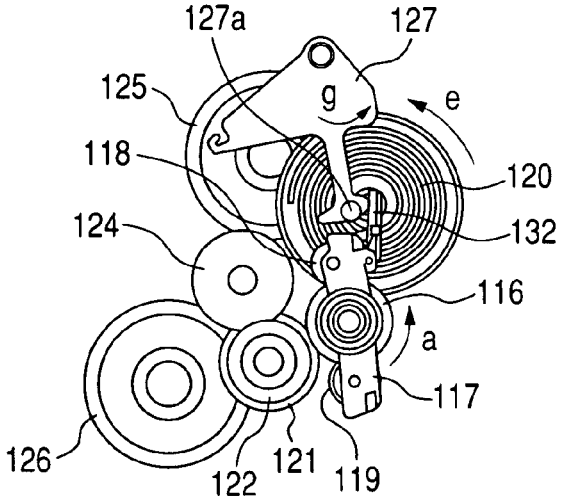
FIGS. 18A, 18B, 18C, 18D, 18E, and 18F are schematic lateral cross-sectional views showing functions of the roller drive mechanism of the auto both-side unit shown in FIG. 17.
Figure 18D:
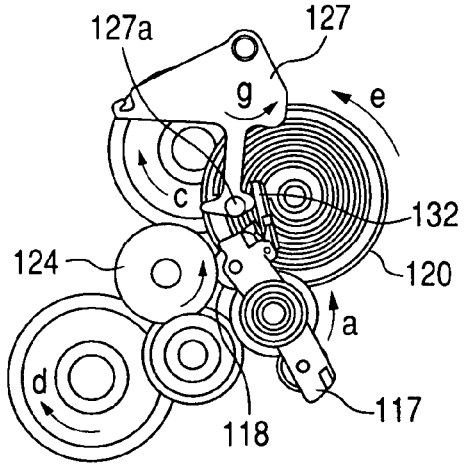
Figure 18B:
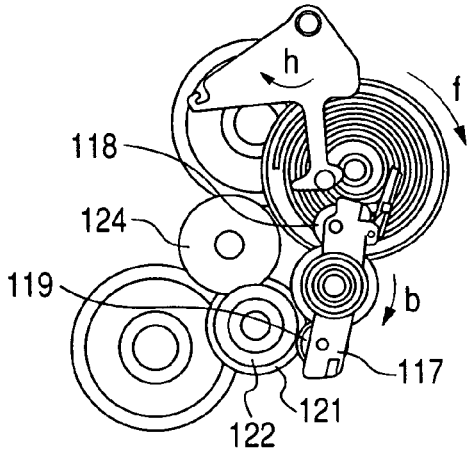
Figure 18E:
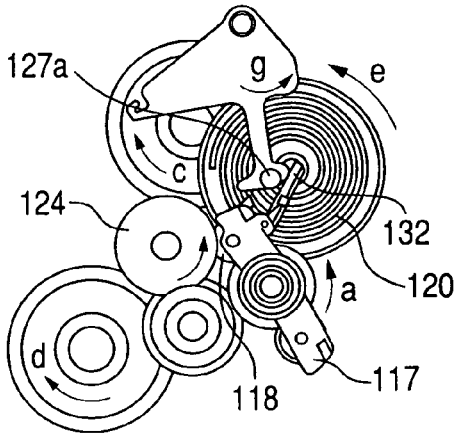
Figure 18C:
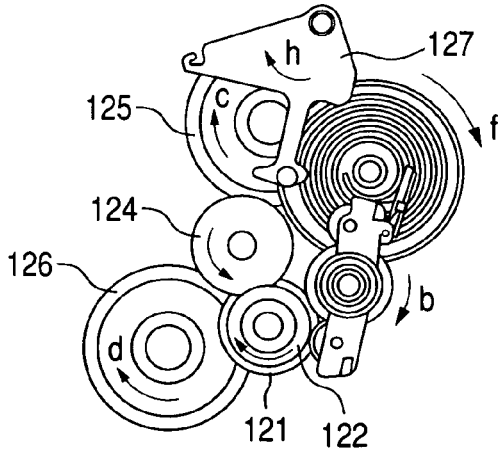
Figure 18F:
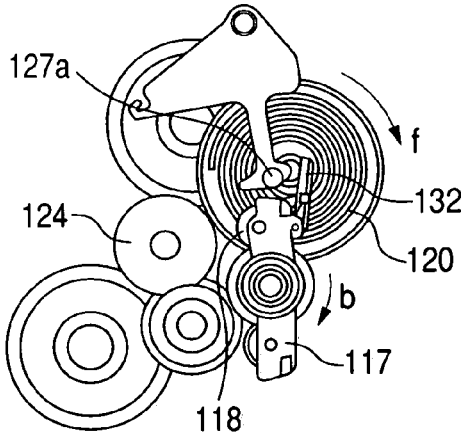

More specifically, the LF motor 26 is slightly rotated in the reverse direction, as shown in FIG. 18F, in a state where the stop arm 127 is in the innermost endless track and the both-side pendulum arm spring 132 is elastically deformed. In this operation, while the both-side pendulum arm 117 is in a state of receiving a rotating force in a direction b in FIG. 17 by the repulsive force of the both-side pendulum arm spring 132 but being stopped by the mutual meshing of the teeth of the first both-side planet gear 118 and the both-side roller idler gear 124, a rotation in a direction of disengaging the mutual meshing of the teeth is given in such state, whereby the both-side pendulum arm 117 rotates at once in a direction b in FIG. 17.

Once the both-side pendulum arm 117 is rotated in the direction b in FIG. 17 as explained above, the elastically deformed both-side pendulum arm spring 132 returns to the original state. Therefore, even in case the LF motor 26 is rotated in the normal direction in this state, because of the interference of the both-side pendulum arm spring 132 and the stop arm 127, the both-side pendulum arm 117 cannot cause a rocking motion to a position where the first both-side planet gear 118 and the both-side roller idler gear 124 mutually mesh. Therefore, from this state, the driving power cannot be transmitted to the both-side pendulum arm 117 and the subsequent components in the sheet inverting portion 2 unless the LF motor 26 is rotated once in the reverse direction by a predetermined amount. The drive up to the both-side pendulum arm 117 merely involves rotation of a gear train and only requires a little load on the LF motor 26, almost comparable to that when the sheet inverting portion 2 is not attached.

In case the LF motor 26 is rotated in the reverse direction from a state where the stop arm 127 is in the innermost endless track, the power transmission to the first inversion delay gear 121 can be executed as explained before, since there is no effect between the both-side pendulum arm spring 132 and the stop arm 127.

The drive mechanism for the rollers of the sheet inverting portion 2 has been explained in the foregoing.

Thus, as will be apparent from the foregoing description, in a both-side recording apparatus including a sheet conveying roller 21, a recording portion 11 and a sheet inverting portion 2 in which a recording sheet 4 is subjected to a recording on a first side (front side), then conveyed by the sheet conveying roller to the sheet inverting portion and supported after the inversion by the sheet conveying roller again for recording on a second side (back side), the configuration shown in FIGS. 17 and 18A to 18F causes a both-side roller to start rotation in synchronization with the sheet conveying roller after the recording on the first side and within a period from the start of rotation of the sheet conveying roller to the supporting of the front end of the recording sheet by the both-side roller 109 in the sheet inverting portion. Also the both-side rollers 108, 109 are so constructed to start rotation in synchronization with the sheet conveying roller 21, by first clutch means which is connected by rotating the sheet conveying roller 21, by a predetermined amount, in a first rotating direction (reverse rotation) for conveying the recording sheet 4 to the sheet inverting portion 2.

Figures 19, 19A:
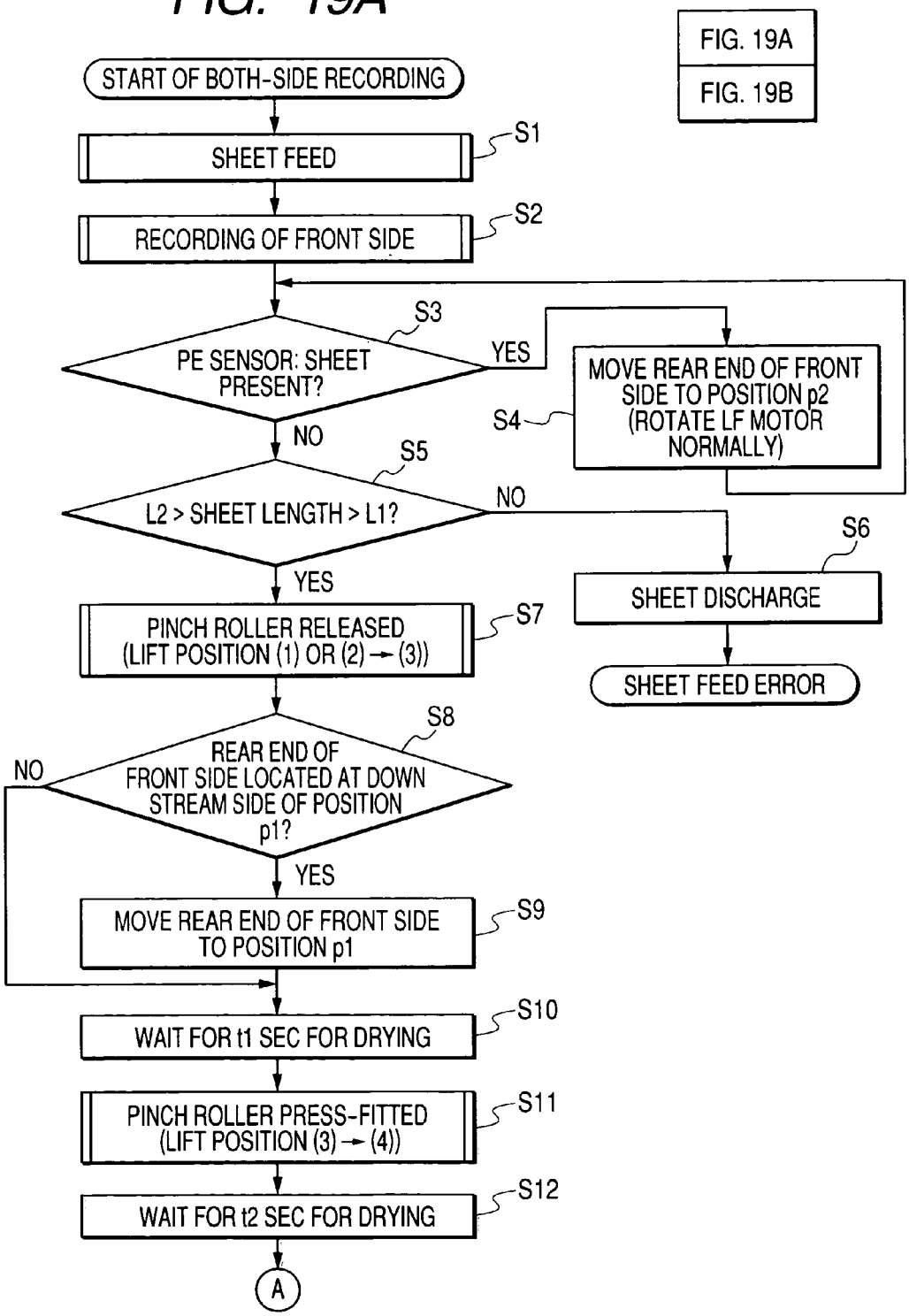
FIG. 19 is comprised of FIGS. 19A and 19B, which are flow charts showing an operation sequence in an auto both-side recording.
Figure 19B:
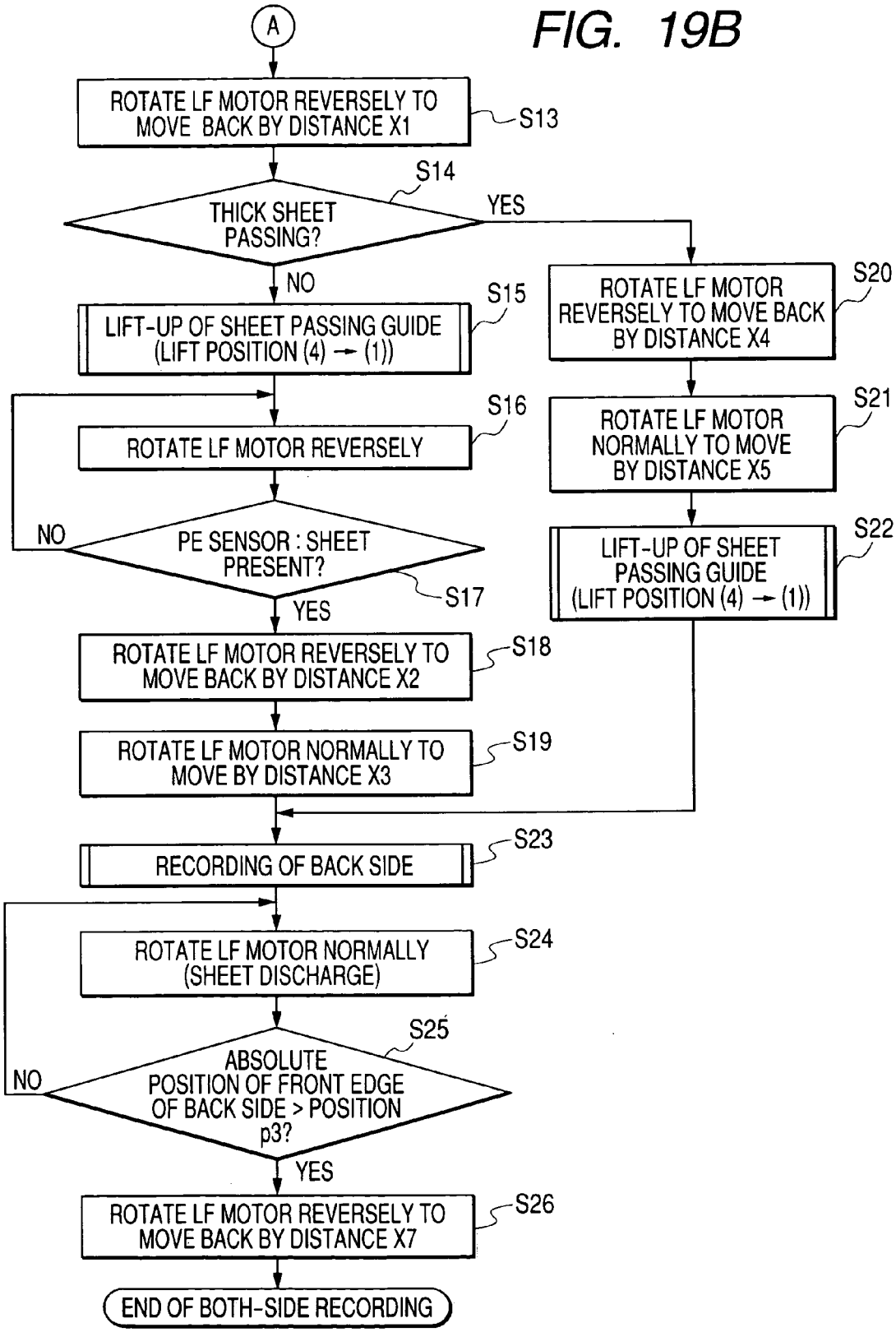

FIGS. 18A to 18F are schematic lateral cross-sectional views of the drive mechanism for the rollers of the sheet inverting portion 2 shown in FIG. 17, and FIGS. 19A and 19B are flow charts showing an operation sequence of an auto both-side recording. In the following, details of the function of the roller driving mechanism of the sheet inverting portion 2 and of the function of auto both-side recording will be explained with reference to flow charts in FIGS. 19A and 19B.

When an auto both-side recording is initiated as shown in FIGS. 18A to 18F, 19A and 19B, a step S1 executes feeding of a recording sheet 4. For example, the recording sheet 4 is fed from the main ASF 37 toward the sheet conveying roller 21. Then a step S2 executes a recording of a front (top) side. This operation is similar to a case of a one-side recording. In this operation, the roller drive mechanism is in a state shown in FIG. 18A.

FIG. 18A shows a state where the LF motor 26 rotates in the normal direction after an initialization of the drive mechanism of the sheet inverting portion 2. This corresponds to a state during a front side recording operation in an auto both-side recording, or during an ordinary recording operation not utilizing the auto both-side recording. In this state, the follower pin 127*a* of the stop arm 127 is in the innermost endless track of the spiral groove gear 120, whereby the both-side pendulum arm 117 tends to rock in the direction a in FIG. 17 and FIGS. 18A to 18F but impinges on the stop arm 127 and cannot rock any more, so that the first both-side planet gear 118 cannot mesh with the both-side roller idler gear 124, whereby the driving power from the LF motor 26 cannot be transmitted to the first both-side roller gear 125 nor the second both-side roller gear 126. In this state, the first both-side roller 108 or the second both-side roller 109, subjected to an axial loss under the pressure of the first both-side pinch roller 112 or the second both-side pinch roller 113 is not rotated, so that the load to the LF motor 26 is low.

Then, when the recording on the front side is completed, a step S3 confirms whether the rear end of the recording sheet has been detected by the PE sensor 67. In case the PE sensor 67 still detects the presence of the recording sheet 4, the rear end of the front side thereof is not yet detected and a step S4 continues the rotation of the LF motor 26 in the normal direction to move the recording sheet 4 until the rear end of the front side thereof reaches a position p2 a little beyond the PE sensor lever 66. Then a step S5 calculates the length of the recording sheet 4, based on the conveying amount of the recording sheet 4 from the detection of the front end of the recording sheet 4 to the detection of the rear end by the PE sensor 67.

As explained in the foregoing, a recording sheet 4 having a length shorter than a predetermined length L1 has to be excluded from the auto both-side recording operation, since the front end of the recording sheet 4 cannot reach the roller in the conveying from the sheet conveying roller 21 to the second both-side roller 109 or in the conveying from the first both-side roller 108 to the sheet conveying roller 21. Also a recording sheet 4 having a length longer than a predetermined length L2 has to be excluded from the auto both-side recording operation, since the recorded surface of the recording sheet causes an undesirable mutual contact in the sheet path from the sheet conveying roller 21 to the sheet inverting portion 2. In case a necessity for exclusion from the auto both-side recording operation is identified under these conditions, the flow proceeds to a step S6 for rotating the LF motor 26 in the normal direction thereby directly discharging the recording sheet 4. In case the length of the recording sheet is identified as suitable under the aforementioned conditions, the flow proceeds to a step S7 for shifting the lift mechanisms to the third position as shown in FIG. 11C thereby releasing the pinch roller 22.

Then a step S8 confirms whether the rear end of the front side of the recording sheet 4 has already been conveyed to a downstream side of a position p1 in the vicinity of the pinch roller 22. In case the conveying has already been made to the downstream side, a step S9 executes a back-feed by rotating the LF motor 26 in the reverse direction until the rear end of the front side reaches p1 in order to achieve a secure pinching between the sheet conveying roller 21 and the pinch roller 22 when the pinch roller 22 is returned to the contact state. In these operations, the roller drive mechanism is in a state shown in FIG. 18B. It is preferred not to interrupt the steps S2 to S8 as far as possible and to execute the step S9 before the recording sheet 4 is deformed, as explained before. In case the rear end of the front side is at an upstream side of p1, a secure pinching of the recording sheet is possible by contacting the pinch roller 22, so that the flow immediately proceeds to a step S10.

FIG. 18B shows a state immediately after the start of rotation of the LF motor 26 in the reverse direction. This state is assumed immediately after the start of the back-feed, after the completion of the front-side recording in the auto both-side recording (state in FIG. 13B), or in case the LF motor 26 is rotated in the reverse direction for the purpose of regulating a lead-in amount after the sheet feeding from the main ASF 37. In this state, the rocking motion of the both-side pendulum arm 117 in the direction b in FIG. 17 and FIGS. 18A to 18F is not hindered, so that the second both-side planet gear 119 meshes with the first inversion delay gear 121. In response, the first inversion delay gear 121 starts to rotate, but does not transmit, for about a turn, the driving power to the second inversion delay gear 122, whereby the both-side roller idler gear 124 does not rotate and the first both-side roller 108 and the second both-side roller 109 do not function.

Therefore, the load to the LF motor 26 is still low in this state. Such state is provided because, at the back-feeding of the recording sheet 4 in the auto both-side recording operation, the second both-side roller 109 need not be rotated until the front end of the recording sheet 4 reaches the second both-side roller 109 since there is a certain distance from the sheet conveying roller 21 to the second both-side roller 109. This is also to avoid, for example at the regulation of the lead-in amount in the ordinary recording operation, unnecessary rotation of the first both-side roller 108 or the second both-side roller 109 as explained before.

Then a step S10 provides a waiting time until the ink recorded on the front side of the recording sheet 4 dries. Since the necessary drying time is variable by certain factors as explained before, the waiting time t1 for drying may be made a variable parameter. More specifically, t1 is determined in consideration of conditions such as a type of the recording sheet, a type of the ink, a superposed deposition method of the ink, an ink deposition amount per unit area, an environmental temperature, an environmental humidity, an environmental air flow rate, etc.

Then a step S11 shifts the lift mechanisms to a fourth position shown in FIG. 1D, whereby the recording sheet 4 is pinched again by the sheet conveying roller 21 and the pinch roller 22.

Then a step S12 provides a waiting time t2 for drying. It may be dispensed with in case the waiting for a time t1 is executed in the step S10, and, in such case, the flow may proceed to a next step, assuming t2=0. The waiting of a time t2 for drying is required in case a rear end portion of the recording sheet 4 is not subjected to a recording operation and constitutes a margin. In such case, the pinch roller 22 can be immediately pressed to such margin without any trouble, by taking t1=0 in the step S10. However, an immediate back-feed of the recording sheet 4 may cause a transfer of the undried ink onto the pinch roller 22, and a waiting time t2 for drying may be provided in the step S12.

Then a step S13 rotates the LF motor 26 in the reverse direction, thereby back-feeding the recording sheet 4 by a predetermined amount X1. This step conveys the recording sheet 4 to the sheet inverting portion 2 for front-back side inversion. After this step, a front end of the back side returns to a position slightly in front of the sheet conveying roller 21. At this point, the roller drive mechanism assumes a state shown in FIG. 18C.

FIG. 18C shows a state where the LF motor 26 continues to rotate in the reverse direction. This corresponds to a state where the recording sheet 4 is back-fed and inverted in the sheet inverting portion 2. When the inversion delay gear 121 rotates by about a turn after the state shown in FIG. 18B, the projection protruding in the thrust direction of the first inversion delay gear 121 engages with the opposed projection of the second inversion delay gear 122, whereby the first inversion delay gear 121 and the second inversion delay gear 122 start to integrally rotate. Since the second inversion delay gear 122 constantly engages with the both-side roller idler gear 124, the rotation of the second inversion delay gear 122 causes the both-side roller idler gear 124, the first both-side roller gear 125 and the second both-side roller gear 126 to rotate. Thus the first both-side roller 108 rotates in a direction c in FIG. 17, while the second both-side roller 109 rotates in a direction d in FIG. 17.

As explained in the foregoing, in a both-side recording apparatus including a sheet conveying roller 21, a recording portion 11 and a sheet inverting portion 2 in which a recording sheet is subjected to a recording on a first side (front side), then conveyed by the sheet conveying roller to the sheet inverting portion and supported after the inversion by the sheet conveying roller again for recording on a second side (back side), the present embodiment is so constructed that a both-side roller 109 starts rotation in synchronization with the sheet conveying roller 21 after the recording on the first side (front side) and within a period from the start of rotation of the sheet conveying roller 21 to the supporting of the front end of the recording sheet by the both-side roller 109 in the sheet inverting portion.

Also in the above-mentioned configuration, the both-side roller 109 starts rotation in synchronization with the sheet conveying roller 21, by first clutch means (FIGS. 17, 18A to 18F) which is connected by rotating the sheet conveying roller 21, by a predetermined amount, in a first rotating direction (reverse rotation) for conveying the recording sheet 4 to the sheet inverting portion 2. As the first clutch means, there is adopted a configuration including mechanisms 120, 127, 132 for constricting the both-side pendulum arm 117 supporting the planet gears 118, 119.

Now there will be explained so-called registration operation in case the front end of the back side is introduced into the nip between the sheet conveying roller 21 and the pinch roller 22. At first, a step S14 switches the control according to whether the currently employed recording sheet 4 is a thin sheet of a low rigidity or a thick sheet of a high rigidity. The rigidity of the recording sheet 4 may be judged, for example, by the kind of the recording sheet set by the user, for example, in a printer driver, or by detection means for measuring the thickness of the recording sheet 4. The control is divided into two types because the recording sheet 4 shows different behaviors depending on the rigidity, when it is bent to form a loop.

Figure 20A:
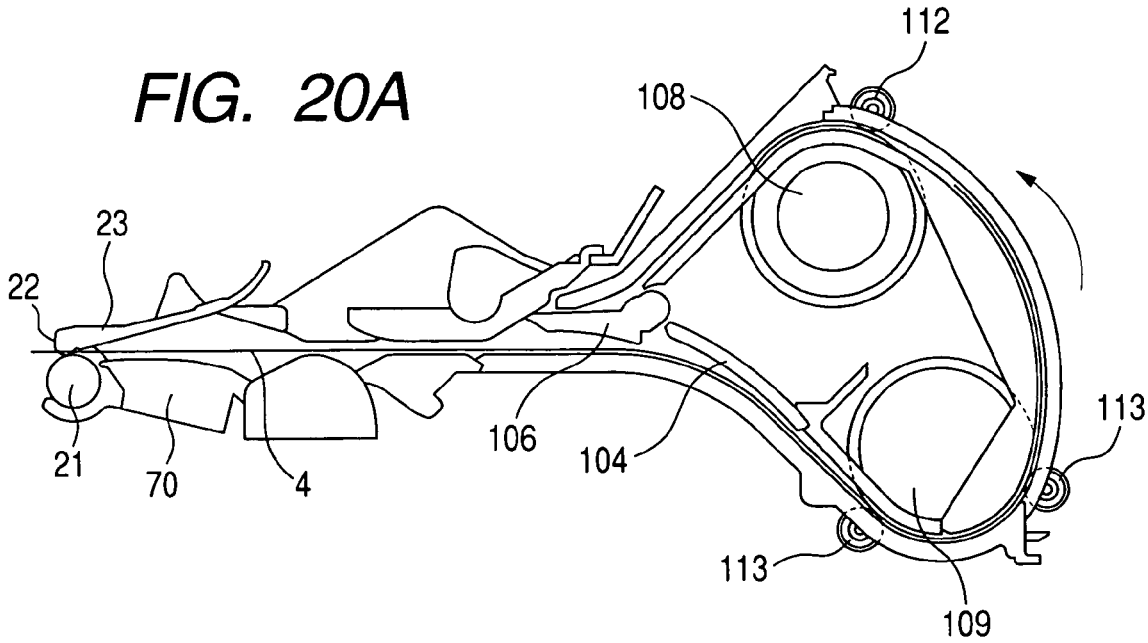
FIGS. 20A, 20B, and 20C are schematic lateral cross-sectional views showing a registration operation for a front end of a back side in case of employing a thin recording sheet.
Figure 20B:
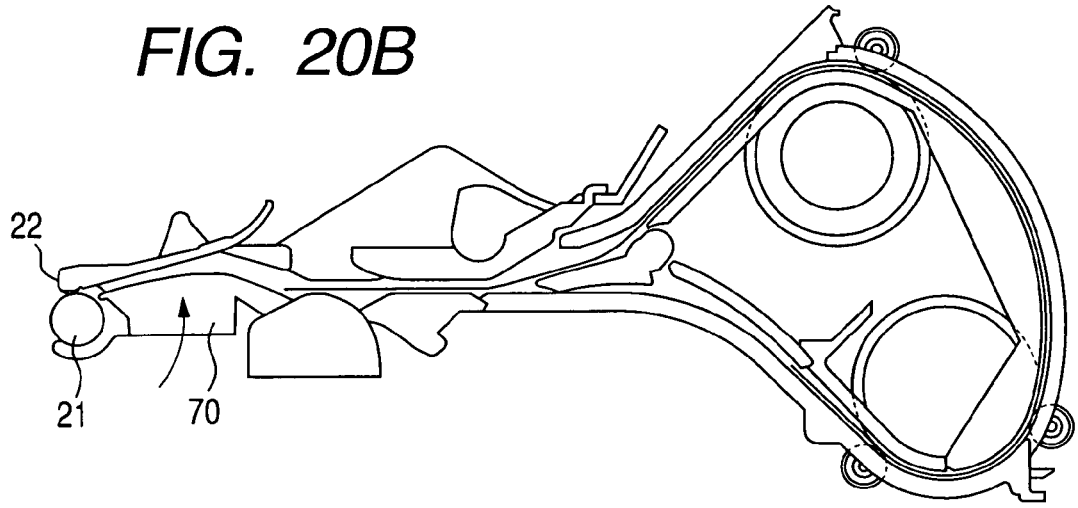
Figure 20C:
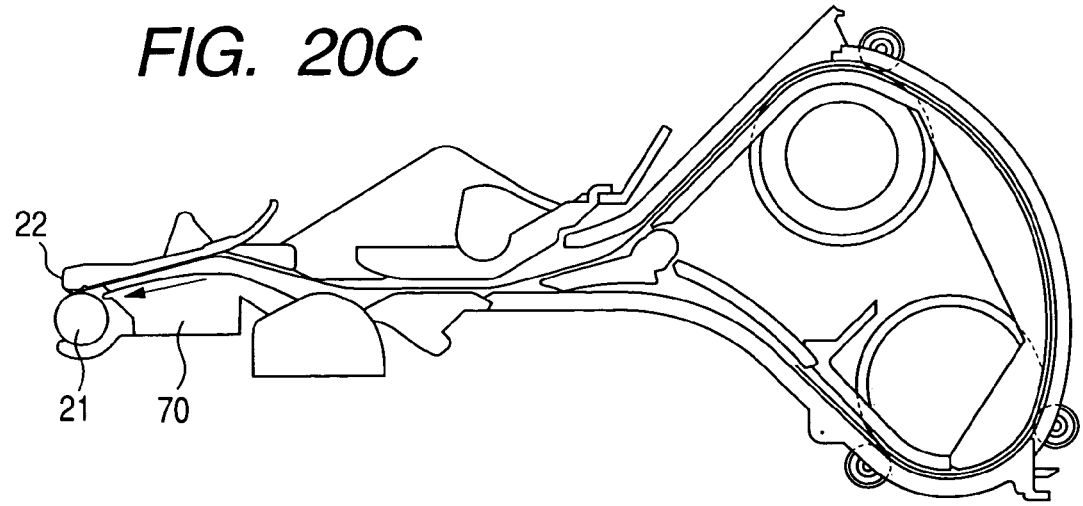

At first there will be explained a case of a thin recording sheet 4 of a relatively low rigidity. FIGS. 20A to 20C are schematic lateral cross-sectional views showing registration of the front end of the back side in case of employing a thin recording sheet 4.

Referring to FIGS. 19 and 20A to 20C, the rotation of the LF motor 26 in the reverse rotation in the step S13 executes an inverted conveying of the sheet shown in FIG. 20A. After the step S13, the front end of the back side of the recording sheet 4 almost returns to the vicinity of the sheet guide 70. In case of a thin recording sheet 4, the sequence proceeds then to a step S15. The step S15 shifts the lift mechanisms to the first position as shown in FIG. 11A, thereby elevating the sheet guide 70.

FIG. 20B shows a state after the end of the step S15. As the center of the pinch roller 22 is somewhat offset to the side of the first sheet discharge roller 30 with respect to the center of the sheet conveying roller 21 as explained before, the nip between the sheet conveying roller 21 and the pinch roller 22 has a certain angle with respect to the substantially horizontal direction in which the recording sheet 4 is conveyed. By returning the sheet guide 70 to the elevated position prior to the registration, it is rendered possible to smoothly guide the front end of the back side of the recording sheet 4 into such inclined nip portion. Then a step S16 rotates the LF motor 26 in the reverse direction, thereby further conveying the recording sheet 4 toward the sheet conveying roller 21. Then a step S17 detects the front end of the back side of the recording sheet 4 by the PE sensor 67. Upon detection of the front end of the back side, the sequence proceeds to a step S18.

Then a step S18 conveys the recording sheet 4 by a distance X2 slightly longer than a distance from a detecting position for the front end of the back side by the PE sensor 67 to the sheet conveying roller 21. Through this operation, the front end of the back side of the recording sheet 4 reaches the nip portion between the sheet conveying roller 21 and the pinch roller 22, and is bent by an additional conveying thereby forming a loop. FIG. 20C shows a state after the end of the step S18. The elevated position of the sheet guide 70 reduces the space of the sheet path in the direction of height, but the loop can be easily formed because of the relatively low rigidity of the recording sheet 4 and acts to push the recording sheet, whereby the front end of the back side of the recording sheet 4 follows the nip portion between the sheet conveying roller 21 in reverse rotation and the pinch roller 22 and becomes parallel to the sheet conveying roller 21, thus completing so-called registration operation. Then a step S19 changes the LF motor 26 to the rotation in the normal direction thereby pinching the front end of the back side of the recording sheet 4 in the nip portion and executing a conveying by a predetermined distance X3, thus completing a preparation for starting the recording on the back side.

Figure 21A:
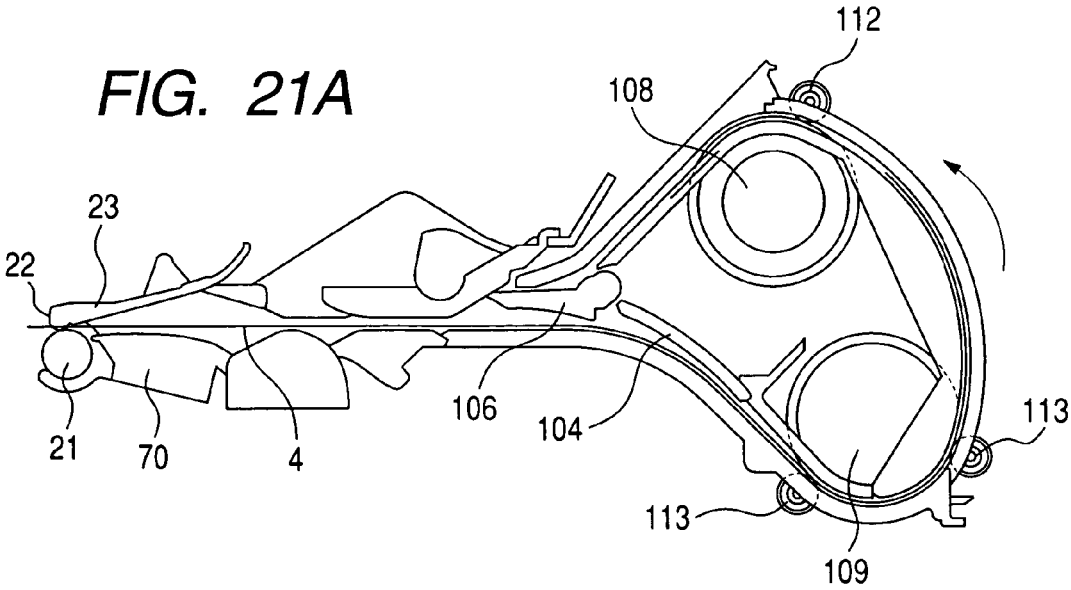
FIGS. 21A, 21B, and 21C are schematic lateral cross-sectional views showing a registration operation for a front end of a back side in case of employing a thick recording sheet.
Figure 21B:
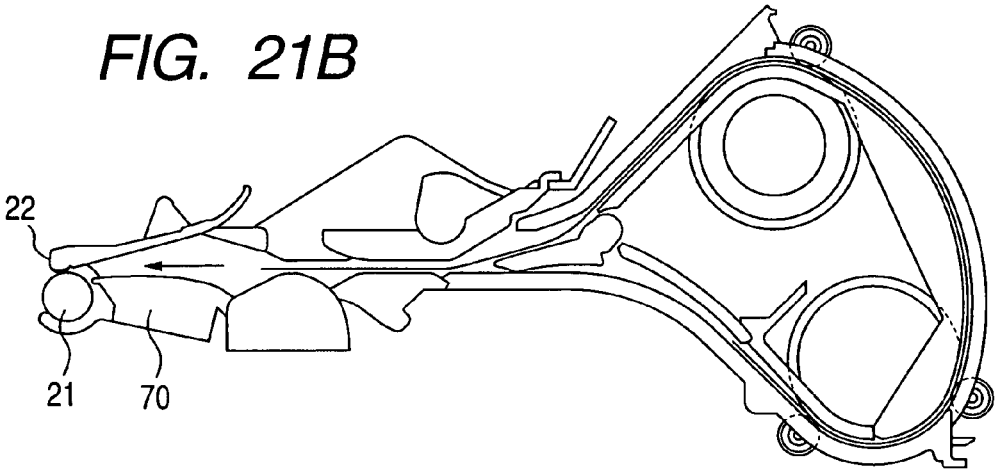
Figure 21C:
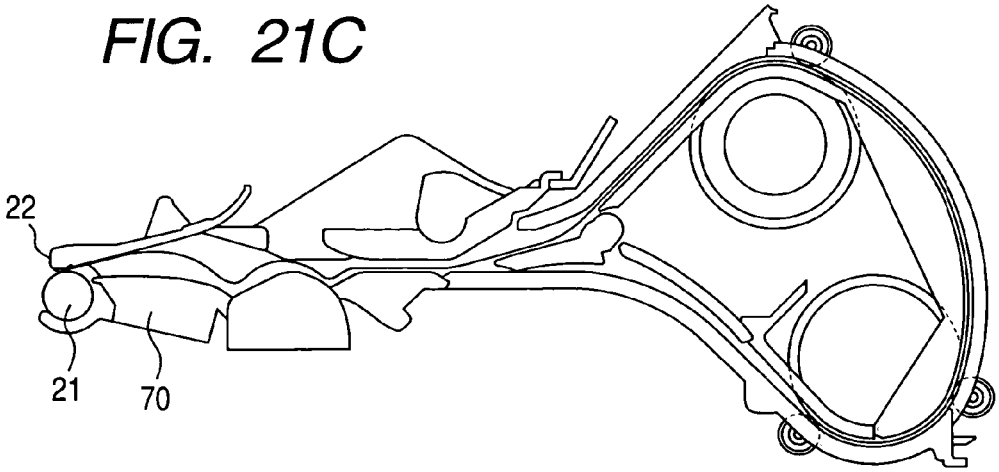

In the following, there will be explained a case of a thick recording sheet 4 of a relatively high rigidity. FIGS. 21A to 21C are schematic lateral cross-sectional views showing registration of the front end of the back side in case of employing a thick recording sheet 4. FIG. 21A shows a state in the course of a step S13 as in FIG. 20A, and FIG. 21B shows a state after the end of the step S13.

Then a step S20, while maintaining the sheet guide 70 in the lowered position, rotates the LF motor 26 in the reverse direction, thereby conveying the recording sheet 4 by a distance X4 slightly longer than a distance from the position of the front end of the back side of the recording sheet 4 at the end of the step S13 to the nip of the sheet conveying roller 21. Thus, as in the case of the thin recording sheet 4, the front end of the back side of the recording sheet 4 reaches the nip portion of the sheet conveying roller 21 rotated in the reverse direction, and the recording sheet is further advanced to form a loop therein, whereby the front end of the back side of the recording sheet 4 becomes parallel to the sheet conveying roller 21 and thus completing the registration operation. FIG. 21C shows a state at the completion of the step S20.

Then a step S21 changes the LF motor 26 to the rotation in the normal direction thereby pinching the front end of the back side of the recording sheet 4 in the nip portion and executing a conveying by a predetermined distance X3, thus completing a preparation for starting the recording on the back side. In the step S19 or S21, the LF motor 26 which has rotated in the reverse direction changes the rotation to the normal direction. At this point, the both-side pendulum arm 117 rocks to a direction a in FIG. 17. In response, the second both-side planet gear 119 and the first inversion delay gear 121 are disengaged. At the reverse rotation of the LF motor 26, the first inversion delay gear 121 and the second inversion delay gear 122 are in a state mutually engaging by projections thereof, and the inversion delay gear spring 124, which is a torsion coil spring sandwiched between the two, is compressed. Thus, when the first inversion delay gear 121 is freed, the inversion delay gear spring 124 extends and the first inversion delay gear 121 rotates by about a turn in the reverse direction thereby returning to the initial state as shown in FIG. 18F.

Then a step S22 shifts the lift mechanisms to the first position as shown in FIG. 11A, thus completing the preparation for starting the recording of the back side. Now there will be explained reason why the sheet guide 70 is maintained in the lowered state during the registration operation with the thick recording sheet 4. In case of trying to generate a loop in the same manner as in the thin recording sheet 4 as shown in FIG. 20C, the recording sheet 4, because of its high rigidity, is conveyed along the pinch roller holder 23 even before arriving at the nip portion. Therefore, in case of executing an additional conveying for forming a loop after the recording sheet 4 arrives at the nip portion, there is no space for loop formation and the loop cannot be formed. Therefore, a satisfactory registration may not be achievable.

Also in case a loop is not formed, the recording sheet 4 has no slack in a state simultaneously supported by the first both-side roller 108 and the sheet conveying roller 21. In case the drive mechanism for the both-side rollers employs a mechanism such as a both-side pendulum arm 117 as in the present embodiment, there is required a time for rocking of the both-side pendulum arm 117 within a period from the rotation of the LF motor 26 in the normal direction in the step S20 to the rotation of the LF motor 26 in the reverse direction in the step S21, and the both-side rollers 108 and 109 remain stopped during such period.

The sheet conveying roller 21, being directly connected to the LF motor 26, has no such stopping period, thus generating a contradiction in the sheet conveying speed. If the recording sheet 4 has a slack, the contradiction in the sheet conveying speed can be absorbed by taking up such slack of the recording sheet 4 during the step S21. In the absence of such slack, the contradiction in the sheet conveying speed cannot be absorbed and the sheet conveying roller 21 forcedly tries to convey the recording sheet 4, but there may result a situation where the recording sheet 4 is not actually conveyed because it is pinched in a rear portion by the first both-side roller 108. Such situation may result in an erroneous conveying amount of the front end portion of the back side of the recording sheet 4, thus providing an upper margin, on the back side, shorter than an intended value. In the present embodiment, in order to avoid the aforementioned drawbacks, the sheet guide 70 is maintained in the lowered state, thereby forming a sufficient space in the height to the pinch roller holder 23 and securing a loop forming space. It is thus rendered possible to achieve satisfactory registration even in case of using a thick recording sheet of a relatively high rigidity.

Then a step S23 executes a recording operation on the back side of the recording sheet 4. At this moment, the rear end portion of the back side of the recording sheet 4 is still pinched by the first both-side roller 108 in most cases. It is undesirable to stop the rotation of the first both-side roller 108 immediately since it may become a load for pulling the recording sheet 4 backward, thus deteriorating the precision of the sheet conveying. Therefore, the drive of the first both-side roller 108 is continued at least while the rear end portion of the back side of the recording sheet 4 is pinched by the first both-side roller 108. A state of the drive mechanism for the both-side rollers is shown in FIG. 18D.

FIG. 18D shows a state of the drive mechanism for the rollers of the sheet inverting portion 2 while the LF motor 26 is rotated in the normal direction after the inversion of the recording sheet 4. When the rotation of the LF motor 26 is changed to the normal direction from the state shown in FIG. 18C, the both-side pendulum arm 117 rocks in a direction a in FIG. 17. In this state, since the stop arm 127 is rocking in a direction h in FIG. 17, the both-side pendulum arm spring 132 does not contact the stop arm 127 when the both-side pendulum arm 117 rocks in the direction a in FIG. 17, whereby the first both-side planet gear 118 engages with the both-side roller idler gear 124 to achieve transmission of the driving power.

When the LF motor 26 continues to rotate in the normal direction thereafter, the follower pin 127*a* is guided by the spiral groove gear 120 and moves toward the internal circumference, whereby the stop arm 127 rocks in a direction g in FIGS. 15A and 15B. In the course of such rocking motion, the stop arm 127 contacts the both-side pendulum arm spring 132 thereby causing a deformation thereof. The deformation of the both-side pendulum arm spring 132 generates a repulsive force acting to rock the both-side pendulum arm 117 in the direction b in FIG. 17, but, during the transmission of the driving power between the first both-side planet gear 118 and the both-side roller idler gear 124, a force generated by meshing of the teeth thereof is stronger, whereby the first both-side planet gear 118 and the both-side roller idler gear 124 are not disengaged and continue the drive. FIG. 18D shows such state.

Also in case of an intermittent drive involving rotation and stopping, the first both-side planet gear 118 and the both-side roller idler gear 124 are not disengaged because of the meshing of the gear teeth. When the recording operation on the back side of the recording sheet 4 is continued by the normal rotation of the LF motor 26, the follower pin 127*a* reaches the innermost circumference of the spiral groove gear 120. FIG. 18E shows the drive mechanism for the both-side rollers in such state. In this state, the both-side pendulum arm spring 132 shows a maximum displacement, but, since the load of the both-side pendulum arm spring 132 is so selected that the force generated by the meshing of the gear teeth becomes larger than the force for rocking the recording sheet both-side arm 117, the gears are not disengaged as long as the LF motor 26 continues to rotate in the normal direction. When the recording operation on the back side of the recording sheet 4 is completed, the flow proceeds to a step S24.

Then a step S24 executes a sheet discharging operation of discharging the recording sheet 4 onto an unillustrated discharge tray. The sheet discharging operation can be executed by continuing the rotation of the LF motor 26 in the normal direction, thereby conveying the recording sheet 4 by the second sheet discharge roller 31 to the exterior of the main body 1 of the recording unit.

Then a step S25 executes a confirmation of an absolute position of the front end of the back side. This operation is executed because the follower pin 127*a* may not have reached the innermost circumference of the spiral groove gear 120 in case a short recording sheet 4 is employed. In such situation, the LF motor 26 is rotated corresponding to a predetermined length, whereby the follower pin 127*a* is always brought to the innermost circumference of the spiral groove gear 120 when the back side recording operation for the recording sheet 4 is completed.

Then a step S26 executes an initialization of the drive mechanism for the both-side rollers. As the both-side pendulum arm spring 132 is maintained in a charged state by the engagement of the first both-side planet gear 118 and the both-side roller idler gear 124 as explained above, they can be easily disengaged by a little rotation of the LF motor 26 in the reverse direction. More specifically, in response to a rotation of the LF motor 26 in the reverse direction, the both-side pendulum arm 117 tends to rock in a direction b in FIGS. 17 to 18A to 18E, whereby the first both-side planet gear 118 and the both-side roller idler gear 124 are disengaged and the both-side pendulum arm 117 rocks at once in the direction b in FIGS. 17 to 18A to 18E, by a returning force of the charged both-side pendulum arm spring 132. FIG. 18F shows the drive mechanism for the both-side rollers in such state.

In case the LF motor 26 is rotated in the normal direction in this state shown in FIG. 18F where the both-side pendulum arm spring 132 has returned to the original state, the both-side pendulum arm 117 tends to rock in a direction a in FIG. 17 but, since the follower pin 127*a* is positioned in the vicinity of the innermost circumference of the spiral groove gear 120, the both-side pendulum arm spring 132 impinges on the stop arm 127 and the first both-side planet gear 118 cannot engage with the both-side roller idler gear 124. Even if the LF motor 26 is further rotated in the normal direction, the follower pin 127*a* continues to rotate on the innermost circumference of the spiral groove gear 120, so that the first both-side roller 108 and the second both-side roller 109 cannot be driven.

As explained in the foregoing, in a both-side recording apparatus including a sheet conveying roller 21, a recording portion 11 and a sheet inverting portion 2 in which a recording sheet 4 is subjected to a recording on a first side (front side) in the recording portion, then conveyed by the sheet conveying roller to the sheet inverting portion and supported after the inversion by the sheet conveying roller again for recording on a second side (back side), the present embodiment is so constructed that, after the recording sheet 4 is conveyed from the sheet inverting portion 2 and is supported again by the sheet conveying roller 21, the both-side roller 109 terminates rotation synchronized with the sheet conveying roller 21 within a period from the disengagement of the rear end of the recording sheet from the both-side roller 108 to the end of the discharging operation of the recording sheet.

In the aforementioned embodiment, there is employed a configuration that the both-side roller 109 terminates rotation synchronized with the sheet conveying roller 21 by second clutch means (FIGS. 17 and 18A to 18F) which is disconnected by rotating the sheet conveying roller 21 by a predetermined amount in a second rotating direction (rotation of normal direction) for conveying the recording sheet from the sheet inverting portion 2 toward the sheet conveying roller 21 and then rotating the sheet conveying roller by a predetermined amount in a first rotating direction (rotation of reverse direction). The second clutch means also includes mechanisms 120, 127, 132 for constricting the both-side pendulum arm 117 supporting the planet gears 118, 119. The second clutch means further includes a time-shift mechanism by a spiral end face cam (spiral groove gear 120) and a cam follower (stop arm 127).

Also in the above-mentioned configuration, as explained in the foregoing, after the recording on the first side (front side), the both-side roller 109 starts rotation in synchronization with the sheet conveying roller 21, within a period from the start of drive of the sheet conveying roller 21 to the pinching of the front end of the recording sheet 4 by the both-side roller 109 of the sheet inverting portion 2, and the synchronized rotation of the both-side roller 109 and the sheet conveying roller 21 is achieved by first clutch means (FIGS. 17 and 18A to 18F) which is connected by rotating the sheet conveying roller 21, by a predetermined amount, in a first rotating direction (reverse rotation) for conveying the recording sheet 4 to the sheet inverting portion 2.

In a state shown in FIG. 18F, as the first inversion delay gear 121 is already initialized in the step S19 or S21, the step S26 completes the initialization of the drive mechanism for all the both-side rollers.

Thus the auto both-side recording operation is terminated. A same sequence is repeated in case of executing an auto both-side recording operation in continuation.

In the present embodiment, an elastic impingement is realized between the both-side pendulum arm 117 and the stop arm 127 by the function of the both-side pendulum arm spring 132, but the present invention is not limited to such configuration and may also be constructed as shown in FIGS. 22A to 22E. FIGS. 22A to 22E are schematic lateral cross-sectional views, like FIGS. 18A to 18F, showing function states of a roller drive mechanism of the sheet inverting portion 2. A both-side pendulum arm 117 shown in FIGS. 22A to 22E is provided with an arm of a low elasticity, and such arm and the stop arm 127 are so arranged as to mutually impinge. Functions in this configuration will be briefly explained in the following.

Figure 22A:
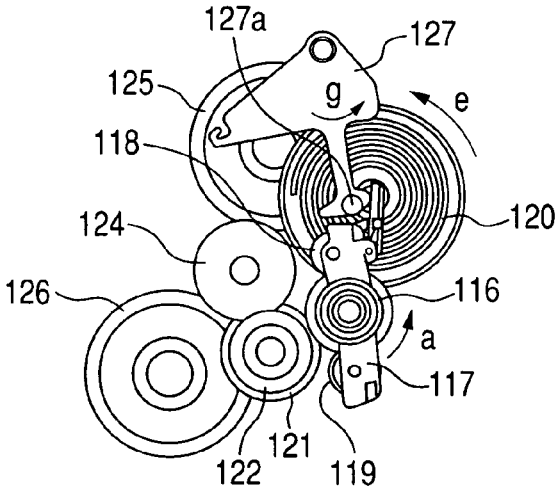
FIGS. 22A, 22B, 22C, 22D, and 22E are schematic lateral cross-sectional views showing function states of the roller drive mechanism of the auto both-side unit.
Figure 22D:
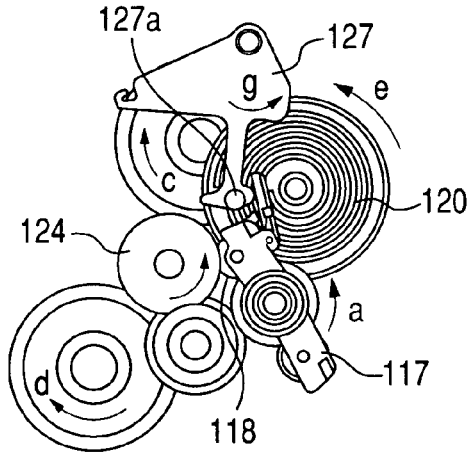
Figure 22B:
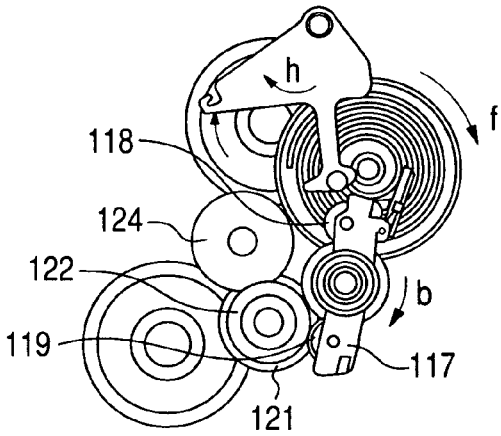
Figure 22E:
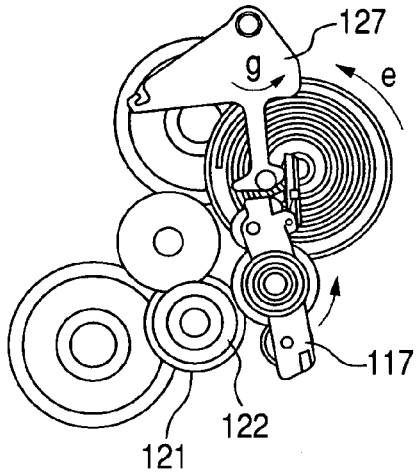
Figure 22C:
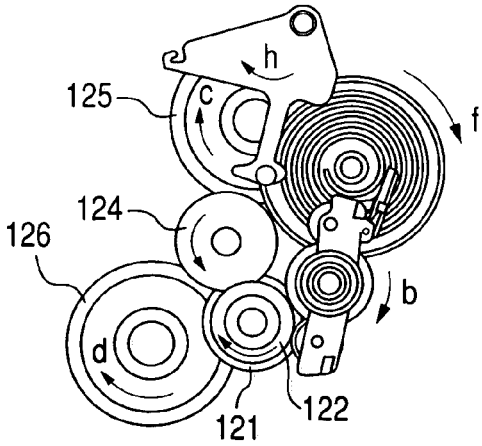

Functions from FIGS. 22A to 22C are similar to those shown in FIGS. 18A to 18C and will not, therefore, be explained further.

FIG. 22D shows a state where the stop arm 127 has moved toward the internal circumference of the spiral groove gear 120 and impinges on the arm of the both-side pendulum arm 117. When the arm 142 of the both-side pendulum arm 117, not having much elasticity, is pushed by the stop arm 127, exerts a force to rock the both-side pendulum arm 117 in a direction b in FIG. 17 on the both-side pendulum arm 117. Such force acts in a direction to disengage the first both-side planet gear 118 and the both-side roller idler gear 124.

Such disengaging force is balanced with a pressure between the teeth of the first both-side planet gear 118 and the both-side roller idler gear 124 and an elastic and sliding force of such gear teeth, but the disengaging force becomes larger as the follower pin 127*a* moves toward the internal circumference and overcomes the forces between the gear teeth, thereby forcedly disengaging the first both-side planet gear 118 and the both-side roller idler gear 124. The rotation of the first both-side roller 108 and the second both-side roller 109 is stopped simultaneously with the disengagement. This state is shown in FIG. 22E. Such stopping of the roller rotation is executed at a suitable timing, in the step S23, after the rear end of the back side of the recording sheet 4 has passed the first both-side roller 108.

In the configuration shown in FIGS. 22A to 22E, there is employed, instead of the second clutch means explained in FIGS. 18A to 18F, third clutch means 120, 127, 142 which is disconnected by a rotation of a predetermined amount of the sheet conveying roller 21 in the second rotating direction (normal rotation), thereby terminating the synchronized rotation of the both-side roller 108 with the sheet conveying roller 21. The third clutch means in the configuration of FIGS. 22A to 22E also includes a mechanism for a forced displacement of the both-side pendulum arm 117 supporting the planet gears 118, 119, and also includes a time-shift mechanism by a spiral end face cam (spiral groove gear 120) and a cam follower (stop arm 127).

Also the both-side recording apparatus having the mechanism shown in FIG. 17 is so constructed that, after the recording on the first side (front side), the both-side roller 109 starts to rotate in synchronization with the sheet feeding roller 21 within a period from the start of drive of the sheet conveying roller 21 to the pinching of the front end of the recording sheet 4 by the both-side roller 109 of the sheet inverting portion 2, and that the synchronized rotation of the both-side roller 109 with the sheet conveying roller 21 is started by the first clutch means (FIGS. 17, 18A to 18F) which is connected by a rotation of a predetermined amount of the sheet conveying roller 21 in the first rotating direction (reverse rotation) for conveying the recording sheet 4 to the sheet inverting portion 2.

After the gear disengagement as shown in FIG. 22C, the sheet inverting portion 2 is not driven until the LF motor 26 is rotated by a predetermined amount in the reverse direction, since, even when the LF motor 26 is rotated in the normal direction, the both-side pendulum arm 117 is prevented from a rocking motion in the direction a in FIG. 17 by means of the stop arm 127. Also as in the configuration shown in FIGS. 18A to 18F, the first inversion delay gear 121 is initialized in the step S19 or S21, so that the drive mechanism for the rollers of the sheet inverting portion 2 is already initialized at this point. It is therefore possible to avoid the load for rotating the first both-side roller 108 and the second both-side roller 109 during the recording operation on the back side, thereby reducing the rotational load on the LF-motor 26.

In the following, there will be explained a method of feeding and recording on a thick recording sheet.

Figure 23:
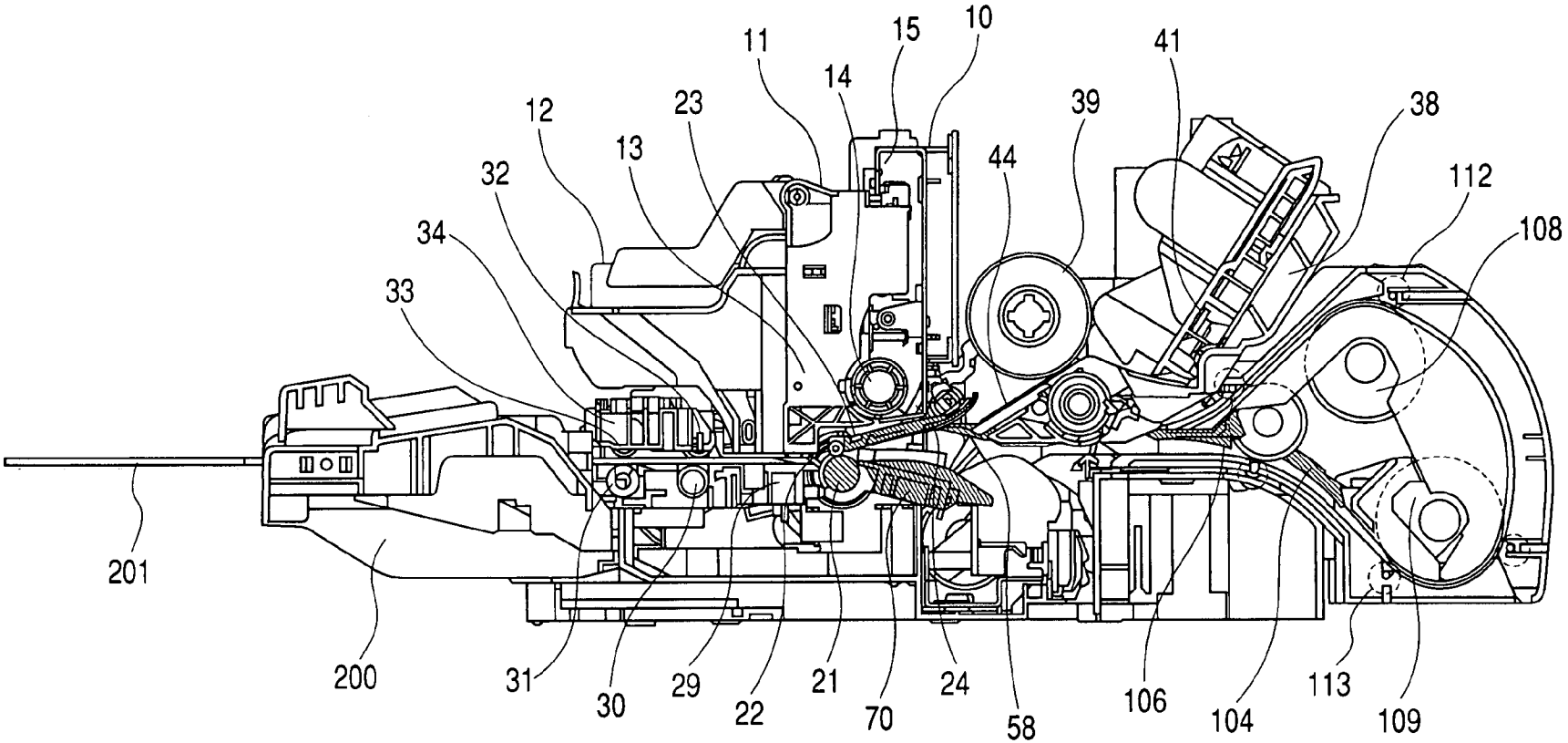
FIG. 23 is a schematic lateral cross-sectional view showing a state in which a sheet guide exclusive for a thick recording sheet is mounted on the recording apparatus.

As already explained in the foregoing, the both-side recording apparatus of the present embodiment is also capable of feeding and recording a thick recording sheet of a high rigidity. FIG. 23 shows a state where an exclusive feeding guide for a thick recording sheet is mounted on the recording apparatus.

As the thick recording sheet cannot be fed from the main ASF 37 because of a curved sheet path, the exclusive thick sheet guide 200 is mounted as guide means at the sheet discharge side of the recording apparatus. The main body of the recording apparatus is provided with a mechanism (not shown) for retracting the first spur array 32 and the second spur array 33 in linkage with the operation of mounting the thick sheet guide 200 on the main body, in order not to hinder the sheet passing from the side of the thick sheet guide 200. Thus, a thick sheet can be easily inserted from the side of the thick sheet guide 200 to immediately before the sheet conveying roller 21.

However, in case the recording medium is a thick recording sheet 201 which may have a thickness up to several millimeters, it cannot be pushed into the nip of the pinch roller 22 but the front end of the sheet merely collide with the pinch roller 22 in case the thickness is equal to or larger than the radius of the pinch roller 22. Also, even in case the thick recording sheet 201 has a thickness allowing such pressing-in, such pressing operation requires power and is undesirable for the operator. It is also possible to manually release the pinch roller 22 by the operator and to manually contact the pinch roller 22 again after the sheet feeding, but such configuration is unsatisfactory in the work efficiency.

Therefore, the recording apparatus of the present embodiment utilizes the pinch roller releasing mechanism, which moves the pinch roller 22 between a position in contact with the sheet conveying roller 21 and a position separated from the sheet conveying roller 21, thereby enabling easy insertion of the thick recording sheet 201. As already explained in FIGS. 5A to 5C, the pinch roller 22 can be shifted from an initial state shown in FIG. 5A to a released state shown in FIG. 5B by a rotation of the lift cam shaft 58.

Now a state where the thick sheet guide 200 is mounted on the recording apparatus is defined as a first mode in which the recording medium is supplied to the conveying portion (nip of the sheet conveying roller 21) from a downstream side in a normal conveying direction to an upstream side, a state where the thick sheet guide 200 is detached from the recording apparatus is defined as a second mode in which the retraction is made from the conveying path of the recording medium when it is conveying in the normal conveying direction of the conveying portion from the upstream side to the downstream side.

When a sheet guide sensor 202 (see FIGS. 1 and 3) provided in the main body of the recording apparatus for detecting whether thick sheet guide 200 is mounted on the main body of the recording apparatus detects that the thick sheet guide 200 is mounted on the main body of the recording apparatus (shift of the thick sheet guide 200 from the second mode to the first mode), and a recording operation start signal is released from a controller of the recording apparatus, the pinch roller 22 is shifted from the initial state to the released state and the sheet conveying roller 21, the first sheet discharge roller 30 and the second sheet discharge roller 31 are rotated in a direction opposite to that in a sheet discharging operation, thereby automatically feeding a thick recording sheet 201. In this operation, the sheet discharge rollers 30, 31 function as reverse conveying means for conveying the recording medium in a direction (direction b in FIG. 2) opposite to the normal conveying direction (direction a in FIG. 2) in the recording operation, namely from the downstream side to the upstream side in the normal conveying direction.

The timing of release of the pinch roller 22 is not limited to the foregoing, and, the pinch roller 22 may be released, for example, upon detection of the mounting of the thick sheet guide 200 on the recording apparatus by the aforementioned sensor 202. In such case, when a recording operation start signal is released from the controller, the thick recording sheet 201 can be fed by immediately rotating the sheet discharge rollers in the reverse direction.

When a front end of the thick recording sheet 201 passes through the nip of the sheet conveying roller 21 and the pinch roller 22, the pinch roller 22 is shifted from the released state to a light pressure state shown in FIG. 1C. When the thick recording sheet 201 is pressed in this state, the pressure become approximately same as that in case of pressing an ordinary sheet in the initial state of the pinch roller 22 as explained in the foregoing, so that the drive load for the LF motor 26 scarcely changes. It is thus possible to guide the thick recording sheet 201 to the side of the sheet inverting portion 2 by a reverse rotation of the sheet conveying roller 21.

Thus the recording apparatus of the present embodiment can automatically execute, by a mere mounting of the thick sheet guide 200 on the recording apparatus, separating-pressing operation of the pinch roller 22 and a feeding operation of conveying the thick recording sheet 201 to the conveying portion (nip of the sheet conveying roller 21) in a direction opposite to the ordinary conveying direction, thereby dispensing with the manual separating-pressing operations of the pinch roller 22 by the user and improving the operability of the recording apparatus. Also at the feeding of the thick recording sheet 201 from the thick sheet guide 200, the pinch roller 22 is separated from the sheet conveying roller 21, so that the feeding does not require an exclusive thick recording sheet having a thin tapered front end.

In this state, the carriage 13 supporting the recording portion 11 is in a third carriage position as already explained in FIG. 12, so that the gap between the recording portion 11 and the thick recording sheet 201 in the conveying path does not become small but is maintained at an appropriate value.

More specifically, the recording apparatus of the present embodiment is provided with a lift mechanism constituting means for changing the position of the recording portion, capable of changing the carriage 13 supporting the recording portion 11 between a first position (third position in FIG. 11C) relatively far from the recording sheet conveyed by the sheet conveying roller 21 of the conveying portion to a position opposed to the recording portion 11 and a second position (first position in FIG. 11A) relatively near to the recording sheet. Such lift mechanism is so constructed as to place the carriage 13 at the first position when the thick sheet guide 200 is mounted on the recording apparatus (when the thick sheet guide 200 is in the first mode) or to place the carriage 13 at the second position when the thick sheet guide 200 is not mounted on the recording apparatus (when the thick sheet guide 200 is in the second mode), so that an appropriate distance can be maintained between the recording portion 11 and the recording medium when a thick recording sheet 201 is supplied as the recording medium or when a relatively thin ordinary paper is supplied as the recording medium.

The releasing mechanism for the pinch roller 22 and the lift mechanism are so constructed as to function in mutual synchronization as explained above by a single drive source constituted by the ASF motor 46 provided in the recording apparatus.

When the thick sheet guide 200 is mounted on the recording apparatus (when the thick sheet guide 200 is in the first mode), the sheet guide 70 constituting a part of the conveying path for the recording medium and capable of assuming a first path state (down state shown in FIG. 7B) constituting a straight conveying path or a second path state (up state shown in FIG. 7A) constituting a curved conveying path, is placed in a down state to provide a straight conveying path, whereby the thick recording sheet 201 can be conveyed without bending and without applying a load to the conveying mechanism or the drive source therefor. When the thick sheet guide 200 is detached from the recording apparatus (when the thick sheet guide 200 is in the second mode), the sheet guide 70 is placed in an up state.

Further, the recording apparatus of the present embodiment is provided, as explained in FIGS. 6A and 6B, with a PE sensor lever, constituting recording medium detection means for detecting whether a recording medium is present in the conveying path. The PE sensor lever 66 can be positioned in an initial detecting position (FIG. 6A) in which it is at least partly provided in the conveying path and capable of detecting presence/absence of the recording medium in the conveying path, or a retracted locked position (FIG. 6B) in which it is retracted from the conveying path. When the thick sheet guide 200 is mounted on the recording apparatus (when the thick sheet guide 200 is in the first mode), the PE sensor lever 66 is placed in the retracted locked position and does not interfere with the thick recording sheet 201 even when it is passed in the direction b in FIG. 2, opposite to the normal conveying direction. When the thick sheet guide 200 is detached from the recording apparatus (when the thick sheet guide 200 is in the second mode), the PE sensor lever 66 is placed in the initial state.

Therefore, the thick recording sheet 201 can be smoothly moved in the directions a and b in FIG. 2 for an appropriate recording operation.

The conveying operation may also be executed by positioning the pinch roller 22 in the initial state instead of the light pressure state, depending on the type of the thick recording sheet 201. In such case, the sheet guide 70 is placed in the up state, but the rigidity of the thick recording sheet 201 itself overcomes the power of the sheet guide spring 71, thereby achieving the conveying of the thick recording sheet 201 in the down state of the sheet guide 70.

Figure 24:
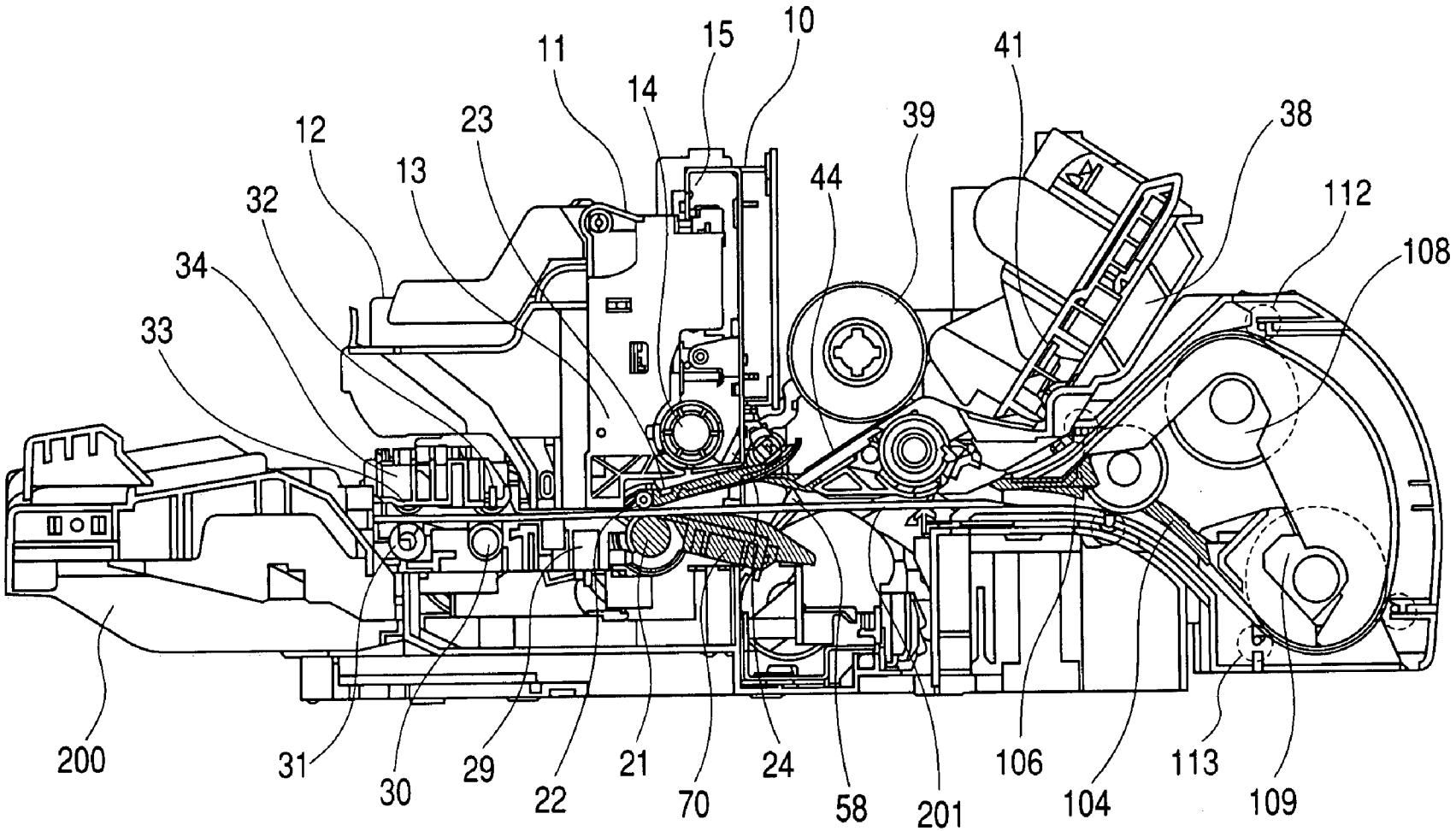
FIG. 24 is a schematic lateral cross-sectional view showing a state in which a thick recording sheet is in the course of conveying.

FIG. 24 is a schematic lateral cross-sectional view in the course of conveying of the thick recording sheet 201. In case the thick recording sheet 201 has a large length, it is conveyed penetrating through the sheet inverting portion 2 as explained in FIGS. 5A and 5B. When the rear end (at the sheet discharge side) of the thick recording sheet 201 is conveyed to a start position allowing recording by the recording portion 11, the intake operation is completed to wait for a recording operation.

Then a recording operation is executed by reversing the conveying direction of the thick recording sheet 201 by rotating the sheet conveying roller 21 in the normal direction, and the recording on the thick recording sheet 201 can thus be executed in the same manner as in the normal recording operation. After the recording operation, the sheet discharge rollers are rotated in normal direction to discharge the thick recording sheet 201 on the thick sheet guide 200, thereby completing all the recording operations. Thereafter the main body of the recording apparatus can be return to the initial state by returning the pinch roller 22 to the initial state. More specifically, the carriage 13 returns to the first carriage position, the sheet guide assumes the up state and the PE sensor lever 66 assumes the free position. In case of recording continuously on plural thick recording sheets 201, a recorded thick recording sheet 201 is removed from the thick sheet guide and a new thick recording sheet 201 is set whereby the recording can be achieved in the same manner as explained in the foregoing.

The state of the pinch roller 22 is not limited to as explained above, but may for example be shifted to the released state after the discharge operation for the thick recording sheet 201. In this case, the pinch roller 22 may be returned to the initial state upon detection by a sensor (not shown) that the thick sheet guide 200 is detached from the main body of the recording apparatus.

The thick recording sheet 201 is not limited to a cardboard of a single material, but can also be a disk-shaped recording medium such as CD-R or DVD placed on an exclusive supporting tray, which can be handled as the thick recording sheet 201. Recording on various materials or various forms is also made possible by preparing an exclusive supporting tray for an abnormally shaped medium.

The thick sheet guide 200 explained above is rendered detachably mountable on the main body of the recording apparatus, but the present invention is not limited to such configuration and the thick sheet guide may be alterable in its form in a state mounted on the main body of the recording apparatus, such as by folding to or incorporating in the main body.

For example, it is possible to form a discharge tray (not shown), mounted in a downstream side of the sheet discharge rollers 30, 31 of the recording apparatus in the normal conveying direction, with a variable height to serve also as guide means for supplying a recording medium to the conveying portion (nip of the sheet conveying roller 21) from the downstream side of the normal conveying direction. More specifically, the sheet discharge tray as the guide means may be rendered variable between a first height for guiding the recording medium to the conveying portion (nip of the sheet conveying roller 21) from the downstream side of the normal conveying direction and a second height retracted from the conveying path of the recording medium in case the conveying portion conveys the recording medium in the normal conveying direction from the upstream side to the downstream side. The sheet discharge tray functions as guide means in the first height, and functions as an ordinary sheet discharge tray at the second height.

In such case, the main body of the recording apparatus is provided with a sensor (not shown) for detecting whether the sheet discharge tray, serving as the guide means, is in the first height or in the second height. Such sensor detects whether the sheet discharge tray is in the first or second state, and the functions of the recording apparatus after such detection are similar to those explained in the foregoing when the thick sheet guide 200 is provided.

In the foregoing, embodiments of the recording apparatus embodying the present invention have been explained, including the auto both-side recording operation based on flow chart showing the operation sequence.

In the foregoing, embodiments have been explained by a serial type recording apparatus in which the recording is executed under a movement of a recording head, in the main scanning direction, but the present invention is likewise applicable to and provides similar effects in a line type recording apparatus utilizing recording means of line type of a length covering the entire width of the recording sheet or a part thereof and achieving recording by a sub scanning (sheet conveying) only.

Also the present invention can be executed regardless of the number of the recording means, and is likewise applicable to and provides similar effects not only in a recording apparatus utilizing single recording means but also a recording apparatus for color recording, utilizing plural recording means for inks of different colors, a recording apparatus for gradation recording, utilizing plural recording means for inks of different concentrations of a same color, and a recording apparatus combining these.

Furthermore, in case the recording apparatus is an ink jet recording apparatus, the present invention is likewise applicable to and provides similar effects in any configuration of a recording head and an ink tank, for example, a configuration employing a replaceable head cartridge integrally containing a recording head and an ink tank, or a configuration in which an recording head and an ink tank are separate and connected with an ink supply tube.

Furthermore, in case the recording apparatus is an ink jet recording apparatus, the present invention is likewise applicable to and provides similar functions and effects not only in a recording apparatus utilizing an ink jet recording head of a type discharging ink by thermal energy, but also in the ink jet recording apparatus utilizing other ink discharging process such as a recording apparatus utilizing an ink jet recording head of an ink discharging process based on an electromechanical converting member such as a piezo element.

As explained in the foregoing, the embodiments of the present invention allow to provide a recording apparatus capable of reducing the operations to be executed by the user in case of employing a thick recording sheet for a recording operation, thereby improving the operability of the recording apparatus.

This application claims priority from Japanese Patent Application No. 2003-306415 filed on Aug. 29, 2003, which is hereby incorporated by reference herein.

What is claimed is:

1. A recording apparatus comprising:

a conveying portion, provided at an upstream side of a recording head, for conveying a recording medium by a conveying roller and a pinch roller pressed to the conveying roller;

a guide portion capable of assuming a first position where the recording medium can be supplied from a downstream side of the recording head and a second position where the recording medium cannot be supplied from the downstream side of the recording head;

detecting means which detects whether said guide portion is at the first position or at the second position; and displacing portion which seperates the pinch roller from a position in contact with the conveying roller when said detecting means detects that said guide portion is displaced from the second position to the first position.

2. A recording apparatus according to claim 1, wherein the displacing means separates the pinch roller from the conveying roller in response to a detection by said detecting means that said guide portion is moved from the second position to the first position and to an output of a start signal for a recording operation.

3. A recording apparatus according to claim 1, further comprising:

a changing portion which is capable of changing a recording portion between a first recording position having a relatively greater distance to the recording medium conveyed by said conveying portion to a position opposed to the recording portion and a second recording position in which the distance is lesser than the first recording position, wherein said changing portion positions the recording portion in the first recording position when said guide portion is in the first position and positions the recording portion in the second recording position when said guide portions is in the second position.

4. A recording apparatus according to claim 3, wherein said displacing portion and said changing portion are driven by a same drive source.

5. A recording apparatus according to claim 1, further comprising:

a sheet guide movable between a first form constituting a substantially straight conveying path and a second form constituting a curved conveying path, wherein said sheet guide assumes the first form when said guide portion is in the first position and assumes the second form when said guide portion is in the second position.

6. A recording apparatus according to claim 1, further comprising:

medium detecting means provided between the conveying roller and a recording portion and a movable between a detecting position capable of detecting presence/absence of the recording medium and a retracted position retracted from a conveying path of the recording medium, wherein said medium detecting means is provided in the retracted position when said guide portion is in the first position and is provided in the detecting position when said guide portion is in the second position.

* * * * *

UNITED STATES PATENT AND TRADEMARK OFFICE

CERTIFICATE OF CORRECTION

PATENT NO. : 7,187,901 B2
APPLICATION NO. : 10/926144
DATED : March 6, 2007
INVENTOR(S) : Ohashi It is certified that error appears in the above-identified patent and that said Letters Patent is hereby corrected as shown below:

COLUMN 1:
Line 31, “However” should read --However,--.
Line 38, “Also” should read --Also,--.

COLUMN 5:
Line 10, “I'/F” should read --I/F--.
Line 53, “Also” should read --Also,--.

COLUMN 7:
Line 9, “Also” should read --Also,--.

COLUMN 8:
Line 3, “a” (second occurrence) should read --$\alpha$--.
Line 55, “leading” should read --leading to--.

COLUMN 10:
Line 12, “following” should read --following,--.
Line 50, “However” should read --However,--.

COLUMN 13:
Line 2, “down” (second occurrence) should be deleted.

COLUMN 14:
Line 46, “Also” should read --Also,--.

COLUMN 15:
Line 61, “Also” should read --Also,--.
Line 65, “Also” should read --Also,--.

COLUMN 17:
Line 9, “Also” should read --Also,--.
Line 12, “Also” should read --Also,--.
Line 16, “Also” should read --Also,--.
Line 17, “Also” should read --Also,--.
Line 19, “Also” should read --Also,--.
Line 21, “Also” should read --Also,--.
Line 51, “Also” should read --Also,--.
Line 54, “Also” should read --Also,--.
Line 57, “Also” should read --Also,--.

UNITED STATES PATENT AND TRADEMARK OFFICE

CERTIFICATE OF CORRECTION

PATENT NO. : 7,187,901 B2
APPLICATION NO. : 10/926144
DATED : March 6, 2007
INVENTOR(S) : Ohashi It is certified that error appears in the above-identified patent and that said Letters Patent is hereby corrected as shown below:

COLUMN 18:
Line 45, “Also” should read --Also,--.
Line 63, “following” should read --following,--.

COLUMN 19:
Line 35, “Also” should read --Also,--.
Line 53, “Also” should read --Also,--.

COLUMN 20:
Line 43, “Also” should read --Also,--.
Line 67, “Also” should read --Also,--.

COLUMN 21:
Line 27, “following” should read --following,--.

COLUMN 27:
Line 16, “Also” should read --Also,--.

COLUMN 32:
Line 12, “Also” should read --Also,--.

COLUMN 34:
Line 47, “Also” should read --Also,--.
Line 67, “Also” should read --Also,--.

COLUMN 36:
Line 43, “Also” should read --Also,--.

COLUMN 38:
Line 8, “return” should read --returned--.

UNITED STATES PATENT AND TRADEMARK OFFICE

CERTIFICATE OF CORRECTION

PATENT NO. : 7,187,901 B2
APPLICATION NO. : 10/926144
DATED : March 6, 2007
INVENTOR(S) : Ohashi It is certified that error appears in the above-identified patent and that said Letters Patent is hereby corrected as shown below:

COLUMN 40:
Line 6, “displacing portion” should read --a displacing portion--.
Line 10, “the” should read --said--.
Line 11, “means” should read --portion--.
Line 45, “a movable” should read --movable--.

Signed and Sealed this

Third Day of February, 2009

John Doll

JOHN DOLL
*Acting Director of the United States Patent and Trademark Office*